US008137886B2

(12) United States Patent
Baba et al.

(10) Patent No.: US 8,137,886 B2
(45) Date of Patent: Mar. 20, 2012

(54) MAGNETIC CARRIER, TWO-COMPONENT DEVELOPER AND IMAGE FORMING METHOD

(75) Inventors: Yoshinobu Baba, Yokohama (JP); Koh Ishigami, Mishima (JP); Tomoko Endo, Odawara (JP); Hiroyuki Fujikawa, Yokohama (JP); Kunihiko Nakamura, Gotemba (JP); Nozomu Komatsu, Mishima (JP); Chika Inoue, Berlin (DE); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 12/691,049

(22) Filed: Jan. 21, 2010

(65) Prior Publication Data

US 2010/0143833 A1 Jun. 10, 2010

Related U.S. Application Data

(63) Continuation of application No. PCT/JP2009/064093, filed on Aug. 4, 2009.

(30) Foreign Application Priority Data

Aug. 4, 2008 (JP) ..... 2008-201075
Aug. 4, 2008 (JP) ..... 2008-201076

(51) Int. Cl.
*G03G 9/08* (2006.01)
*G03G 9/113* (2006.01)

(52) U.S. Cl. ..... 430/110.3; 430/111.32; 430/111.41

(58) Field of Classification Search ..... 430/111.3, 430/111.31, 111.32, 111.33, 111.35, 111.41, 430/110.3
See application file for complete search history.

(56) References Cited

U.S. PATENT DOCUMENTS

| | | | | |
|---|---|---|---|---|
| 5,340,677 | A | 8/1994 | Baba et al. | |
| 5,518,849 | A | 5/1996 | Sato et al. | |
| 5,766,814 | A | 6/1998 | Baba et al. | |
| 6,294,305 | B1 | 9/2001 | Kobayashi et al. | |
| 7,344,816 | B2 | 3/2008 | Matsumura et al. | 430/124.31 |
| 7,566,519 | B2 | 7/2009 | Kobayashi et al. | 430/111.35 |
| 2005/0142478 | A1 | 6/2005 | Matsumura et al. | |
| 2006/0269862 | A1 | 11/2006 | Kobayashi et al. | 430/111.31 |
| 2007/0048649 | A1 | 3/2007 | Kobayashi et al. | 430/111.31 |
| 2008/0152396 | A1 | 6/2008 | Yamamoto et al. | 399/286 |
| 2008/0286668 | A1 * | 11/2008 | Ishigami et al. | 430/48 |
| 2009/0246675 | A1 | 10/2009 | Nakamura et al. | 430/111.31 |
| 2010/0028796 | A1 | 2/2010 | Nakamura et al. | 430/110.3 |
| 2010/0183971 | A1 * | 7/2010 | Fujikawa et al. | 430/110.3 |

FOREIGN PATENT DOCUMENTS

| | | |
|---|---|---|
| EP | 0 431 830 A1 | 6/1991 |
| JP | 07-120086 | 5/1995 |
| JP | 07-225497 | 8/1995 |
| JP | 7-120086 B | 12/1995 |
| JP | 08-160671 | 6/1996 |
| JP | 2759564 | 5/1998 |
| JP | 2890727 | 5/1999 |
| JP | 2954326 | 9/1999 |
| JP | 2000-330342 | 11/2000 |
| JP | 2001-034039 | 2/2001 |
| JP | 2004-302408 | 10/2004 |
| JP | 2005-195674 | 7/2005 |
| JP | 2006-195079 | 7/2006 |
| JP | 2006-337579 | 12/2006 |
| JP | 2007-057943 | 3/2007 |
| JP | 2007-218955 | 8/2007 |
| JP | 4001606 | 10/2007 |
| JP | 2008-122938 | 5/2008 |

OTHER PUBLICATIONS

International Search report issued in the corresponding International Application No. PCT/JP2009/064093 dated Aug. 4, 2009 (12 pages).
International Preliminary Report on Patentability and Written Opinion of the International Searching Authority, International Application No. PCT/JP2009/064093, Mailing Date Feb. 17, 2011.

* cited by examiner

*Primary Examiner* — Janis L Dote
(74) *Attorney, Agent, or Firm* — Fitzpatrick, Cella, Harper & Scinto

(57) ABSTRACT

A magnetic carrier is provided which uses a toner having high coloring power and enables development to be performed at low electric field intensity and can form high quality images while keeping gradation characteristics. The magnetic carrier includes magnetic carrier particles including at least porous magnetic core particles and a resin. The electric field intensity just before the break-down of the magnetic carrier is 1,300 V/cm or more and 5,000 V/cm or less.

11 Claims, 10 Drawing Sheets

MAGNETIC CARRIER, TWO-COMPONENT DEVELOPER AND IMAGE FORMING METHOD

This application is a continuation of International Application No. PCT/JP2009/064093, filed Aug. 4, 2009, which claims the benefit of Japanese Patent Application No. 2008-201075, filed Aug. 4, 2008, and Japanese Patent Application No. 2008-201076, filed Aug. 4, 2008.

BACKGROUND OF THE INVENTION

1. Field of the Invention

The present invention relates to a magnetic carrier to be contained in a developer which is used for electrophotography and an electrostatic recording method, a two-component developer having this magnetic carrier and a toner and an image forming method using a two-component developer.

2. Description of the Related Art

The process of developing an electrostatic charge image in electrophotography includes causing charged toner particles to adhere to the electrostatic charge image by utilizing an electrostatic interaction with the electrostatic charge image to thereby conduct image formation. A developer for developing an electrostatic charge image includes a one-component developer in which a magnetic substance is dispersed in a resin and a two-component developer in which a nonmagnetic toner mixed with a magnetic carrier is used. Particularly, the latter is preferably used in full color image forming apparatuses such as full color copying machines and full color printers in which high image quality is required. In addition, in late years, expansion of electrophotography into the field of print on demand (POD) brings about demands for high-speed printing ability and image printing, and as a result, high quality printed products having higher definition and no image defects have come to be desired.

Attempts to attain higher definition and higher image quality involve decreasing the toner particle size and decreasing the carrier particle size, and reducing the density and magnetic force of the carrier. A Mn—Mg ferrite is used in substitution for the conventional iron powder carrier or heavy metal ferrite so as to improve the quality and durability of the image in Japanese Patent Application Laid-Open No. 2000-330342. However, it cannot be said that the above-mentioned image quality desired in the POD print market is sufficiently satisfied, and further improvement in image quality and stability during extensive operation are needed. On this account, magnetic substance dispersion type resin carrier in which a magnetic substance is dispersed in a resin has been proposed for attaining a carrier having lower specific gravity and lower magnetic force. A magnetic substance dispersion type resin carrier having high electric resistance and lower magnetic force is proposed in Japanese Patent Application Laid-Open No. H8-160671. However, when such a carrier as mentioned above becomes lower in density and in magnetic force, it is possible to attain sufficiently high image quality and high definition and a further improvement in durability, but the developing characteristics may deteriorate. The cause of the deterioration in the developing characteristics is deterioration in the electrode effect, which is caused by higher resistance of the carrier. As a result, the toner at the end edge of the half tone part may be scratched off on the border between the half tone image part and the solid image part to cause white streaks and generate an image defect in which the edge of the solid image part is emphasized (hereinafter referred to as blank areas).

A resin filling type ferrite carrier in which pores of a carrier having a porosity of 10 to 60% which are filled with a resin is proposed in Japanese Patent Application Laid-Open No. 2006-337579 as a material substituted for the magnetic substance dispersion type resin carrier. Furthermore, a carrier having a structure in which pores of a porous ferrite core material are filled with a resin is proposed in Japanese Patent Application Laid-Open No. 2007-57943. These are low in specific gravity and strong against mechanical stress, and can produce a sufficient image density. They are excellent also in developing characteristics, and exhibit performance stable for a long period of time. However, in the field of POD where higher image quality is pursued, not only high developing characteristics and durability but also fewer image defects in each image on each sheet are required. Besides, as mentioned later, further improvement is necessary in the above carrier to obtain sufficient developing characteristics when the laid-on toner amount is reduced.

In addition, a carrier in which porous parts thereof are filled with a resin and the total volume of pores is defined and which uses a carrier core material having an electric resistance of $10^5$ Ω·cm or more when a voltage of 500 V is applied is proposed in Japanese Patent Application Laid-Open No. 2007-218955. Japanese Patent Application Laid-Open No. 2007-218955 proposes a high-resistant carrier in which break-down is suppressed when a high voltage is applied. However, as mentioned above, when a carrier having an increased resistance is used, the developing characteristics may deteriorate and, as a result, image defects such as blank areas may be generated.

As a carrier which can provide clear black solid printing and inhibit carrier adhesion, a carrier which shows reversible and abrupt changes of electric resistance of $10^3$ Ω·cm or more when the electric field intensity crosses the border of 1000 V/cm is proposed in Japanese notification Patent Gazette No. H07-120086. This carrier is one having a thin layer coating on a relatively low electric resistance carrier core particle. This carrier allegedly exhibits low electric resistance at high electric field intensity, which enhances the developing characteristics, while increasing the electric resistance of the carrier at lower electric field intensity, thereby inhibiting carrier adhesion. However, when a carrier which shows an abrupt change in electric resistance across the border of electric field intensity of 1000 V/cm is adopted in a developing apparatus to which an alternating electric field is applied, injection of electric charges may occur, which causes a roughened region in the half tone part. Besides, leaking of the electric charges may not be prevented, which may cause white spots.

It is necessary to achieve three factors, high speed, high image quality and low running cost, when an image forming method according to an electrophotographic method is contemplated to be applied to the field of POD. As characteristics expected of a toner, it is essential to achieve higher image quality and higher definition image as compared with the conventional level without narrowing a color gamut reproduction range. It is also essential to reduce toner consumption. Furthermore, it is necessary to reduce fixation energy and to adapt to various types of transfer materials.

Japanese Patent Application Laid-Open No. 2005-195674 makes a suggestion that problems such as blister are inhibited from occurring at the time of fixation while toner consumption is reduced by reducing the laid-on toner amount to 0.35 mg/cm$^2$ or less, to thereby form high quality and high definition color images which stably have a wide color gamut reproduction range. According to this suggestion, it is allegedly possible to form high quality and high definition color images which stably have a wide color reproduction range, are reduced in roughening and are excellent in fixing properties. When a toner including toner particles having an increased amount of a coloring agent is used in a conventional electrophotographic system, a certain effect can be expected on the fixation characteristics, but the chroma of images may be lowered and the color gamut of images may be narrowed. The reason for these is presumed to be that as a result of increasing the amount of the coloring agent, the dispersion state of the coloring agent becomes worse, the hue is changed, the chroma of images is lowered, and the color gamut is narrowed.

As stated above, density stability and gradation characteristics are liable to deteriorate at the time of long-time use when the amount of a coloring agent contained in toner particles is increased. Conventionally, a toner has the γ-characteristics as shown by the curve A in FIG. 3 in which the horizontal axis represents the electric potential and the vertical axis represents the image density. In a conventional toner, when the content of a coloring agent is increased, it becomes possible to produce a given density on a transfer material with a smaller amount of laid-on toner and gradation characteristics are required to be produced with electric potential in a narrow range of developing contrast (see Japanese Patent Application Laid-Open No. 2005-195674). In this case, the γ-characteristics are as represented by the curve B of FIG. 3, where the slope of the γ-characteristics becomes steep, and high gradation characteristics are difficult to obtain in some cases. In addition, since the slope of the γ-characteristics is steep, a change in image density due to a change in electric potential increases as compared with a conventional toner, which may also decrease the gradation characteristics.

In the POD market, it is important that wide gradation characteristics can be obtained and color is stable, and so, it is preferable that development is conducted so that the γ-characteristics may have a gentle slope even with a small amount of laid-on toner. As a method for forming gradation with electric potential in the same developing contrast as before by using a toner having an increased content of the coloring agent, there is a method in which the frictional charge amount of the toner is increased. Japanese Patent Application Laid-Open No. 2005-195674 does not mention the frictional charge amount of the toner.

The developing characteristics and transfer characteristics may deteriorate and the image density may decrease when the frictional charge amount of the toner is increased since the electrostatic adhesive power to the surface of a carrier and the photosensitive member increases. In addition, as described above, it becomes a possible cause of the image defects such as blank areas. Japanese Patent Application Laid-Open No. 2006-195079 describes the relationship between the frictional charge amount of toner and the adhesive power between the toner and a carrier.

In Japanese Patent Application Laid-Open No. 2006-195079, the formation of high quality images free from image defects is enabled by setting each of the frictional charge amount of toner and adhesive power in a certain range. However, it is not stated that the content of a coloring agent in toner particles, which can reduce the consumption of the toner, is increased, and the frictional charge amount of the toner is adjusted in order to reduce the consumption of the toner, and the adhesive power between the carrier and toner is still so strong that sufficient image density may not be obtained.

On this account, in order to perform image formation with a smaller amount of laid-on toner than before, a carrier is needed which can efficiently carrying out development with a toner which has a high frictional charge amount, a large content of a coloring agent and strong coloring power and which is high in the dispersibility of the coloring agent.

SUMMARY OF THE INVENTION

An object of the present invention is to provide a magnetic carrier in which the afore-mentioned problems have been solved, a two-component developer and an image forming method.

Another object of the present invention is to provide a magnetic carrier which has excellent developing characteristics, and can perform high quality image formation, a two-component developer and an image forming method.

Still another object of the present invention is to provide a magnetic carrier which has such excellent developing characteristics that development can efficiently perform in a low development electric field without generating ring marks, sufficient image density can be provided even at low electric field intensity, and high image quality images can stably be provided over a long period of time without causing image defects such as fogging and blank areas, a two-component developer and an image forming method.

A further object of the present invention is to provide an image forming method which enables toner consumption to be reduced, causes no scattering, and are excellent in fine line reproducibility, gradation characteristics, color gamut reproducibility, and color stability.

The present inventors have conducted intensive studies and consequently have found that a magnetic carrier which shows an electric field intensity of not less than 1,300 V/cm and not more than 5,000 V/cm just before break-down is excellent in the developing characteristics, and the use thereof enables high quality images to be formed.

That is, the present invention relates to a magnetic carrier having magnetic carrier particles including at least porous magnetic core particles and a resin, wherein the electric field intensity just before break-down of the magnetic carrier is 1,300 V/cm or more and 5,000 V/cm or less.

Further, the present invention relates to a two-component developer containing at least a magnetic carrier and a toner, wherein the magnetic carrier includes magnetic carrier particles including at least porous magnetic core particles and a resin and the electric field intensity just before break-down of the magnetic carrier is 1,300 V/cm or more and 5,000 V/cm or less.

Furthermore, the present invention relates to an image forming method which includes charging an electrostatic latent image bearing member with a charging unit; exposing the charged electrostatic latent image bearing member to light to form an electrostatic latent image; forming a magnetic brush of a two-component developer on a developer carrying member, developing the electrostatic latent image with a toner while applying a developing bias between the electrostatic latent image bearing member and the developer carrying member in a state that the magnetic brush is in contact, to thereby form an electric field between the electrostatic latent image bearing member and the developer carrying member, and thereby forming a toner image on the electrostatic latent image bearing member; transferring the toner image from the electrostatic latent image bearing member onto a transfer material via or not via an intermediate transfer member; and fixing the toner image on the transfer material with heat and/or pressure, wherein the two-component developer contains at least a magnetic carrier and a toner, and the magnetic carrier includes magnetic carrier particles including at least porous magnetic core particles and a resin and the electric field intensity just before break-down of the magnetic carrier is 1,300 V/cm or more and 5,000 V/cm or less, and the developing bias is generated by superimposing an alternating electric field on a direct electric field.

The magnetic carrier of the present invention uses a toner having a large frictional charge amount and has such excellent developing characteristics that sufficient image density can be obtained even when the laid-on toner amount is smaller than conventional cases. The magnetic carrier of the present invention is also good in gradation characteristics and fine line reproducibility and enables high quality images without scattering to be attained. In addition, images excellent in image quality can be obtained without generating image defects such as fog and blank areas. Furthermore, images stable for a long term can be obtained.

BRIEF DESCRIPTION OF THE DRAWINGS

FIG. 1A is a drawing illustrating a blank state in which a sample has not been placed, and FIG. 1B is a drawing illustrating a state in which a sample has been placed.

FIG. 15A is a graph showing all measurement area; FIG. 15B is a graph obtained by cutting out and enlarging the range of 0.1 μm or more and 10.0 μm or less.

DESCRIPTION OF THE EMBODIMENTS

The present invention will be described below in detail.

The magnetic carrier is described.

Figure 10:
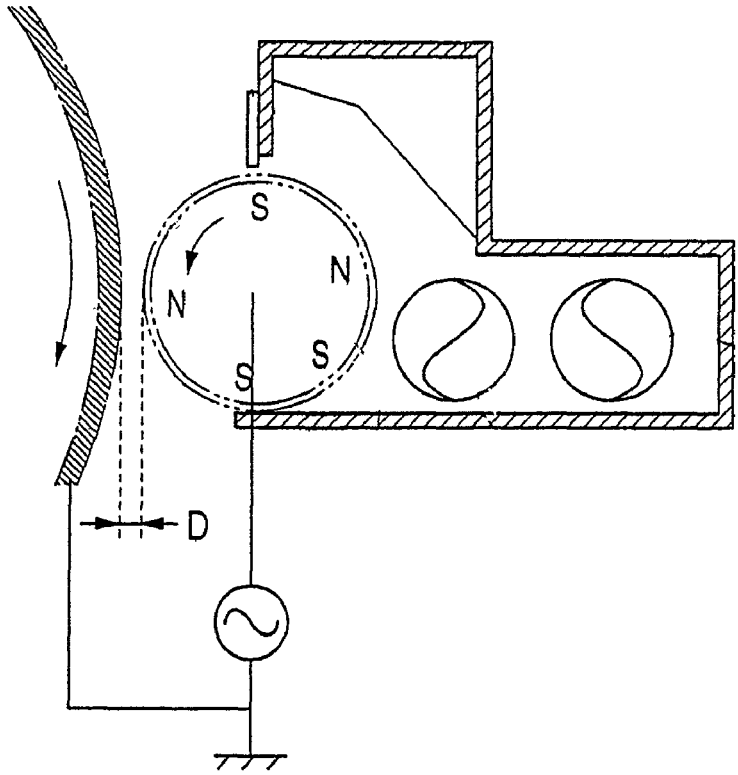
FIG. 10 is a schematic view illustrating an example of the developing area.

It has been found in the present invention that high developing characteristics can be obtained when the electric field intensity just before the break-down falls within the range of 1,300 V/cm or more and 5,000 V/cm or less in the resistivity measurement method of the magnetic carrier described later. As for the condition for the actual developing area, the gap between the electrostatic latent image bearing member and the developer carrying member (referred to as S-D gap) is from 250 μm to 500 μm as schematically shown in FIG. 10. A two-component developer having a toner and a magnetic carrier is borne on the developer carrying member in an amount of 25 mg/cm$^2$ to 50 mg/cm$^2$. The magnetic brush (not shown in the drawings) of the two-component developer is in contact with the electrostatic latent image bearing member at that time. The contact nip width is from 1 mm to 7 mm, and the contact nip width changes according to the adjustment of the S-D gap and the magnetic force of the magnetic carrier.

An electrostatic latent image is formed on the electrostatic latent image bearing member by electric charge and exposure to light, and a voltage generated by superimposing an alternating electric field on a DC voltage is applied to the developer carrying member. The purpose of applying an alternating electric field is to perform rearrangement of the toner on the electrostatic latent image bearing member to improve dot reproducibility. The charged electric potential ($V_D$) of the electrostatic latent image bearing member depends on the kind of photosensitive member to be used and the film thickness of the photosensitive layer, and in the case where the photosensitive member is an organic photosensitive member and the film thickness of the photosensitive layer is 30 μm, it is 500 V to 700 V in terms of absolute value. The DC voltage ($V_{DC}$) applied to the developer carrying member is determined appropriately by the contrast electric potential and the electric potential ($V_L$) and the charged electric potential ($V_D$) of the part exposed to light. It is preferable that the contrast electric potential is 200 V or more and 450 V or less for obtaining good gradation characteristics. In addition, it is important that the contrast electric potential falls within this range regardless of the change of the amount of toner electric charge, which may vary depending on the environmental change and durability and the change of release characteristics of the toner and the magnetic carrier in order that particularly stable image output is performed in the field of POD.

It is preferable that the alternating electric field has a peak-to-peak voltage (Vpp) of 0.5 kV or more and 2.0 kV or less and a frequency of 1.0 kHz or more and 3.0 kHz or less for higher image quality. As for Vpp, it is preferable that the value is lowered as much as possible, but the developing characteristics deteriorate as the value is lowered. When Vpp is set higher, sufficient developing characteristics can be obtained, but on the other hand, a discharge phenomenon may occur due to too high electric field intensity, and in this case, patterns in the form of a ring or a spot (referred to as a ring mark) may be generated on a transfer material. The ring mark can be prevented by reducing Vpp to evade a discharge phenomenon. Therefore, it is preferable that development is performed at Vpp lower than that causing a ring mark. The peak-to-peak voltage of the alternating electric field (Vpp) is preferably equal to or less than 1.5 kV, and is more preferably 1.3 kV. In the situation in which such developing characteristics are disadvantageous, high quality images as well as high developing characteristics can be obtained at the same time, utilizing such a characteristic that break-down is brought about when high voltage is applied to the magnetic carrier and aiming at optimizing this characteristic and Vpp which is a developing condition.

Break-down will be described. In the resistivity measurement using an apparatus schematically illustrated in FIG. 1A and FIG. 1B, an electrometer (for example, Keithley 6517A manufactured by Keithley Instruments Inc.) is used under the condition that the electrode area is 2.4 $cm^2$ and the thickness of the magnetic carrier is about 1.0 mm. The maximum applied voltage is set to 1,000 V and screening in which voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V (approximately $2^{10}$ V) are each applied for one second is performed using the automatic range function of the electrometer. In this case, the electrometer determines whether a voltage can be applied up to 1,000 V, and when overcurrent flows, "VOLTAGE SOURCE OPERATE" flashes on and off. When "VOLTAGE SOURCE OPERATE" flashes on and off, the applied voltage is lowered and the voltages that can be applied are screened, and the maximum value of the applicable voltage is automatically determined. After the maximum value of the applicable voltage is determined, the voltage just before the break-down and the electric field intensity just before the break-down are measured. The determined maximum value of the applicable voltage is divided into 5 and the respective voltages are applied for 30 seconds and the resistance values are measured from the measured current values.

Taking as an example a magnetic carrier used in Example 1 described later, explanation will be made. The measurement results of the porous magnetic core and the magnetic carrier are shown in Table 1A.

In the case of the magnetic carrier used in Example 1, DC voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V were applied to the magnetic carrier respectively for one second at the time of the screening, and the indication of "VOLTAGE SOURCE OPERATE" lighted up to 512 V, and the indication of "VOLTAGE SOURCE OPERATE" flashed on and off at 1,000 V. Then, the indication was turned on at the DC voltage 724 V (approximately $2^{9.5}$ V) and the indication flashed on and off at the DC voltage 891 V (approximately $2^{9.80}$ V), and the indication flashed on and off at the DC voltage 831 V ($2^{9.7}$ V) and the indication was turned on at the DC voltage 776 V ($2^{9.6}$ V). Furthermore, the indication was turned on at the DC voltage 792 V ($2^{9.63}$ V) and the indication flashed on and off at the DC voltage 803 V (approximately $2^{9.65}$ V), and the maximum applicable voltage was converged, and as a result, the maximum value of the applicable voltage was 797 V (approximately $2^{9.64}$ V). DC voltages of 159 V (the first step) which is ⅕ of 797 V, 319 V (the second step) which is ⅖ of 797 V, 478 V (the third step) which is ⅗ of 797 V, 638 V (the fourth step) which is ⅘ of 797 V, 797 V (the fifth step) which is ⅝ of 797 V, 797 V (the sixth step) which is ⅝, 638 V (the seventh step) which is ⅘ of 797 V, 478 V (the eighth step) which is ⅗ of 797 V, 319 V (the ninth step) which is ⅖ of 797 V, 159 V (the tenth step) which is ⅕ of 797 V are applied in this order. The electric field intensity and the resistivity are calculated from the sample thickness of 1.02 mm and the electrode area by processing the current values obtained therefrom by computer and plotted in a graph. In that case, five points lowering the voltage from the maximum applied voltage (from the sixth step to the tenth step in Table 1) are plotted.

Figure 2:
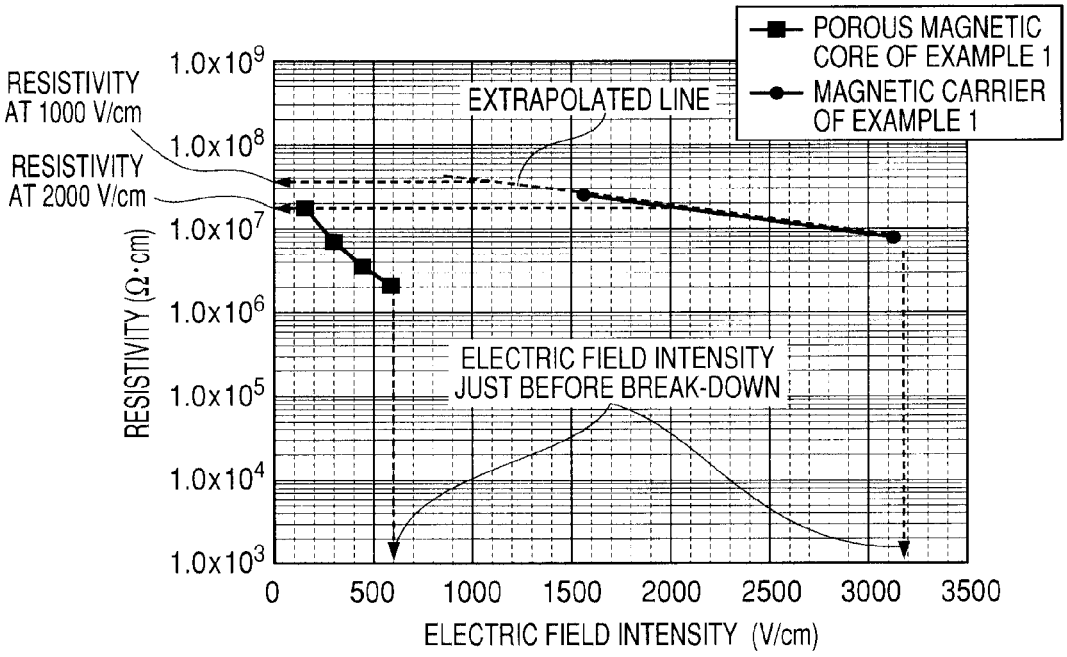
FIG. 2 is an example of a graph showing the measurement results of the resistivity measured by the apparatus illustrated in FIGS. 1A and 1B. The measurement results of the magnetic carrier 1 of Example 1 and the porous magnetic core 1 used therefor are shown.

Table 1A shows the applied voltage (V), the electric field intensity (V/cm) obtained by dividing the applied voltage by the thickness d of the sample, and the resistivity (Ω·cm) at that time. FIG. 2 is a graph in which the resistivity is plotted against the electric field intensity after the sixth step in Table 1A. In the graph of FIG. 2, the point of the electric field intensity 3,130 V/cm at the time of applying a DC voltage 319 V to the magnetic carrier for 30 seconds is defined as the electric field intensity just before the break-down. At the time of the screening, DC voltage 797 V, DC voltage 638 V, and DC voltage 478 V were able to be each applied for one second, but overcurrent flowed when a DC voltage of 478 V or higher was applied for 30 seconds, and the measured resistance became zero. This phenomenon is defined as "break-down". In addition, the electric field intensity just before the break-down is defined as the electric field intensity of the DC voltage when "VOLTAGE SOURCE OPERATE" is turned on and off or the maximum electric field intensity for which the value of the resistivity can be plotted.

The present inventors have found that there is a correlation between the application of the DC voltage which is the electric field intensity just before the break-down to the magnetic carrier of 1 mm in thickness for 30 seconds and the bias applied in actual development. It has been found that the fact that the sum of the contrast voltage applied between the photoconductor drum (electrostatic latent image bearing member) and developing sleeves (developer carrying member) in the developing area in an actual image forming apparatus and ½ of Vpp, i.e., about 1,000 V (contrast voltage: 350 V, ½ of ½ Vpp: 650 V) is momentarily applied to the magnetic brush is correlated with the fact that the DC voltage which is the electric field intensity just before the break-down is applied to the magnetic carrier of 1 mm in thickness for 30 seconds correlate. When the nearest-neighbor distance (distance between S-D) between the photoconductor drum and the developing sleeve is 400 μm, the electric field intensity in the developing area is 25,000 V/cm, whereas a DC voltage of 1,000 V (maximum electric field intensity: 10,000 V/cm) will be applied to the magnetic carrier of 1 mm in thickness for 30 seconds when the resistivity of the magnetic carrier is measured.

A correlation can be seen between the applied voltage to the magnetic carrier and the resistance value in the thickness of 1 mm which is close to the gap in the actual developing area, and accordingly, it is supposed that the correlation with the magnetic carrier upon actual use is present. That is, the developing characteristics of the magnetic carrier correlate more with whether break-down is brought about in a certain range of electric field intensity than with the resistivity. When the electric field intensity just before the break-down is low, high developing characteristics are obtained in lower Vpp, but when the electric field intensity just before the break-down is less than 1,300 V/cm, leak occurs in the developing area, and as a result, white spots are caused in some cases. When the electric field intensity is more than 5,000 V/cm, Vpp not less than 1.5 kV becomes necessary in order to obtain high image density, and higher Vpp becomes necessary in the case of a toner having a high frictional charge amount. As a result, image defects such as ring marks are liable to occur. Thus, it is more preferable that the electric field intensity just before the break-down lowers for enhancing the developing characteristics of the magnetic carrier, but when the intensity becomes too low, a leak may be caused, and when the intensity becomes too high, the developing characteristics deteriorate, and higher Vpp is necessary, which may cause negative effects such as ring marks. The above matters can be balances when the electric field intensity just before the break-down is 1,300 V/cm or more and 5,000 V/cm or less. The reason why the high developing characteristics are obtained when the electric field intensity just before the break-down of the magnetic carrier is in the range of 1,300 V/cm or more and 5,000 V/cm or less is that the resistance of the magnetic brush is reduced when the developing electric field of the electric field intensity which will cause break-down is applied, and the counter charge in the magnetic carrier after the flight of the toner from the surface of the magnetic carrier particle abruptly attenuates in addition to the electrode effect due to the low resistance of the magnetic brush. When the counter charge remains on the surface of the magnetic carrier particles after the toner is separated from the surface of the magnetic carrier particles, the developing characteristics of a two-component developer deteriorate since the power of the electric field acting on the toner becomes weak, and the toner which is about to fly next cannot fly.

Typically, when a magnetic carrier which may cause the break-down is used, leak may be brought about, and white spots may be caused or holes may be made on the photosensitive member, which may cause black spots. In the image forming method which uses the magnetic carrier of the present invention, high developing characteristics can be satisfied without causing the leak by adjusting the point of the electric field intensity just before the break-down of the magnetic carrier and the value of Vpp which is a developing condition.

It is more preferable in the present invention that the break-down does not occur at an electric field intensity less than 1,300 V/cm and the break-down occurs at an electric field intensity more than 5,000 V/cm, because, as described above, high image quality is maintained without causing problems such as black spots and white spots which result from the leak, and at the same time, excellent developing characteristics can be attained and image defects such as blank areas can be prevented without applying high Vpp which may cause ring marks.

The resistivity of the magnetic carrier in an electric field intensity of 1,000 V/cm is preferably $1.0\times10^{6}$ Ω·cm or more and $1.0\times10^{11}$ Ω·cm or less. The value of the electric field intensity of 1,000 V/cm in the resistivity measurement is the electric field intensity which correlates with the voltage of pulling back the toner when an alternating electric field is applied, and the value of the resistivity at that time correlates with the charge injection into the electrostatic latent image bearing member. Therefore, the above-mentioned resistivity range is preferable so as to prevent fogging due to charge injection, and also to maintain the developing characteristics of the two-component developer. More preferably, the magnetic carrier has a resistivity of $1.0\times10^{7}$ Ω·cm or more and $1.0\times10^{10}$ Ω·cm or less at the electric field intensity of 1,000 V/cm. The value of the resistivity at the electric field intensity of 1,000 V/cm of the magnetic carrier used in Example 1 of the present invention can be determined by reading the resistivity at the electric field intensity of 1,000 V/cm from the graph of FIG. 2. Because there is no intersection point in the case of the magnetic carrier used in Example 1 of the present invention, a straight line linking the value at 1,560 V/cm and the value at 3,130 V/cm is extrapolated (shown by a broken line in the drawing) and the intersection point with the vertical line at the electric field intensity of 1,000 V/cm is defined as the resistivity value at the electric field intensity of 1,000 V/cm. Therefore, in the case of the magnetic carrier used in Example 1 of the present invention, the resistivity value at the electric field intensity of 1,000 V/cm is $4.0\times10^{7}$ Ω·cm.

In addition, it is more preferable that the magnetic carrier has a resistivity of $1.0\times10^{6}$ Ω·cm or more and $5.0\times10^{10}$ Ω·cm or less at the electric field intensity of 2,000 V/cm so as to maintain the high developing characteristics. This is preferable since the image density is sufficient and negative effects such as blank areas and fogging caused by charge injection can be prevented when the resistivity is $1.0\times10^{6}$ Ω·cm or more and $5.0\times10^{10}$ Ω·cm or less.

In order to make the electric field intensity just before the break-down of the magnetic carrier of the present invention to fall within the range of 1,300 V/cm or more and 5,000 V/cm or less, it is important to control how to cause the resin to be present on the surface of the magnetic carrier particles and to control the state in which the core particles are partially exposed. The resistivity can be retained at a certain level or higher, and at the same time, an overcurrent can be allowed to abruptly pass through the magnetic carrier when the electric field intensity elevates by allowing the region where the layer thickness of the resin layer is thick and the region where the layer thickness is thin to be coexistent on the surface of the magnetic carrier particles.

Furthermore, the electric field intensity just before the break-down of the magnetic carrier can be controlled by controlling the core part which is low in resistance and the resin part which is high in resistance by controlling the linkage state (the inner structure of the core particles) of the pores in the porous magnetic core particles and by filling the pores with a resin.

In the present invention, the term "porous magnetic core" means an aggregate of a large number of porous magnetic core particles.

As for the porous magnetic core particles, porous magnetic ferrite core particles are preferably used as core particles. In the case of porous magnetic ferrite core particles, it is possible to allow a resin to be present in the core particles, thereby balancing the resin on the surfaces of the magnetic carrier particles and the partial exposure of the core particles, and besides, attaining control so that the resistance value may be kept high at a low electric field intensity while the break-down occurs at a high electric field intensity.

The electric field intensity at which the break-down occurs can be adjusted by finally controlling the surface condition of the magnetic carrier particles in the production process. That is, a magnetic carrier having a desired electric field intensity at which the break-down occurs can be formed by strengthening stirring of respective particles and grinding among particles in the apparatus used in the step of filling porous magnetic core particles with a resin and the step of further coating with a resin the magnetic carrier core particles filled with a resin. For example, when NAUTA MIXER (manufactured by Hosokawa Micron Corporation) is used as a coating apparatus, the resin coating can be ground to partially expose the surfaces of the core particles by increasing the speed of rotation which enhances grinding among particles with respect to the speed of revolution which slowly mixes the whole particles. The speed of revolution of a screw-shaped stirring blade depends on the size of the apparatus, but 3 revolutions or more and 10 revolutions or less per minute is preferable, and the speed of rotation is preferably 60 rotations or more and 300 rotations or less per minute. A similar effect can be obtained in other apparatuses if the stirring/grinding function can be enhanced more than the mixing function.

Furthermore, as a method of controlling the surface condition of the magnetic carrier particles after coating, there is a method of applying some stress to carrier particles at the time of heat treatment. Specifically, the resin-coated magnetic carrier particles can be heat-treated while turning a rotating vessel having a stirring blade in its inside such as a drum mixer (manufactured by Sugiyama heavy industrial CO., LTD.), whereby the surface of the core particles can be partially exposed by grinding among magnetic carrier particles. It is preferable that using a drum mixer, treatment is carried out at a temperature of 100° C. or more for 0.5 hour or more.

The resin parts on the surfaces of the magnetic carrier particles and the partial exposure of the magnetic core particles can be controlled by adjusting the coating resin amount and a coating method. In addition, the porous magnetic core particles described later are porous magnetic ferrite particles which are preferable in that the exposure of the magnetic core particles can be easily controlled and that the electric field intensity of the magnetic carriers at which the break-down occurs can be easily controlled.

It is preferable that the magnetic carrier of the present invention has a 50% particle size (D50) based on volume distribution of 20.0 μm or more and 70.0 μm or less, because carrier adhesion is suppressed and spent toner is suppressed and they can be used stably in a long term use.

It is preferable that the magnetic carrier of the present invention has an intensity of magnetization at $1000/4\pi$ (KA/m) of 40 $Am^2/kg$ or more and 65 $Am^2/kg$ or less, because dot reproducibility which determines the half tone image quality is improved, carrier adhesion is suppressed and spent toner is suppressed and stable images are provided.

It is preferable that the magnetic carrier of the present invention has a true specific gravity of 3.2 $g/cm^3$ or more and 5.0 $g/cm^3$ or less, because spent toner is suppressed and stable images can be maintained for a long term. More preferably, the magnetic carrier has a true specific gravity of 3.4 $g/cm^3$ or more and 4.2 $g/cm^3$ or less, because carrier adhesion is further suppressed and the durability is further improved.

In the magnetic carrier particles in the present invention, it is preferable that particles composed of porous magnetic core particles filled with a resin are further coated with a resin. In that case, the electric field intensity just before the break-down of the magnetic carriers is easily optimized by further preferably controlling the degree of the exposure of the porous magnetic core particles. The resin for coating the surfaces of the carrier particles may be the same as or different from the resin with which the porous magnetic core particles are filled (or the resin for filling), and may be a thermosetting resin or a thermoplastic resin.

A silicone resin or a modified silicone resin is preferable as the resin for filling since such a resin has high affinity for the porous magnetic ferrite core particles.

The following commercial products can be exemplified. As silicone resins, KR271, KR255, KR152 manufactured by Shin-Etsu Chemical Co., Ltd. and SR2400, SR2405, SR2410, SR2411 manufactured by Dow Corning Toray Co., Ltd. may be cited. As modified silicone resin, KR206 (alkyd modified), KR5208 (acrylic modified), ES1001N (epoxy modified), KR305 (urethane modified) manufactured by Shin-Etsu Chemical Co., Ltd., SR2115 (epoxy modified), SR2110 (alkyd modified) manufactured by Dow Corning Toray Co., Ltd. may be cited.

The porous magnetic core particles may be used as a magnetic carrier after only the pores thereof are filled with a resin. In that case, it is preferable that in order to enhance the ability of imparting frictional charge to the toner, the pores are filled with a resin solution in which a charge control agent, an electric charge control resin or a coupling agent has been beforehand included.

In the case of a thermoplastic resin, the resin filled into the porous magnetic core particles is preferably cured for 0.5 or more hour and two or less hours at a temperature of not lower than the glass transition point (Tg) and not higher than Tg+20° C. In the case of a thermosetting resin, the resin is preferably used after being cured for 0.5 or more hour and two or less hours at a temperature of not lower than 120° C. and not higher than 250° C. When a coating is further applied after curing, it becomes difficult for the resin filled into the pores to dissolve into the coat resin solution, and thereby a preferable coating can be applied.

In addition, as the resins for forming the coating layer, silicone resins or modified silicone resins have high affinity for the particles composed of porous magnetic ferrite particles whose pores are filled with a resin and have high release characteristics, and therefore, can be used for the purpose of inhibiting spent toner from occurring.

Silicone resins are particularly preferable among the aforementioned resins. As silicone resins, conventionally known silicone resins may be used.

The following commercial products can be exemplified. As silicone resins, KR271, KR255, KR152 manufactured by Shin-Etsu Chemical Co., Ltd., SR2400, SR2405, SR2410, SR2411 manufactured by Dow Corning Toray Co., Ltd. may be cited. As modified silicone resin, KR206 (alkyd modified), KR5208 (acrylic modified), ES1001N (epoxy modified), KR305 (urethane modified) manufactured by Shin-Etsu Chemical Co., Ltd., SR2115 (epoxy modified), SR2110 (alkyd modified) manufactured by Dow Corning Toray Co., Ltd. may be cited.

The coating resins may be used each singly, but two or more of them may be mixed with each other and used. A curing agent may be mixed with a thermoplastic resin and used after curing. In particular, it is more suitable to use a resin having higher release characteristics.

Furthermore, the coating resin may contain particles having electric conductivity, particles having electric charge controllability, charge control agents, electric charge control resins, and coupling agents to control the frictional charge properties.

Carbon black, magnetite, graphite, zinc oxide or tin oxide is exemplified as particles having conductivity. However, when a lot of conductive particles are used, they may be deviated from the most suitable range of the electric field intensity just before the break-down of the magnetic carriers, and in the case where the break-down occurs on the low electric field side, leak cannot be avoided, and there is a case where white spots occur or pinholes are made on the photosensitive member.

It is preferable that the addition amount is 0.1 part by mass or more and 10.0 parts by mass or less based on 100 parts by mass of the coating resin for adjusting the resistance of the magnetic carrier.

The following can be exemplified as particles having electric charge controllability: particles of an organometallic complex, particles of an organometallic salt, particles of a chelate, particles of a monoazo metal complex, particles of an acetylacetone metal complex, particles of a hydroxycarboxylic acid metal complex, particles of a polycarboxylic acid metal complex, particles of a polyol metal complex, particles of a polymethyl methacrylate resin, particles of a polystyrene resin, particles of a melamine resin, particles of a phenolic resin, particles of a nylon resin, particles of silica, particles of titanium oxide, and particles of alumina.

It is preferable that the addition amount of the particles having electric charge controllability is 0.5 part by mass or more and 50.0 parts by mass or less based on 100 parts by mass of the coating resin for adjusting the frictional charge amount.

Metal salts of naphthenic acid or higher fatty acids, alkoxylated amines, quaternary ammonium salt compounds, azo metal complexes, salicylic acid metal salts or metal complexes thereof can be exemplified as the charge control agent.

It is preferable that the charge control agent mentioned above is a nitrogen containing compound in order to enhance the negative charge imparting properties as in the electric charge control resin. It is preferable that in order to enhance the positive charge imparting properties, the charge control agent is a sulfur-containing compound.

It is preferable that the addition amount of the charge control agent is 0.5 part by mass or more and 50.0 parts by mass or less based on 100 parts by mass of the coating material for improving dispersibility and adjusting the frictional charge amount.

It is preferable that the addition amount of the electric charge control resin is 0.5 part by mass or more and 30.0 parts by mass or less based on 100 parts by mass of the coating material for attaining both the release effect of the coating material and the charge imparting properties.

Nitrogen-containing coupling agents are preferable for enhancing the negative charge imparting properties as the coupling agent mentioned above.

It is preferable that the addition amount of the coupling agent is 0.5 part by mass or more and 50.0 parts by mass or less based on 100 parts by mass of the coating resin for adjusting the frictional charge amount.

As a method for coating with a resin the surfaces of the porous magnetic core particles whose pores have been filled with a resin, coating methods such as a dipping method, a spraying method, a brush coating method, a dry method and a fluid bed method can be exemplified. Among these, the dipping method and the dry method are preferable by which the surfaces of the porous magnetic core particles whose pores have been filled with a resin can be appropriately exposed.

The amount of the coating resin is preferably 0.1 part by mass or more and 5.0 parts by mass or less based on 100 parts by mass of the porous magnetic core particles whose pores have been filled with a resin, because the surfaces of the porous magnetic core particles can be appropriately exposed.

The porous magnetic core will be described below.

It is important that the porous magnetic core particles have pores continuing from the surface to the inside of each of the magnetic core particles. The magnetic carrier can be provided with high developing characteristics by filling the pores with a resin.

In addition, it is preferable that the electric field intensity just before the break-down of the porous magnetic core is 400 V/cm or more and 1,000 V/cm or less in the resistivity measurement, because the electric field intensity just before the break-down of the magnetic carrier is easy to control when the surfaces of the magnetic core particles are partially exposed on the surfaces of the porous magnetic core particles. More preferably, the electric field intensity just before the break-down of the porous magnetic core particles is 500 V/cm or more and 700 V/cm or less. The electric field intensity just before the break-down of the porous magnetic core particles can be adjusted to a desired value when the electric field intensity just before the break-down of the magnetic carrier is 1000 V/cm or less. High developing characteristics come to be obtained and image defects such as blank areas can be alleviated by causing the break-down in a lower development electric field. The electric field intensity just before the break-down of the porous magnetic core particles of 400 V/cm or more is preferable in that the leak can be inhibited even in development at a lower electric field intensity.

It is preferable that the resistivity of the porous magnetic core used in the present invention is $1.0\times10^6$ Ω·cm or more and $5.0\times10^7$ Ω·cm or less in the electric field intensity of 300 V/cm. More preferably, the resistivity in the electric field intensity of 300 V/cm is $3.0\times10^6$ Ω·cm or more and $3.0\times10^7$ Ω·cm or less. When the resistivity of the porous magnetic core is $1.0\times10^6$ Ω·cm or more and $5.0\times10^7$ Ω·cm or less, a developing leak is inhibited and the developing characteristics are improved for the magnetic carrier. Furthermore, in addition to the improvement of the developing characteristics, image defects such as blank areas can be alleviated.

Figure 15A:
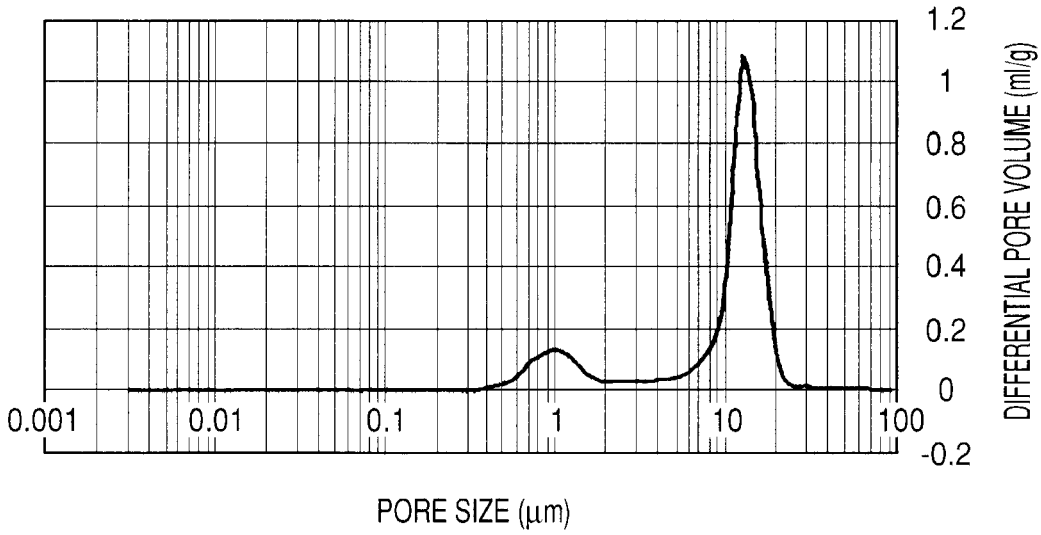
FIGS. 15A and 15B are an example of a graph showing the results of the pore size distribution of the porous magnetic core measured by a mercury intrusion method. The measurement results of the porous magnetic core used in Example 12 are shown.
Figure 15B:
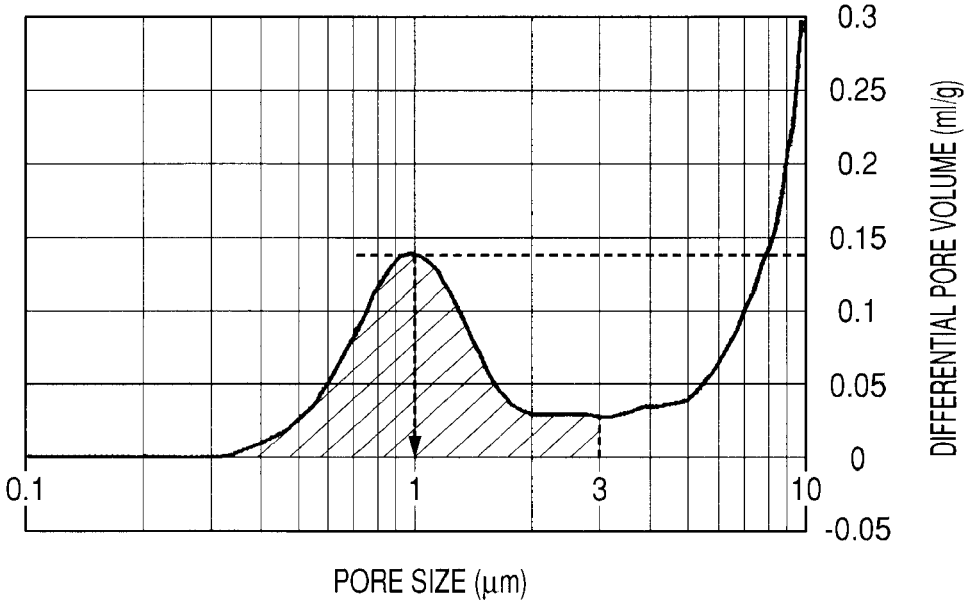

The results of the pore size distribution measured by a mercury intrusion method applied to the porous magnetic core are shown in FIG. 15A and FIG. 15B. FIG. 15A shows the whole measurement area, and pore sizes ranging from 96 μm to 0.003 μm are measured. The measurement conditions are described later. There is a peak at a position where the pore size exceeds 10 μm, but this is attributable to the space among the porous magnetic core particles. A graph of the range from 0.1 μm to 10 μm cut out of FIG. 15A is shown in FIG. 15B. In the present invention, as the region in which pores inside the porous magnetic core particles are shown, the pore size range of 0.1 μm or more and 3.0 μm or less is defined. Therefore, it is preferable that the pore size at which the differential pore volume becomes maximal is 0.8 μm or more and 1.5 μm or less in the pore size range of 0.1 μm or more and 3.0 μm or less as measured by the mercury intrusion method. When the pore size is 0.8 μm or more and 1.5 μm or less, the insides of the pores become easy to fill sufficiently with a resin, and at the same time, the developing characteristics of the magnetic carrier are improved, because the connection between the low resistance parts of the porous magnetic core particles and the barrier of the resin high in electric resistance are present. The total volume of the pores is preferably 0.040 ml/g or more and 0.120 ml/g or less in the range in which the pore size is 0.1 μm or more and 3.0 μm or less for balancing the developing characteristics and the inhibition of fogging. Furthermore, this is preferable because the strength of the magnetic carrier is improved and the spent toner is reduced.

As mentioned above, ferrite is preferable for the material of the porous magnetic core particles. Ferrite is a sintered material represented by the following formula.

$(M1_2O)_x(M2O)_y(Fe_2O_3)_z$ (wherein M1 is a monovalent metal, M2 is a divalent metal, and when $x+y+z=1.0$, x and y each satisfy $0\leqq(x,y)\leqq0.8$, and z satisfies $0.2<z<1.0$.)

In the formula, it is preferable that one or two or more types of metal atoms selected from the group consisting of Li, Fe, Mn, Mg, Sr, Cu, Zn, Ni, Co and Ca are used as M1 and M2.

Magnetic Li-type ferrite (for example, $(Li_2O)_a(Fe_2O_3)_b$ ($0.0<a<0.4$, $0.6\leqq b<1.0$, $a+b=1$), $(Li_2O)_a(SrO)_b(Fe_2O_3)_c$ ($0.0<a<0.4$, $0.0<b<0.2$, $0.4\leqq c<1.0$, $a+b+c=1$)); Mn-type ferrite (for example, $(MnO)_a(Fe_2O_3)_b$, ($0.0<a<0.5$, $0.5\leqq b1.0$, $a+b=1$)); Mn—Mg-type ferrite (for example, $(MnO)_a(MgO)_b(Fe_2O_3)_c$ ($0.0<a<0.5$, $0.0<b<0.5$, $0.5\leqq c<1.0$, $a+b+c=1$)); Mn—Mg—Sr-type ferrite (for example, $(MnO)_a(MgO)_b(SrO)_c(Fe_2O_3)_d$ ($0.0<a<0.5$, $0.0<b<0.5$, $0.0<c<0.5$, $0.5\leqq d<1.0$, $a+b+c+d=1$)); Cu—Zn-type ferrite (for example, $(CuO)_a(ZnO)_b(Fe_2O_3)_c$ ($0.0<a<0.5$, $0.0<b<0.5$, $0.5\leqq c<1.0$, $a+b+c=1$).) The above ferrites may contain slight amounts of other metals.

The Mn-type ferrite, Mn—Mg-type ferrite, and Mn—Mg—Sr-type ferrite which contain a Mn element are more preferable, because the growth rate of the crystal can be easily controlled and the resistivity of the porous magnetic core can be suitably controlled and the electric field intensity just before the break-down can be easily controlled.

A method of controlling the resistance and the electric field intensity just before the break-down of the porous magnetic core includes controlling the composition of the ferrite, the particle size and the particle size distribution of the starting materials, the calcination temperature, the particle size and particle size distribution after calcination, the burning temperature, atmosphere at the time of the burning, the porous structure and the control of the grain boundary.

It is preferable from the viewpoint of carrier adhesion inhibition and resistance to spent toner that the 50% particle size (D50) based on volume distribution of the porous magnetic core is 18.0 μm or more and 68.0 μm or less. When the porous magnetic core particles having such a particle size is filled with a resin and coated with a resin, the magnetic carrier whose 50% particle size (D50) based on volume distribution is 20.0 μm or more and 70.0 μm or less is easily obtained.

The intensity of magnetization at 1,000/4π (kA/m) of the porous magnetic core is preferably 50 $Am^2/kg$ or more and 75 $Am^2/kg$ or less for finally exhibiting performance as the magnetic carrier. Such a magnetic carrier can improve the dot reproducibility which determines the image quality of the half tone parts, and inhibit carrier adhesion and spent toner to provide stable images.

It is preferable that the true specific gravity of the porous magnetic core is 4.2 $g/cm^3$ or more and 5.9 $g/cm^3$ or less so as to finally come to be suitable for a magnetic carrier.

In the following, a process for producing the porous magnetic core is described.

Step 1 (Weighing/Mixing Step):

The raw materials of ferrite are weighed and mixed.

The following is exemplified as ferrite raw materials in order to control the resistivity and the electric field intensity just before the break-down of the magnetic cores to desired values.

Metal particles, oxides of metallic elements, hydroxides of metallic elements, oxalates of metallic elements, carbonates of metallic elements selected from Li, Fe, Mn, Mg, Sr, Cu, Zn, Ni, Co and Ca.

Ball mills, planetary mills, and Giotto mills are exemplified as a mixing apparatus. In particular, wet process ball mills using a slurry in which the solid content in water is 60 mass % to 80 mass % are preferable for mixing properties and forming a porous structure.

Step 2 (Calcination Step):

The mixed ferrite raw materials are granulated and dried with a spray dryer, and calcined at a temperature of 700° C. or more and 1,000° C. or less in the atmosphere for 0.5 hour or more and 5.0 hours or less to convert the raw materials into ferrite. When the temperature exceeds 1,000° C., sintering proceeds and there may be cases where particles are difficult to crush into a size enough to be made porous.

Step 3 (Crushing Step):

The calcined ferrite prepared in Step 2 is pulverized with a powdering machine.

As a powdering machine, crushers and hammer mills, ball mills, beads mills, planetary mills and Giotto mill are exemplified.

The 50% particle size (D50) based on volume of the pulverized powder of the calcined ferrite is preferably 0.5 μm or more and 3.0 μm or less. Thereby, the carrier particles having an almost sphere shape can be obtained and the pore size of the porous magnetic core particles can be easily controlled.

In addition, the 90% particle size (D90) based on volume of the pulverized powder of the calcined ferrite is preferably 2.0 μm or more and 5.0 μm or less. Thereby, a desired porous structure can be formed, the pore size can be easily controlled, and a good resistance value as a magnetic carrier is obtained and the electric field intensity just before the break-down can be easily controlled to a desired value.

In the ball mill or the beads mill, it is preferable to control the material of a ball or beads to be used, and an operating time period so that the pulverized powder of the calcined ferrite has the particle size mentioned above. Specifically, in order to reduce the particle size of the calcined ferrite, it is suitable to use a heavy ball high in specific gravity and to lengthen the crushing time. The materials of a ball and beads are not particularly limited as long as desired particle size can be obtained. In order to widen the particle size distribution, pulverized powders different in pulverized particle size may be mixed and used.

The following may be exemplified as the materials of a ball and beads. Glass such as soda-lime glass (specific gravity 2.5 $g/cm^3$), sodaless glass (specific gravity 2.6 $g/cm^3$), high density glass (specific gravity 2.7 $g/cm^3$) and quartz (specific gravity 2.2 $g/cm^3$), titania (specific gravity 3.9 $g/cm^3$), silicon nitride (specific gravity 3.2 $g/cm^3$), alumina (specific gravity 3.6 $g/cm^3$), zirconia (specific gravity 6.0 $g/cm^3$), steel (specific gravity 7.9 $g/cm^3$) and stainless steel (specific gravity 8.0 $g/cm^3$). Among these, alumina, zirconia, stainless steel are excellent in abrasion-resistant properties and are preferable.

The particle sizes of a ball and beads are not particularly limited as long as desired pulverized particle size can be obtained. For example, balls having a diameter of 5 mm or more and 20 mm or less are preferably used. As for beads, those having a diameter of 0.1 mm or more and less than 5 mm are preferably used.

The ball mills and beads mills are high in pulverizing efficiency and facilitate the control of the particle size distribution of the pulverized product of the calcined ferrite, and therefore, wet processing such as a slurry using water is more preferable than dry processing.

Step 4 (Granulation Step):

To the pulverized product of the calcined ferrite, water, a binder, a foaming agent, organic fine particles and $Na_2CO_3$ as needed as a pore regulating agent are added.

For example, polyvinyl alcohol is preferably used as a binder.

When pulverization is performed in wet process in Step 3, it is preferable that a binder and a pore regulating agent as needed are added in consideration of water contained in the ferrite slurry. It is preferable that granulation is performed while the solid content of the slurry is 50 mass % or more and 80 mass % or less in order to control the porosity.

The obtained ferrite slurry is granulated and dried using a spray dryer in an atmosphere warmed to 100° C. or more and 200° C. or less.

As a dryer, a spray dryer capable of attaining a desired porous magnetic core particle size can be preferably used. The core particle size of the porous magnetic core particles can be controlled by appropriately selecting the rotation number of a disk used for a spray dryer and a spray amount.

Step 5 (Burning Step):

Then, the granulated product is calcined at a temperature of 800° C. or more and 1200° C. or less for 1 hour or more and 24 hours or less. It is preferable to control the calcinating temperature and time in the range mentioned above.

When the calcinating temperature is elevated and the calcinating time is increased, calcination of the porous magnetic cores proceeds, and as a result, the diameter of the pores decreases and the volume of the pores decreases. In addition, the resistivity of the porous magnetic core and the electric field intensity just before the break-down can be controlled to a preferable range by controlling the calcinating atmosphere. The resistivity of the magnetic cores can be brought into the desired range by adjusting the oxygen concentration preferably to 0.1 volume % or less, more preferably to 0.01 volume % or less. Furthermore, lower resistance can be attained by performing calcination in a reduction atmosphere. The porous structure and the resistivity closely correlate with each other in relation to a conductive path, and therefore, it is very important to control the calcinating temperature and the calcinating environment, and as described above, it is important to control the temperature, the calcinating time and the atmosphere adjustment so that the fluctuations thereof become small.

Step 6 (Sorting Step):

After the particles calcined as above are disintegrated, they may be classified or sieved as needed to remove coarse particles and fine particles.

The pores of the porous magnetic core are filled with a resin as follows.

As a method for filling the pores of the porous magnetic core particles with a resin, there is a method of diluting the resin with a solvent to add the diluted resin into the pores of the porous magnetic core particles. The solvent used here is not limited as long as it can dissolve the resin. When the resin is soluble in an organic solvent, toluene, xylene, Cellosolve butyl acetate, methyl ethyl ketone, methyl isobutyl ketone or methanol can be exemplified as such an organic solvent. When the resin is a water-soluble resin or an emulsion type resin, water may be used as a solvent. As a method for filling the pores of the porous magnetic core particles with a resin, coating methods such as a dipping method, a spraying method, a brush coating method and a fluid bed method may be exemplified, and the porous magnetic core particles are impregnated with the resin solution by such coating methods and then the solvent is evaporated.

The amount of the resin solid content of the resin solution mentioned above is preferably 1 mass % or more and 50 mass % or less, more preferably 1 mass % or more and 30 mass % or less. With a content of 50 mass % or less, viscosity becomes moderate, and the resin solution can easily uniformly penetrate the pores of the porous magnetic core particles. When the content is 1 mass % or more, it does not take time to remove the solvent and the uniformity of the filling becomes good.

In addition, the exposure degree of the porous magnetic core particles on the surface of the magnetic carrier particles can be controlled by controlling the solid content and the speed of evaporating the solvent when the filling is performed. As a result of the control, the desired resistivity as a magnetic carrier and the desired electric field intensity characteristics just before the break-down can be obtained. As a solvent to be used, toluene whose evaporation rate can easily be controlled is preferable.

Next, the toner used with the magnetic carrier will be described.

It is preferable that the toner has an average circularity of 0.940 or more and 1.000 or less. When the average circularity of the toner falls within the above range, the release characteristics of the magnetic carrier and the toner become good. In addition, in the average circularity range of 0.940 or more and 0.965 or less, good cleaning characteristics are easy to obtain. In the average circularity range of 0.960 or more and 1.000 or less, the toner can easily be adapted to a cleanerless system. When the average circularity is less than 0.940, the toner comes to be somewhat inferior in developing characteristics, and there may be a case where ring marks occur when Vpp is inevitably increased. The average circularity is determined as follows: circularity measured with a flow-type particle image analyzer having one visual field of 512 pixels×512 pixels (0.37 μm×0.37 μm per one pixel) is divided into 800 in the circularity range of 0.200 or more and 1.000 or less and analyzed. The average circularity is based on circularity distribution in the circle-equivalent diameter range of 1.985 or more and less than 39.69 μm.

The fluidity as the two-component developer can be suitably controlled by using a toner whose average circularity is in the range mentioned above and the magnetic carrier of the present invention together. As a result, the transportation characteristics of the two-component developer on a developer carrying member become good, and separation of the toner from the magnetic carrier becomes good, and excellent developing characteristics can be obtained. When being used together with a toner whose particle size is large and whose circularity is high, the magnetic carrier exhibits too high release characteristics with respect to the toner, and therefore, the developer skids on the developer carrying member, and defective transportation is liable to occur in some cases. On the other hand, when used with a toner whose particle size is small and whose circularity is low, the magnetic carrier exhibits too high adhesive power to the toner, and there may be a case where the developing characteristics deteriorate.

It is preferable that the absolute value of the frictional charge amount of the toner measured by applying a two-component method to a two-component developer comprising at least the toner and the magnetic carrier in which the toner concentration is assumed to be 8 mass % is 40.0 mC/kg or more and 80.0 mC/kg or less. In the case of a two-component developer using a toner in which the absolute value of the frictional charge amount of the toner is 40.0 mC/kg or more, when a toner having high coloring power which is preferably used in the present invention is used, the γ-characteristics do not become steep and sufficient gradation characteristics are obtained, and a change in density due to long-term use decreases, and it is stable. When the absolute value of the frictional charge amount of the toner is 80.0 mC/kg or less, sufficient image density and high transfer efficiency are maintained. This is considered to be due to the fact that the electrostatic adhesive power to the magnetic carrier and the photosensitive member surface becomes suitable, and that the toner can follow the electrostatic latent image well, and further that the developing characteristics can be maintained at a high level. The range of the frictional charge amount of the toner mentioned above is also preferable in that the compatibility of the developing characteristics and the alleviation of image defects such as fogging and blank areas can be achieved.

In order to adjust the absolute value of the frictional charge amount of the toner mentioned above to the range mentioned above, an approach from the toner includes controlling the types of external additives, the types of surface treatment agents, the particle size, and the covering ratio of toner particles with external additives. An approach from the magnetic carrier includes optimizing the type of resin to be filled into the magnetic carrier, the type of coating resin, the filling amount and the coating amount, or adding frictional charge imparting particles, charge control agents and electric charge control resins to the resin to be filled or the coating resin.

When a toner having high coloring power which is preferably used in the present invention is used, the reason why a toner having a high frictional charge amount as above is required is explained as follows.

Figure 3:
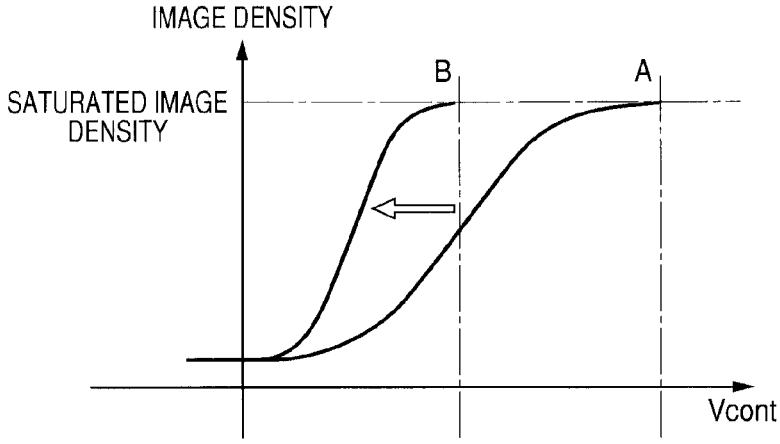
FIG. 3 shows the γ-characteristics of the toner.
Figure 4:
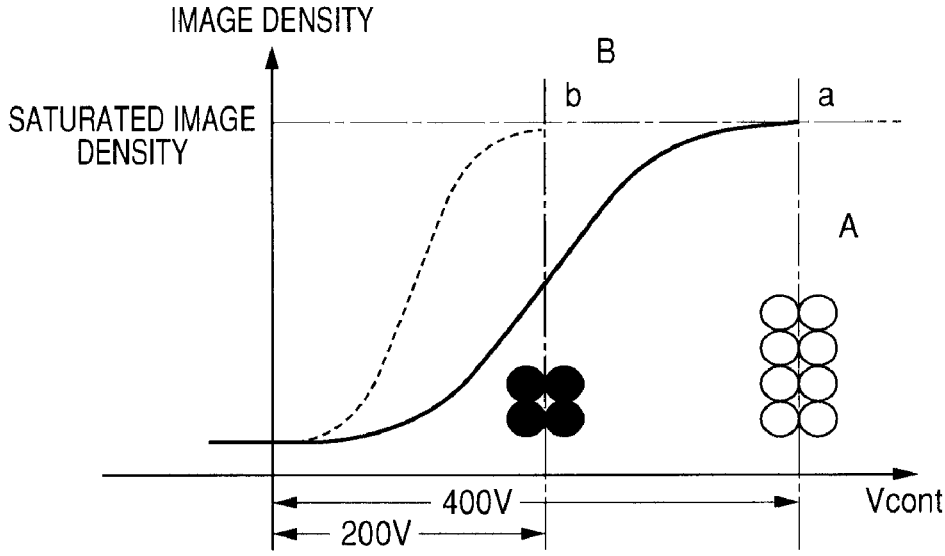
FIG. 4 illustrates the relationship between the contrast electric potential and the (saturated) image density in the toner.

A developer and a developing system are presumed for obtaining saturated image density with a conventional toner, in which, for example, the absolute value of the frictional charge amount of the conventional toner is 30 mC/kg, Vcont=400 V and the laid-on toner amount on a transfer material is 0.60 mg/cm$^2$. The contrast electric potential is taken as the horizontal axis and the image density is taken as the vertical axis, the conventional toner shows the γ-characteristics as in a curve A in FIG. 3. Development is performed by filling the contrast electric potential with the electric charge of the toner and the toner particles. The point a in FIG. 4 is a point at which saturated concentration is obtained by a conventional toner.

Figure 5:
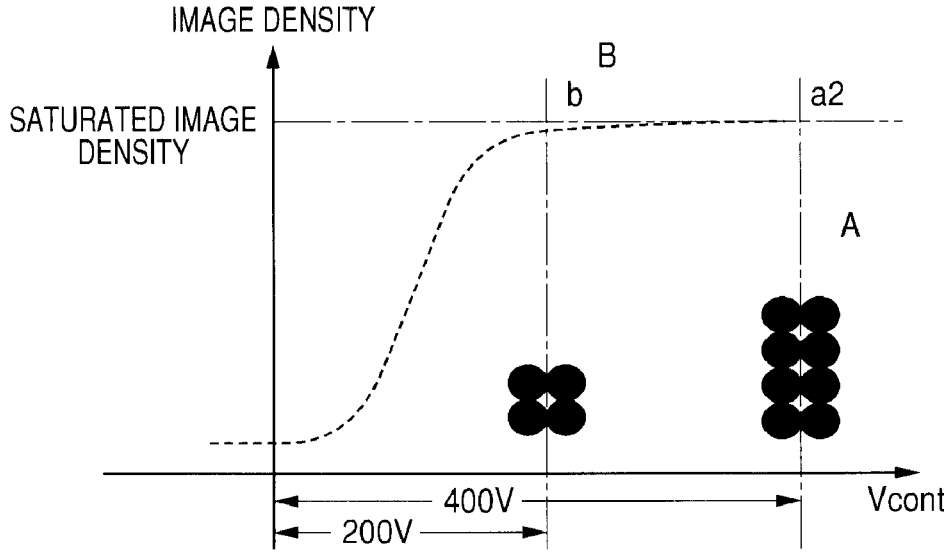
FIG. 5 illustrates the relationship between the contrast electric potential and the (saturated) image density in the toner.

On the other hand, when a toner having high coloring power preferably used in the present invention is used, if the coloring power increases twice as compared with the conventional toner, saturated image density will be obtained with a laid-on toner amount of 0.30 mg/cm$^2$ which is half the amount of the conventional toner. On this account, development is carried out with the toner necessary at a point b in FIG. 4 where Vcont=200 V. When Vcont is further increased from the point b, the laid-on toner amount further increases, but the image density is saturated and therefore will not increase any more (point a2 in FIG. 5). When Vcont=400 V, the laid-on toner amount becomes 0.60 mg/cm$^2$ to reach the point a. The toner high in coloring power becomes excessive, and the image looks gloomy at the point a with the hue significantly being changed.

Figure 7:
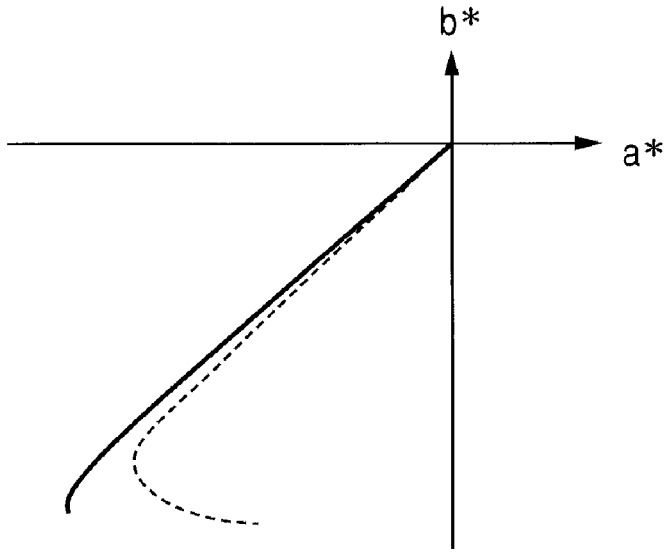
FIG. 7 shows hue profiles of a conventional toner and a toner having strong coloring power in the a* b* plane of CIELAB.

FIG. 7 shows the hue profiles of the conventional toner and a toner having higher coloring power in the a*b* plane of CIELAB for the cyan toner. The conventional toner is represented by a solid line whereas the toner having higher coloring power is represented by a dotted line. The hue profile is shown in which development is performed with the toner having higher coloring power beyond the point b and up to the point a2 in FIG. 5. When the curve comes to the point a2, it bends toward the a* axis side in FIG. 7, which means the hue changes (shown by dotted line). The lowering of the lightness as well is brought about at the same time. Therefore, output should be effected in the minimum amount of toner with which the image density is saturated. However, when a system in which development is carried out with the toner having high coloring power which is saturated in a laid-on amount of 0.30 mg/cm$^2$ and Vcont=200 V is presumed, gradation must be formed in half the conventional Vcont (=200 V), which means that the density change with respect to the change of the electric potential becomes so large that problems with the image stability remain.

Figure 6:
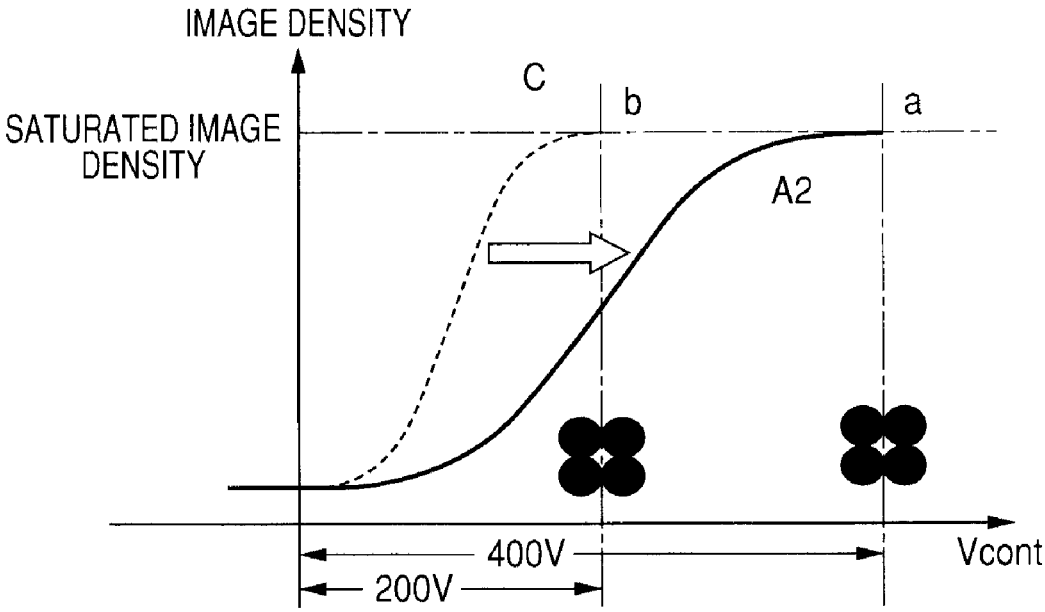
FIG. 6 illustrates a change in the γ-characteristics of the toner.

If gradation can be obtained with the halved laid-on amount in Vcont (=400 V) which is equal to the conventional toner, that is, if γ-characteristics can be made to have a gentle slope as in the conventional toner, just like a curve A2 (a dotted line) as formed by enlarging a curve C (a broken line) in FIG. 6 in the horizontal direction, a change in hue caused by the excessive presence of a toner having high coloring power will be suppressed, and at the same time, the stability of the hue against the electric potential change can be improved. Therefore, it is necessary to increase the frictional charge amount of the toner in order to fill the contrast electric potential Vcont (=400 V) which is equal to the conventional toner with half of the amount of the conventional toner. In order to obtain saturated image density by using the toner having enhanced coloring power of the present invention with a laid-on toner amount of 0.30 mg/cm$^2$ and a contrast electric potential of Vcont=400 V, the frictional charge amount should be doubled as compared with that of the conventional toner. That is, if development is performed efficiently with a toner having a frictional charge amount of 60 mC/kg in terms of an absolute value, it is possible to form gradation with γ-characteristics as in the conventional toner. In order to maintain high gradation characteristics by using the toner having enhanced coloring power while decreasing the laid-on toner amount on a transfer material and suppressing a change in density, it is necessary to efficiently perform development with a toner having a high frictional charge amount.

In addition, it is preferable that the weight average particle size (D4) of the toner is 3.0 μm or more and 8.0 μm or less in order to attain both the high image quality and the durability. When the weight average particle size (D4) is within the above range, the fluidity of the toner is good and the sufficient frictional charge amount is easy to obtain and good resolution is easy to obtain.

In addition, a toner having toner particles containing a binder resin and a coloring agent is used.

As for the binder resin which can be used in the present invention, it is preferable that the peak molecular weight (Mp) in the molecular weight distribution measured by gel permeation chromatography (GPC) is 2,000 or more and 50,000 or less; the number average molecular weight (Mn) is 1,500 or more and 30,000 or less; the weight average molecular weight (Mw) is 2,000 or more and 1,000,000 or less; and the glass transition point (Tg) is 40° C. or more and 80° C. or less in order to attain both the storage stability and the low temperature fixation properties of the toner.

The wax is used preferably in an amount of 0.5 part by or more and 20 parts by mass or less, more preferably in an amount of 2 parts by mass or more and 15 parts by mass or less per 100 parts by mass of the binder resin. In addition, the peak temperature of the maximum endotherm peak of the wax is preferably 45° C. or more and 140° C. or less. This is preferable in that both the storage stability and hot offset properties of the toner can be attained.

The following can be exemplified as a wax. Hydrocarbon wax such as paraffin wax and Fischer Tropsch wax; waxes whose main components are fatty acid esters such as carnauba wax, behenyl behenate ester wax and montanic acid ester wax; wholly or partially deacidified products of fatty acid esters such as deacidified carnauba wax.

The addition amount of the coloring agent is preferably 0.1 to 30 parts by mass, more preferably 0.5 to 20 parts by mass, and most preferably 3 to 18 parts by mass per 100 parts by mass of the binder resin. Particularly the coloring agent in a black toner having a high coloring power can be used in an amount of 8 to 15 parts by mass. The coloring agent in a magenta toner having high coloring power can be used in an amount of 8 to 18 parts by mass. The coloring agent in a cyan toner having high coloring power can be used in an amount of 6 to 12 parts by mass. The coloring agent in a yellow toner having high coloring power can be used in an amount of 8 to 17 parts by mass. It is preferable to use the coloring agent in the above range from the viewpoint of the dispersion characteristics and color development characteristics thereof.

A charge control agent can be incorporated into the toner as needed. As a charge control agent incorporated into the toner, known agents may be used, and particularly, metal compounds of an aromatic carboxylic acid are preferable in that they are colorless, and high in the frictional electrification speed of the toner, and capable of stably maintaining a constant frictional charge amount.

As negative charge control agents, the following may be cited: salicylic acid metal compounds, naphthoic acid metal compounds, dicarboxylic acid metal compounds, polymer compounds each having sulfonic acid or carboxylic acid in the side chain, polymer compounds each having sulfonate or sulfonic acid ester in the side chain, polymer compounds each having carboxylate salt or carboxylic acid ester in the side chain, boron compounds, urea compounds, silicon compounds and calixarene. As positive charge control agents, quaternary ammonium salts, polymer compounds having the above quaternary ammonium salts in their side chains, guanidine compounds and imidazole compounds. The charge control agent may be added internally or externally to the toner particles. It is preferable that the addition amount of the charge control agent is 0.2 part by mass or more and 10 parts by mass or less based on 100 parts by mass of the binder resin.

As spacer particles for improving release characteristics between a toner and a carrier, inorganic particles having at least one peak value in the range of 80 nm or more and 200 nm or less in the number-based particle size distribution may be preferably added externally to the toner.

Besides, other inorganic particles may be added to the toner particles with the aim of improving fluidity and transfer properties. The inorganic particles mentioned above externally added to the surface of the toner particles preferably include titanium oxide, alumina and silica. It is preferable to incorporate inorganic particles having at least one peak value in the range of 10 nm or more and 50 nm or less in the number-based particle size distribution, which may be used together with the spacer particles in a preferred embodiment.

It is preferable that the total addition amount of the external additives is 0.3 part by mass or more and 5.0 parts by mass or less, more preferably 0.8 part by mass or more and 4.0 parts by mass or less, based on 100 parts by mass of the toner particles. Among these, the addition amount of the inorganic particles having at least one peak value in the range of 80 nm or more and 200 nm or less in the number-based particle size distribution is 0.1 part by mass or more and 2.5 parts by mass or less, more preferably 0.5 part by mass or more and 2.0 parts by mass or less. If the content is within this range, the effect as a spacer particle becomes more remarkable.

It is preferable that the surface of an inorganic particle used as an external additive is subjected to hydrophobic treatment.

It is preferable that the hydrophobicity degree of the external additives subjected to hydrophobic treatment is 60 or more and 92 or less. The hydrophobicity degree represents the wettability of a sample in the water/methanol concentration and serves as an index of hydrophobicity.

A method for producing the toner particles includes a pulverizing method in which at least the binder resin, the coloring agent and other internal additives are melt-kneaded and the kneaded product is cooled, followed by pulverization and classification; a method in which toner particles are directly produced by suspension polymerization; a suspension granulation method in which at least the binder resin and the coloring agent are dissolved/swelled/dispersed in a solvent and the resultant solution is dispersed in a certain particle size and then the solvent is removed to obtain toner particles; a dispersion polymerization method in which toner particles are directly produced using an aqueous organic solvent in which monomers are soluble and polymers obtained are insoluble; a method in which toner particles are produced by emulsion polymerization, as typified by soap-free polymerization in which toner particles are formed by direct polymerization in the presence of a water-soluble polar polymerization initiator; and an emulsification coagulation method including forming fine particle aggregates by coagulating at least polymer fine particles and coloring agent fine particles and maturing the fine particle aggregates to fuse the fine particles in the fine particle aggregates.

The procedure for producing the toner by pulverizing method in which the toner having high coloring power can be most preferably produced will be described below.

In the material mixing step, predetermined amounts of at least a binder resin, a coloring agent and a wax and other ingredients such as a charge control agent as needed are weighed and mixed as materials constituting toner particles. Examples of the mixing apparatus include a double cone mixer, V type mixer, drum type mixer, super mixer, HENSCHEL MIXER, and NAUTA MIXER.

Then the mixed materials are melt-kneaded to disperse the coloring agent in the binder resin. In the melt-kneading step, batch type kneaders such as a pressurization kneader and a BANBURY MIXER, and continuous type kneaders can be used, and from the advantage of being capable of continuous production, mono-screw or twin-screw extruders are preferable. For example, the following may be used: KTK type twin-screw extruders manufactured by Kobe Steel, Ltd., TEM type twin-screw extruders manufactured by Toshiba Machine Co., Ltd., PCM kneading machine manufactured by Ikegai Corporation, twin-screw extruders manufactured by KCK Corporation and co-kneader manufactured by Buss Corporation.

In order to improve the dispersion of the coloring agent, a masterbatch in which a coloring agent and a binder resin are preliminarily kneaded while using the coloring agent in a high content, can be further subjected to the above-mentioned kneading (dilution kneading). As a method for forming a coloring agent masterbatch, the synthesized coloring agent is subjected to heat mixing with a resin without drying as a moisture containing product (as a paste coloring agent) and then made into dry pellets. As a kneading machine, the following may be cited: a heating kneader, a mono-screw extruder, a twin-screw extruder and a kneader, and particularly preferably, a heating kneader may be cited. The content of the coloring agent in the masterbatch is preferably 20 mass % or more and 50 mass % or less for preventing the pigment shock at the time of dilution and enhancing dispersibility.

The colored resin composition obtained by melt-kneading is further rolled by means of two rolls and cooled with water at a cooling step.

Then, the cooled resin composition is pulverized to a desired particle size at a pulverizing step.

Then, the composition is classified by a classifying machine or a sieving machine such as Elbowjet for an inertial classification method manufactured by Nittetsu Mining Co., Ltd., Turboplex for a centrifugal force classification method manufactured by Hosokawa Micron Corporation as needed to obtain toner particles.

After pulverization, surface modification of the toner particles such as spherical treatment may be performed as needed by means of a hybridization system manufactured by Nara Machinery Co., Ltd. or a mechanofusion system and FACULTY manufactured by Hosokawa Micron Corporation.

When toner particles are produced by a polymerization method, monomers to be used include monomers used for vinyl resins.

As a polymerization initiator, an azo polymerization initiator and a peroxide polymerization initiator may be used.

The addition amount of the polymerization initiator varies depending on the polymerization degree, but it is generally added and used in an amount of 0.5 to 20 mass % of the monomers. Although there may be some difference depending on the polymerization method, the polymerization initiators are used each singly or as a mixture in consideration of 10-hour half-life temperature. Conventionally known crosslinking agents, chain transfer agents, polymerization inhibitors can be further added and used so as to control the polymerization degree.

A dispersing agent may be used when suspension polymerization is used as a production method of the toners. The dispersing agent to be used may include inorganic oxide compounds and organic compounds.

The dispersing agent is dispersed in a water phase and used. The preferable amount of the dispersing agent to be added is 0.2 to 10.0 parts by mass based on 100 parts by mass of the monomers.

As for the dispersing agents, commercial products may be used as they are, but in order to obtain dispersed fine particles having a uniform fine particle size, the inorganic compound can be generated in a disperse medium under high speed stirring. For example, in the case of tricalcium phosphate, a preferable dispersing agent can be obtained by mixing an aqueous solution of sodium phosphate and an aqueous solution of calcium chloride under high-speed stirring.

A surfactant may be used in an amount of 0.001 to 0.1 part by mass based on 100 parts by mass of the monomers.

The frictional charge amount of the toner measured by applying a two-component method to a two-component developer comprising at least the toner and the magnetic carrier in which the toner concentration is set to 8 mass % is determined by shaking the developer prepared so that the toner concentration is set to 8 mass % in a V-type mixer for 10 minutes at 0.63 $S^{-1}$. The absolute value of the frictional charge amount when mixing is performed for 10 minutes is defined as the frictional charge amount. As for the developer further tested on the durability, image formation is repeated till the toner concentration reaches 8 mass %. In that case, when the toner concentration is to be increased, the toner amount to be supplied is made to be 1.01 times the consumed toner amount in a printing ratio of 1%. When the toner concentration is to be decreased, no toner is supplied at a printing ratio of 20%. Within the above range, it is easy to obtain high quality images and images without fogging. Furthermore, in the toner having high coloring power, Vcont can be sufficiently taken, and images excellent in gradation characteristics can be output.

In the present invention, the toner to be replenished may be replenished by itself, but the toner is preferably mixed beforehand with a small amount of the magnetic carrier and used as a replenishing developer. This is preferable because the frictional electrification of the toners can be accelerated to give an increased frictional charge amount. As for the ratio of the magnetic carrier to the toner, it is preferable that toner/magnetic carrier is 2/1 to 50/1 by mass ratio for accelerating the frictional electrification.

The image forming method in the present invention will be described below.

Figure 8:
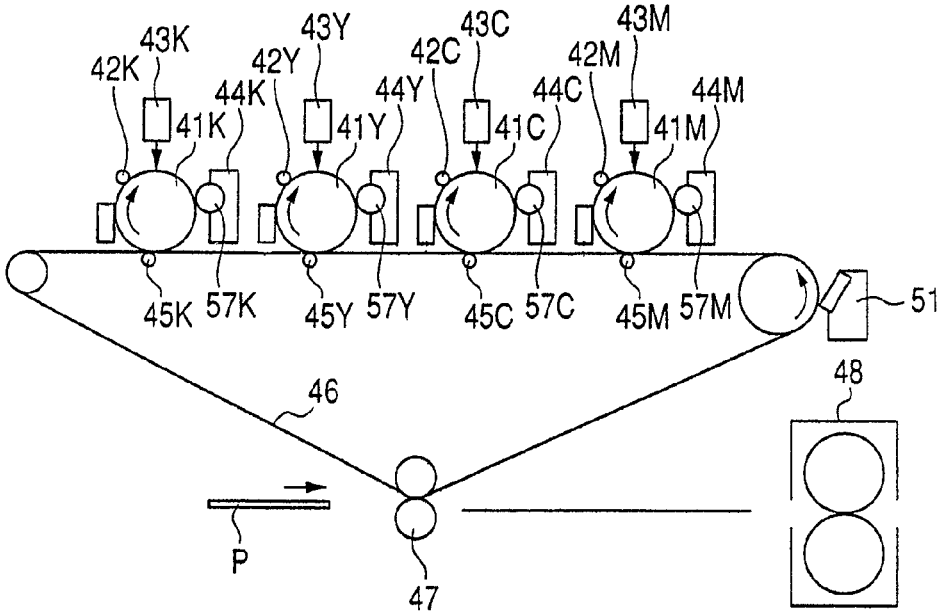
FIG. 8 is a schematic constitutive view illustrating one embodiment of the full color image forming apparatus.

FIG. 8 is an example of a schematic view illustrating a full color image forming apparatus to which the image forming method of the present invention is applied.

The order of the image forming units such as K, Y, C, M and an arrow showing the rotation direction in the drawing are not restrictive to these at all. For reference, K stands for black, Y for yellow, C for cyan, and M for magenta. In FIG. 8, photosensitive members 41K, 41Y, 41C, 41M which are electrostatic latent image bearing members rotate in the direction shown by the arrow in the drawing. Respective photosensitive members are charged by charging apparatuses 42K, 42Y, 42C, 42M which are charging units, and a laser beam is projected on the charged surface of the respective electrophotographic photosensitive members by exposure apparatuses 43K, 43Y, 43C, 43M which are electrostatic latent image forming units to form electrostatic latent images. Then, the electrostatic latent images are made visible as toner images by two-component developers (not illustrated) carried on developer carrying members 57K, 57Y, 57C, 57M set in developing apparatuses 44K, 44Y, 44C, 44M which are developing units and transferred onto an intermediate transfer member 46 by means of transfer apparatuses 45K, 45Y, 45C, 45M which are transferring units. The toner images are further transferred onto a transfer material P by the transfer apparatus 47 which is a transferring unit, and the transfer material P is subjected to heat and pressure fixing by a fixing apparatus 48 which is a fixing unit, and the transfer material P with the fixed image thereon is output. A cleaning member 51 for a transfer belt collects a transfer residual toner.

Figure 9:
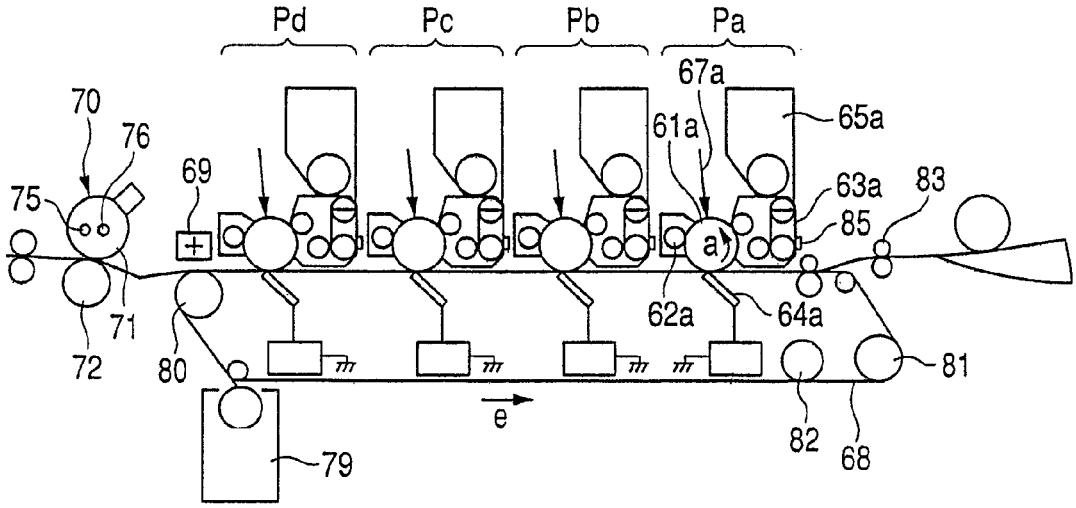
FIG. 9 is a schematic constitutive view illustrating one embodiment of the cleanerless system in the full color image forming apparatus.

FIG. 9 is a schematic view illustrating a full color image forming apparatus to which the image forming method of the present invention is applied. This apparatus does not have an independent cleaning unit for collecting and storing a transfer residual toner remaining on the photosensitive member, and performs a cleaning method simultaneous with the developing in which the developing unit collects a transfer residual toner which remains on the image bearing member after the toner image has been transferred to a transfer material.

The main body of the full color image forming apparatus is provided side by side with a first image forming unit Pa, a second image forming unit Pb, a third image forming unit Pc and a fourth image forming unit Pd, and images with respectively different colors are formed on a transfer material through the process of latent image formation, development and transfer.

The respective image forming units provided side by side in the image forming apparatus are each constituted as described below taking as an example the case of the first image forming unit Pa.

The first image forming unit Pa has a photosensitive member 61*a* of 60 mm in diameter as an image bearing member which is an electrostatic latent image bearing member. This photosensitive member 61*a* is rotatively moved in the direction of an arrow a. A charging roller 62*a* such as a primary charging assembly as a charging unit is disposed so that a magnetic brush for charging formed on the surface of a 16 mm diameter sleeve is brought into contact with the photosensitive member 61*a*. Irradiation with exposing light 67*a* is carried out by an exposure apparatus (not shown) for forming an electrostatic latent image on the photosensitive member 61*a* whose surface has uniformly been charged by means of the charging roller 62*a*. A developing assembly 63*a* as a developing unit for developing an electrostatic latent image held on the photosensitive member 61*a* to form a color toner image holds a color toner. A transfer blade 64*a* as a transferring unit transfers the color toner image formed on the surface of the photosensitive member 61*a* to the surface of a transfer material (recording material) transported by a belt transfer material carrying member 68. This transfer blade 64*a* comes into contact with the back side of the transfer material carrying member 68 and can apply a transfer bias thereto.

In the first image forming unit Pa, the photosensitive member 61*a* is uniformly primarily charged by the charging roller 62*a*, and thereafter the electrostatic latent image is formed on the photosensitive member by the exposing light 67*a* emitted from the exposure apparatus. The electrostatic latent image is developed by the developing assembly 63*a* using the color toner. The toner image thus formed by development is transferred to the surface of a transfer material by applying transfer bias from the transfer blade 64*a* coming into contact with the back side of the belt transfer material carrying member 68 carrying and transporting a transfer material, at a first transfer part (the position where the photosensitive member and the transfer material come into contact with each other).

The toner is consumed as a result of the development and the T/C (toner/magnetic carrier) ratio is reduced, whereupon this reduction is detected by a toner concentration detecting sensor 85 which measures a change in the permeability of the developer by utilizing the inductance of a coil, and a container for a replenishing toner 65*a* is replenished with a replenishing toner according to the amount of the toner consumed. The toner concentration detecting sensor 85 has a coil (not shown) in its interior.

In this image forming apparatus, the second image forming unit Pb, third image forming unit Pc and fourth image forming unit Pd, constituted in the same way as in the first image forming unit Pa, but having different color toners held in the developing assemblies, are so provided that the four image forming units are arranged side by side. For example, a yellow toner is used in the first image forming unit Pa, a magenta toner in the second image forming unit Pb, a cyan toner in the third image forming unit Pc and a black toner in the fourth image forming unit Pd. Thereby, the respective color toners are sequentially transferred to a transfer material at the transfer parts of the respective image forming units. In this course, the respective color toners are superimposed while making registration, on the same transfer material with one-time movement of the transfer material. After the transfer is completed, the transfer material is separated from the surface of the transfer material carrying member 68 by a separation charging assembly 69, and then sent to a fixing assembly 70 by a transport unit such as a transport belt, where a final full-color image is formed only by one-time fixing.

The fixing assembly 70 has an 80 mm diameter fixing roller 71 and a 60 mm diameter pressure roller 72 in pairs. The fixing roller 71 has heating units 75 and 76 in its interior.

Unfixed color toner images having been transferred onto the transfer material are passed through the pressure contact part between the fixing roller 71 and the pressure roller 72 of this fixing assembly 70, whereupon they are fixed onto the transfer material by the action of heat and pressure. As the members for use in the fixing assembly, any combination of the combination of an upper roller and a lower roller, the combination of an upper belt and a lower roller, the combination of an upper roller and a lower belt and the combination of an upper belt and a lower belt may be used.

In FIG. 9, the transfer material carrying member 68 is an endless belt member. This belt member is moved in the direction of an arrow e by a drive roller 80. In addition, a transfer belt cleaning device 79; a belt driven roller 81; and a belt charge eliminator 82 are provided. A pair of registration rollers 83 is for transporting to the transfer material carrying member 68 the transfer material held in a transfer material holder.

As the transferring unit, in place of the transfer blade 64*a* coming into contact with the back side of the transfer material carrying member 68, a contact transferring unit may be used which is a transfer roller in the form of a roller in contact with the back side of the transfer material carrying member 68 and can directly apply a transfer bias.

The above contact transferring unit may also be replaced with a non-contact transferring unit which performs transfer by applying a transfer bias from a means placed in non-contact with the transfer material carrying member 68 on the back side thereof, as commonly used. However, in view of such an advantage that the amount of ozone generated when the transfer bias is applied can be controlled, it is more preferable to use the contact transferring units.

In the present invention, it is preferable that the image density after fixation is 1.30 or more and 1.60 or less when the laid-on toner amount of the single color solid image part formed on the transfer material is 0.30 mg/cm$^2$. Since high image density is obtained in the state in which the laid-on toner amount is 0.30 mg/cm$^2$ which is smaller than before, loading characteristics are improved, for example, in the case where there is a deflection in the image and a large number of the same images are expelled from the apparatus. This is also preferable because, in the transfer process, curling of paper can be alleviated when a solid image is output, and because scattering is significantly suppressed as compared with the case where a large laid-on toner amount is used. However, the toner with high coloring power is liable to be outstanding in fogging because the density of each particle is dark. In addition, where reproducibility of dots is disrupted, roughened images are liable to be outstanding. Therefore, a system can be realized by using the magnetic carrier of the present invention which prevents fogging by the toner having a high toner charge amount, and even in such a case, assures satisfactory developing characteristics.

By using a magnetic carrier having a low specific gravity and low magnetic force which is provided by filling porous magnetic cores with a resin, the magnetic brush becomes flexible in the developing part and dot reproducibility becomes good. In addition, fogging can be prevented by increasing the frictional charge amount of the toner.

The developing process in the present invention includes forming a magnetic brush of a two-component developer of the present invention on a developer carrying member and applying a developing bias between the electrostatic latent image bearing member and the developer carrying member (S-D gap) in a state in which the magnetic brush is contacted, to thereby form an electric field, thereby developing the electrostatic latent image with the toner.

Specifically, the developer carrying member (developing sleeve) contains in its interior a magnet having a developing pole of 800 gauss or more and 1500 gauss or less. The developer is applied in a predetermined layer thickness with a developer layer thickness regulation member and a magnetic brush of the two-component developer is formed on the surface of the developer carrying member. Then, the developer is transported to the developing area facing the developer carrying member. A developing bias formed by superposing an alternating electric field on a direct current electric field is applied between the electrostatic latent image bearing member and the developer carrying member (S-D gap) in a state in which the magnetic brush is contacted, to thereby form an electric field, and thereby developing the electrostatic latent image.

The S-D gap is 100 μm or more and 500 μm or less and typically about 300 μm, and arrangement with such a gap is preferable for developing characteristics and for preventing carrier adhesion.

As an alternating electric field condition, the frequency is 500 Hz or more and 3,000 Hz or less and the peak-to-peak voltage (Vpp) is 500 V or more and 1,800 V or less, preferably 700 V or more and 1,500 V or less. As a direct current electric field condition, the absolute value is 200 V or more and 550 V or less. The developing bias formed by superposing these is preferable from the viewpoint of improvement in developing characteristics and image quality, and the prevention of carrier adhesion.

It is preferable to lower Vpp as much as possible from the viewpoint of preventing carrier adhesion, but when it is lowered, the developing characteristics remarkably deteriorate and the image quality of the half tone part also deteriorates. When Vpp is elevated, sufficient developing characteristics can be obtained, but patterns in the form of rings or spots on a transfer material (recording paper) are caused in some cases.

<Measurement of Electric Field Intensity Just Before the Break-down and Resistivity of Magnetic Carrier and Porous Magnetic Core>

Figure 1A:
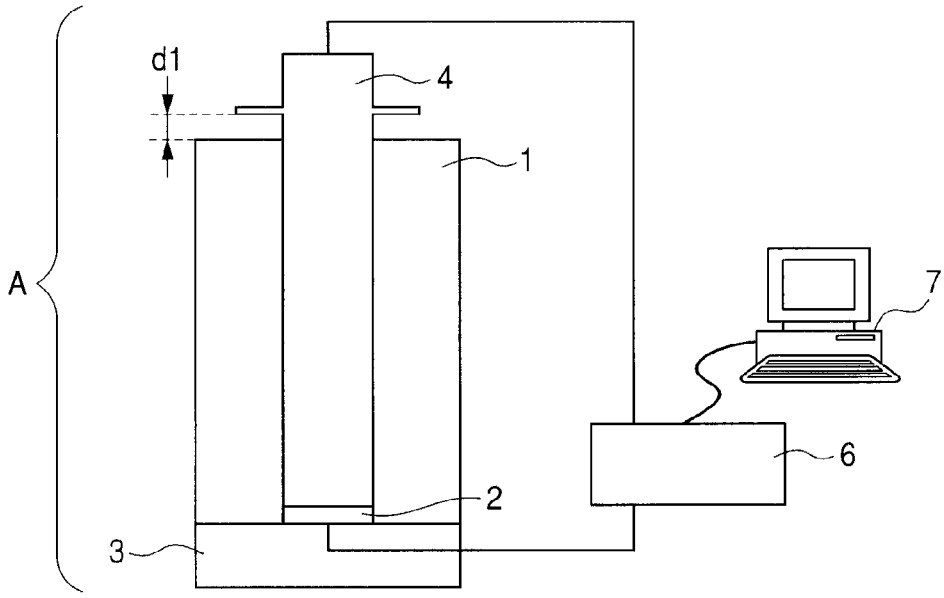
FIGS. 1A and 1B are schematic cross sectional views of an apparatus for measuring the resistivity of a magnetic carrier, a magnetic core or the like in the present invention.
Figure 1B:
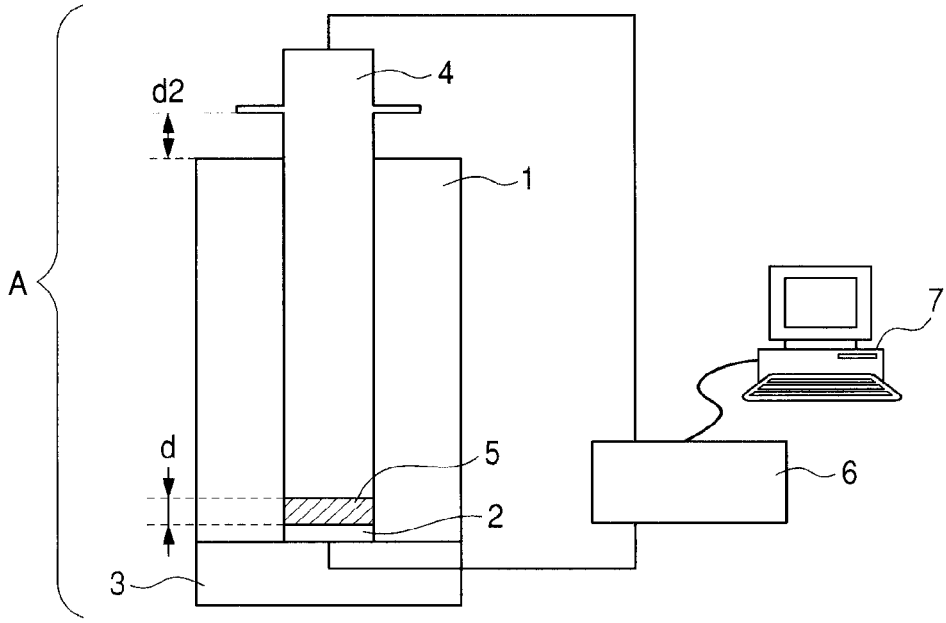

The electric field intensity just before the break-down and the resistivity of the magnetic carrier and porous magnetic core are measured with a measuring apparatus schematically illustrated in FIG. 1A and FIG. 1B. For the measurement of the porous magnetic core, samples which have not been filled with a resin and coated with a resin are used.

A resistance measurement cell A includes a cylindrical PTFE resin container 1 having an opening of 2.4 $cm^2$ in cross section, a lower part electrode (made of stainless steel) 2, a support pedestal (made of PTFE resin) 3, and an upper part electrode (made of stainless steel) 4. The cylindrical PTFE resin container 1 is placed on the support pedestal 3 and filled with a sample (magnetic carrier or porous magnetic core) 5 to the thickness of about 1 mm and the upper part electrode 4 is placed on the sample 5 in the container, and then, the thickness of the sample is measured. As shown in FIG. 1A, the gap when there is no sample is d1, and as shown in FIG. 1B, the gap when the sample is filled to a thickness of about 1 mm is d2, and the thickness d of the sample is calculated by the following expression:

$$d=d2-d1$$

In this case, it is important to appropriately change the mass of the sample so that the thickness of the sample becomes 0.95 mm or more and 1.04 mm or less.

A direct voltage is applied between the electrodes, and an electric current flowing at this time is measured to determine the electric field intensity just before the break-down and the resistivity of the magnetic carrier and porous magnetic core. An electrometer 6 (Keithley 6517A manufactured by Keithley Instruments Inc.) is used for the measurement and a computer 7 is used for control.

Control is performed with a control system manufactured by National Instruments Corporation for a control computer and software using control software (LabVEIW manufactured by National Instruments Corporation). As a measurement condition, a found value d is input which is measured under the condition where the contact area of the sample and the electrode S=2.4 $cm^2$, and the thickness of the sample is 0.95 mm or more and 1.04 mm or less. In addition, the load of the upper part electrode is 120 g and the maximum applied voltage is 1,000 V.

The condition for applying the voltage is as follows: screening in which the voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V are each applied for one second is performed utilizing the automatic range function of the electrometer by using an IEEE-488 interface for the control between the control computer and the electrometer. In this case, the electrometer determines whether a voltage can be applied up to 1,000 V (10,000 V/cm as electric field intensity, for example, when the sample thickness is 1.00 mm), and when overcurrent flows, "VOLTAGE SOURCE OPERATE" flashes on and off. Then, the applied voltage is decreased and the voltages that can be applied are screened, and the maximum value of the applicable voltage is automatically determined. Subsequently, main measurement is performed. The determined maximum value of the applicable voltage is divided into 5 and the respective voltages are applied for 30 seconds and the resistance values are measured from the current values. For example, when the maximum applied voltage is 1,000 V, the voltage is applied in such an order that the voltage is increased in increments of 200 V and then decreased in decrements of 200 V, which is ⅕ of the maximum applied voltage, i.e., 200 V (the first step), 400 V (the second step), 600 V (the third step), 800 V (the fourth step), 1,000 V (the fifth step), 1,000 V (the sixth step), 800 V (the seventh step), 600 V (the eighth step), 400 V (the ninth step) and 200 V (the tenth step), and the resistance value is measured from the current value after keeping each step for 30 seconds.

In the case of the porous magnetic core used in Example 1, 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V) and 128 V ($2^7$ V) were applied respectively for one second at the time of the screening, and the indication of "VOLTAGE SOURCE OPERATE" lighted up to 64 V, and the indication of "VOLTAGE SOURCE OPERATE" flashed on and off at 128 V. Then, the maximum applicable voltage was converged in such a way that the indication flashed on and off at 90.5 V ($2^{6.5}$ V), was turned on at 68.6 V ($2^{6.1}$ V), and flashed on and off at 73.5 V ($2^{6.2}$ V), and as a result, the maximum applicable voltage became 69.8 V. The voltage is applied in the order of 14.0 V (the first step) which is ⅕ of 69.8 V, 27.9 V (the second step) which is ⅖, 41.9 V (the third step) which is ⅗, 55.8 V (the fourth step) which is ⅘, 69.8 V (the fifth step) which is ⅝, 69.8 V (the sixth step), 55.8 V (the seventh step), 41.9 V (the eighth step), 27.9 V (the ninth step), 14.0 V (the tenth step). The electric current values obtained therefrom are processed by a computer to calculate the electric field intensity and the resistivity from the sample thickness of 0.97 mm and the electrode area, and plotted in a graph. In that case, while decreasing the voltage from the maximum applied voltage (from the sixth step to the tenth step in Table 1A), five points are plotted. In the measurement of the respective steps, when the indication of "VOLTAGE SOURCE OPERATE" flashes on and off and overcurrent flows, the resistance value is displayed as zero in the measurement. This phenomenon is defined as "break-down". The phenomenon in which "VOLTAGE SOURCE OPERATE" flashes on and off is defined as the electric field intensity just before the break-down. Therefore, the value at the point where "VOLTAGE SOURCE OPERATE" flashes on and off and the maximum electric field intensity of the afore-mentioned profile is plotted is defined as the electric field intensity just before the break-down. In the case where "VOLTAGE SOURCE OPERATE" flashes on and off when the maximum applied voltage is applied, if the resistance value does not become zero and the point can be plotted, the value at the point is defined as the electric field intensity just before the break-down. In the case of the porous magnetic core in Example 1 shown in Table 1A, the value is 55.8 V, which corresponds to $5.76\times10^2$ V/cm as electric field intensity. In the case of the magnetic carrier, the value is 319 V, which corresponds to $3.13\times10^3$ V/cm as electric field intensity. In addition, the resistivity and the electric field intensity can be determined by the following expression.

$$\text{Resistivity } (\Omega\cdot\text{cm})=(\text{applied voltage (V)}/\text{measurement current } (A))\times S\ (\text{cm}^2)/\text{d(cm)}$$

$$\text{Electric field intensity (V/cm)}=\text{applied voltage (V)}/\text{d (cm)}$$

The results of plot for the magnetic carrier and porous magnetic core used in Example 1 are shown in FIG. 2.

In FIG. 2, the resistivity of the magnetic carrier at the electric field intensity of 1,000 V/cm can be determined by reading the resistivity at the electric field intensity of 1,000 V/cm from the graph. Because there is no intersection point in the case of the magnetic carrier used in Example 1 of the present invention, a straight line which links the value at 3,130 V/cm and the value at 1,560 V/cm is extrapolated (shown with a broken line in the drawing) and the intersection point thereof with the vertical line at the electric field intensity of 1,000 V/cm is defined as the resistivity value at the electric field intensity of 1,000 V/cm. Therefore, in the case of the magnetic carrier used in Example 1 of the present invention, the resistivity value at the electric field intensity of 1,000 V/cm is $4.0\times10^{7}$ Ω·cm. Similarly, the intersection point with the vertical line at the electric field intensity of 2,000 V/cm is defined as the resistivity value at the electric field intensity of 2,000 V/cm. When there is no intersection point, extrapolation is conducted with a straight line which links two points on the side to be extrapolated and the intersection point thereof with the vertical line at the electric field intensity of 2,000 V/cm is defined as the resistivity value at the electric field intensity of 2,000 V/cm. The electric field intensity just before the break-down can be determined by reading the point of the maximum electric field intensity of the profile from the graph.

When measurement is made for a porous magnetic core, the resistivity and the electric field intensity just before the break-down at 300 V/cm can be determined by reading the graph in the same way as in the magnetic carrier.

Figure 12:
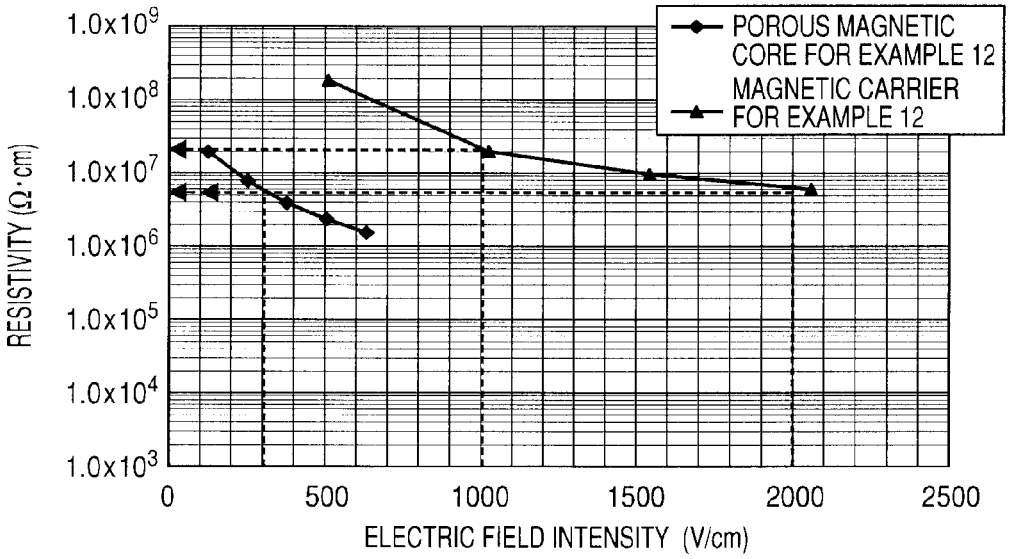
FIG. 12 is an example of a graph showing the measurement results of resistivity. The measurement results of the magnetic carrier 16 of Example 12 and porous magnetic core 10 used therefor are shown.

The results of the actual measurement and plot for the magnetic carrier 16 and the porous magnetic core 10 used in Example 12 are shown in Table 1B and FIG. 12.

Figure 13:
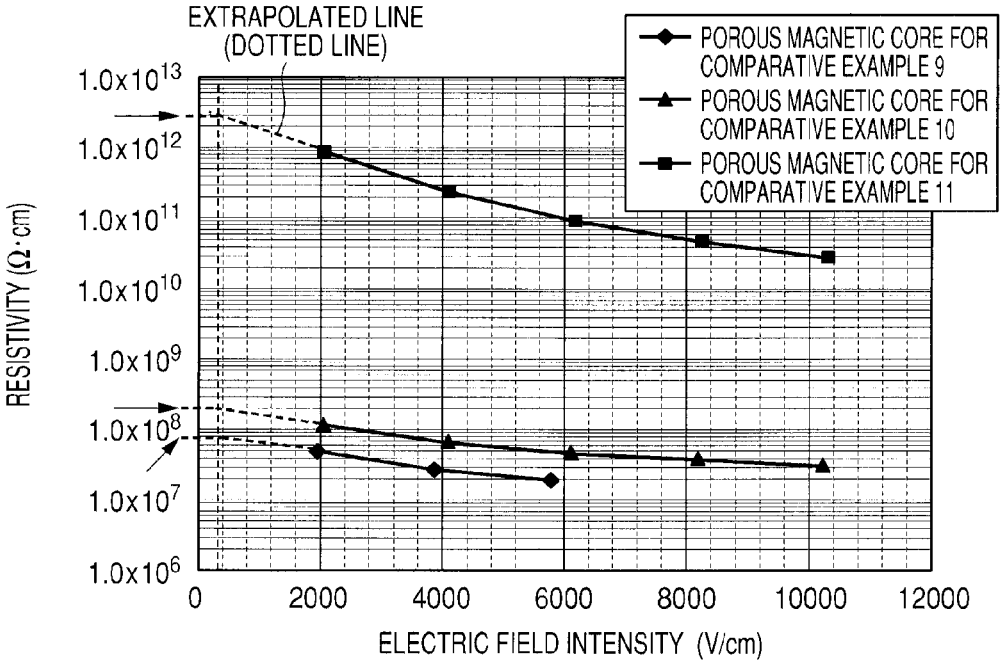
FIG. 13 is an example of a graph showing the measurement results of resistivity. The measurement results of the magnetic cores (porous magnetic core 16, magnetic core 17, and magnetic core 18) used in Comparative Examples 9, 10 and 11 are shown.

The graphs of resistivity of porous magnetic cores 16, 17 and 18 used respectively in Comparative Examples 9, 10 and 11 are shown in FIG. 13. Because there is no plot at the electric field intensity of 300 V/cm for any of the porous magnetic cores as shown by dotted lines in the drawing, extrapolation from a point of electric field intensity of 3,850 V/cm and a point of electric field intensity of 1,920 V/cm (Comparative Example 9), extrapolation from a point of electric field intensity of 4,080 V/cm and a point of electric field intensity of 2,040 V/cm (Comparative Example 10), and extrapolation from a point of electric field intensity of 4,120 V/cm and a point of electric field intensity of 2,060 V/cm (Comparative Example 11) are performed, and the values of the respective intersection points with the vertical line of the electric field intensity of 300 V/cm (shown by a dotted line) are each defined as the resistivity at the electric field intensity of 300 V/cm.

Figure 14:
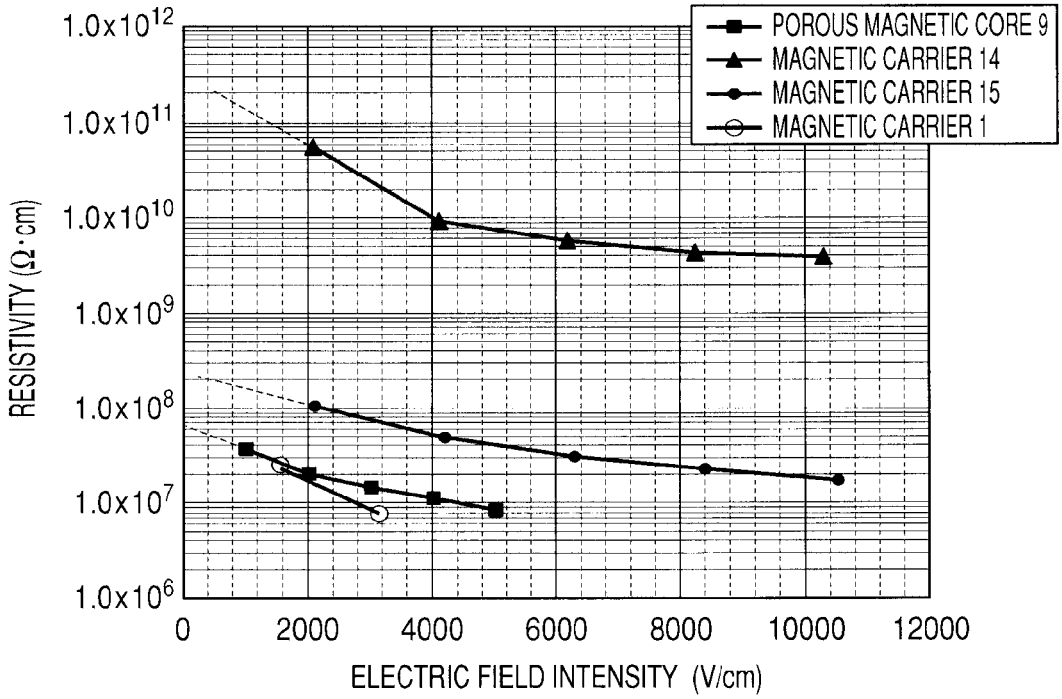
FIG. 14 is an example of a graph showing the measurement results of resistivity. The measurement results of the porous magnetic core 9 and magnetic carriers (magnetic carrier 14, magnetic carrier 15) used in Comparative Examples 5 and 6 are shown.

A graph of resistivity of porous magnetic core used in Comparative Examples 5 and 6, magnetic carrier 14 filled with a resin (Comparative Example 5), magnetic carrier 15 in which the particles are filled with a resin and further coated with a resin (Comparative Example 6) is shown in FIG. 14. None of these magnetic carriers caused break-down at the electric field intensity of 10,000 V/cm or less. The resistivity values at the electric field intensity of 1,000 V/cm and 2,000 V/cm were $1.7\times10^{8}$ Ω·cm and $1.1\times10^{8}$ Ω·cm (Comparative Example 6), respectively, and $1.4\times10^{11}$ Ω·cm and $5.6\times10^{10}$ Ω·cm (Comparative Example 5), respectively. The electric field intensity just before the break-down of the porous magnetic cores was 5,040 V/cm. Because there is no plot at the electric field intensity of 300 V/cm, extrapolation from a line linking a point of electric field intensity of 2,020 V/cm and a point of electric field intensity of 1,010 V/cm is performed, and the value at the electric field intensity of 300 V/cm is defined as the resistivity value. Therefore, the resistivity value in electric field intensity of 300 V/cm corresponds to $5.2\times10^{10}$ Ω·cm.

TABLE 1A

| | Porous magnetic core (d = 0.97 mm) | | | Magnetic carrier(d = 1.02 mm) | | |
|---|---|---|---|---|---|---|
| Step | Applied voltage (V) | Electric field intensity (V/cm) | Resistivity (Ω · cm) | Applied voltage (V) | Electric field intensity (V/cm) | Resistivity (Ω · cm) |
| 1 | 14.0 | $1.44\times10^{2}$ | $1.1\times10^{7}$ | 159 | $1.56\times10^{3}$ | $8.7\times10^{7}$ |
| 2 | 27.9 | $2.88\times10^{2}$ | $5.7\times10^{6}$ | 319 | $3.13\times10^{3}$ | $1.7\times10^{7}$ |
| 3 | 41.9 | $4.32\times10^{2}$ | $3.7\times10^{6}$ | 478 | $4.69\times10^{3}$ | $0.0\times10^{0}$ |
| 4 | 55.8 | $5.76\times10^{2}$ | $2.5\times10^{6}$ | 638 | $6.25\times10^{3}$ | $0.0\times10^{0}$ |
| 5 | 69.8 | $7.19\times10^{2}$ | $0.0\times10^{0}$ | 797 | $7.81\times10^{3}$ | $0.0\times10^{0}$ |
| 6 | 69.8 | $7.19\times10^{2}$ | $0.0\times10^{0}$ | 797 | $7.81\times10^{3}$ | $0.0\times10^{0}$ |
| 7 | 55.8 | $5.76\times10^{2}$ | $2.2\times10^{6}$ | 638 | $6.25\times10^{3}$ | $0.0\times10^{0}$ |
| 8 | 41.9 | $4.32\times10^{2}$ | $3.6\times10^{6}$ | 478 | $4.69\times10^{3}$ | $0.0\times10^{0}$ |
| 9 | 27.9 | $2.88\times10^{2}$ | $7.3\times10^{6}$ | 319 | $3.13\times10^{3}$ | $7.5\times10^{6}$ |
| 10 | 14.0 | $1.44\times10^{2}$ | $1.8\times10^{7}$ | 159 | $1.56\times10^{3}$ | $2.4\times10^{7}$ |

TABLE 1B

| | Porous magnetic core (d = 1.04 mm) | | | Magnetic carrier (d = 0.98 mm) | | |
|---|---|---|---|---|---|---|
| Step | Applied voltage (V) | Electric field intensity (V/cm) | Resistivity (Ω · cm) | Applied voltage (V) | Electric field intensity (V/cm) | Resistivity (Ω · cm) |
| 1 | 13.2 | $1.27\times10^{2}$ | $1.1\times10^{7}$ | 50 | $5.14\times10^{2}$ | $1.1\times10^{9}$ |
| 2 | 26.4 | $2.54\times10^{2}$ | $6.1\times10^{6}$ | 101 | $1.03\times10^{2}$ | $1.3\times10^{8}$ |
| 3 | 39.6 | $3.81\times10^{2}$ | $5.3\times10^{6}$ | 151 | $1.54\times10^{2}$ | $3.9\times10^{7}$ |
| 4 | 52.8 | $5.08\times10^{2}$ | $3.4\times10^{6}$ | 202 | $2.06\times10^{2}$ | $1.7\times10^{7}$ |
| 5 | 66.0 | $6.35\times10^{2}$ | $1.7\times10^{6}$ | 252 | $2.57\times10^{2}$ | $0.0\times10^{0}$ |
| 6 | 66.0 | $6.35\times10^{2}$ | $1.6\times10^{6}$ | 252 | $2.57\times10^{2}$ | $0.0\times10^{0}$ |
| 7 | 52.8 | $5.08\times10^{2}$ | $2.4\times10^{6}$ | 202 | $2.06\times10^{2}$ | $6.0\times10^{6}$ |
| 8 | 39.6 | $3.81\times10^{2}$ | $4.1\times10^{6}$ | 151 | $1.54\times10^{2}$ | $9.5\times10^{6}$ |
| 9 | 26.4 | $2.54\times10^{2}$ | $8.0\times10^{6}$ | 101 | $1.03\times10^{2}$ | $2.1\times10^{7}$ |
| 10 | 13.2 | $1.27\times10^{2}$ | $2.0\times10^{7}$ | 50 | $5.14\times10^{2}$ | $1.8\times10^{8}$ |

<Measurement of Pore Size and the Total Pore Volume of Porous Magnetic Core>

The pore size distribution of the porous magnetic core (also referred to as "pore size distribution") is measured by a mercury intrusion method. The measurement principle is as follows.

In this measurement, the pressure applied on the mercury is varied and the amount of mercury which enters the pores is measured. The condition that mercury can permeate the pores can be represented by $PD=-4\sigma\cos\theta$ (where P is pressure, D is pore size, and θ and σ are contact angle and surface tension of mercury, respectively) from the balance of forces. When the contact angle and surface tension are assumed to be constant values, the pressure P and the pore size D of the pore into which mercury enters will be in inverse proportion. On this account, the horizontal axis P of the P-V curve obtained by measuring the pressure P and the amount V of mercury which enters into the pores while varying the pressure is replaced with the pore size directly from this expression, whereby the pore distribution is determined.

The measurement can be performed by using as a measuring apparatus a full automatic multifunctional mercury porosimeter, PoreMaster series/PoreMaster-GT series, manufactured by Yuasa-Ionics Company, Ltd., or an automatic porosimeter, Autopore IV9500 series, manufactured by Shimadzu Corporation, etc.

Specifically, measurement was performed with Autopore IV9520 manufactured by Shimadzu Corporation under the following condition/procedure.

Measurement Conditions

| Measurement environment | 20° C. |
|---|---|

Measurement cell Sample volume 5 $cm^3$, Intrusion volume 1.1 $cm^3$, for use in powder Measuring range 2.0 psia (13.8 kPa) or more and 59989.6 psia (413.7 Mpa) or less

| Measurement step | 80 steps |
|---|---|

(Steps are set so that the intervals may be the same when the pore size is plotted as a logarithm)

Intrusion volume adjusted so that the intrusion volume may be 25% or more and 70% or less Low Pressure Parameter

| | |
|---|---|
| Evacuation pressure | 50 μmHg |
| Evacuation time | 5.0 min |
| Mercury intrusion pressure | 2.0 psia (13.8 kPa) |
| Equilibrium time | 5 secs |

High Pressure Parameter

| | |
|---|---|
| Equilibrium time | 5 secs |
| Mercury parameter Advancing contact angle | 130.0 degrees |
| Receding contact angle | 130.0 degrees |
| Surface tension | 485.0 mN/m (485.0 dynes/cm) |
| Density of mercury | 13.5335 g/mL |

Measurement Procedure (1) About 1.0 g of porous magnetic core is weighed and put into a sample cell.

Input the weighed values.

(2) Perform measurement in a range of 2.0 psia (13.8 kPa) or more and 45.8 psia (315.6 kPa) or less in a low pressure part.

(3) Perform measurement in a range of 45.9 psia (316.3 kPa) or more and 59989.6 psia (413.6 Mpa) or less in a high pressure part.

(4) Determine the pore size distribution by calculation from the mercury intrusion pressure and the volume of intruded mercury.

The steps of (2), (3) and (4) were automatically performed by the software attached to the apparatus.

The pore size distribution measured as above is shown in FIG. 15A and FIG. 15B. The whole measured area is shown in FIG. 15A and the area cut in the range of 0.1 μm or more and 10.0 μm or less is shown in FIG. 15B. The pore size at which the differential pore volume is maximal in the range of 0.1 μm or more and 3.0 μm or less (shown by a dotted line) is read from FIG. 15B and is defined as the pore size corresponding to the maximal differential pore volume.

The total pore volume in the range of 0.1 μm or more and 3.0 μm or less was calculated by using the attached software.

<Method for Measurement of 50% Particle Size (D50) Based on Volume Distribution of Magnetic Carrier and Porous Magnetic Core>

The particle size distribution was measured with a particle size distribution measuring apparatus according to a laser diffraction/dispersion method "MICROTRAC MT3300EX" (manufactured by Nikkiso Co., Ltd.). A sample feeding unit for dry process measurement "one-shot dry type sample conditioner TURBOTRAC" (manufactured by Nikkiso Co., Ltd.) was attached to the apparatus to make a measurement. As the supply condition of TURBOTRAC, a dust collector was used as a vacuum source, and the air flow rate was set to about 33 liters/sec, and the pressure was set to about 17 kPa. The control is automatically performed by the software. 50% particle size (D50) which is an accumulated value based on volume is determined. The control and the analysis are performed with the attached software (version 10.3.3-202D).

The measurement conditions are as follows.

SetZero time: 10 seconds

Measurement time: 10 seconds

Number of measurement times: once

Particle refraction index: 1.81

Particle form: non-spherical

Upper limit of measurement: 1,408 μm

Lower limit of measurement: 0.243 μm

Measurement environment: Normal temperature and normal humidity environment (23° C. 50% RH)

<Method for Measurement of 50% Particle Size (D50) and 90% Particle Size (D90) Based on Volume Distribution of Finely Pulverized Product of Calcined Ferrite>

A particle size distribution measurement apparatus "Microtrac MT3300EX" according to a laser diffraction/the dispersion method (manufactured by Nikkiso Co., Ltd.) is used for the measurement of 50% particle size (D50) and 90% particle size (D90) based on volume distribution of calcined ferrite (ferrite slurry). A sample circulating unit for wet process measurement "Sample Delivery Control" (SDC) (manufactured by Nikkiso Co., Ltd.) was attached to the apparatus and the measurement was performed. Ion-exchange water was circulated and dropped to the sample circulating unit so that the ferrite slurry reached a measurement concentration. The flow rate was set to 70%, the supersonic wave output was set to 40 W, and the supersonic wave time was set to 60 seconds. The control and calculation of D50 and D90 are automatically performed by the software under the following conditions. 50% particle size (D50) and 90% particle size (D90) which are accumulated values based on volume are determined. The measurement conditions are as follows.

SetZero time: 10 seconds

Measurement time: 30 seconds

Number of measurement times: 10 times

Solvent refraction index: 1.33

Particle refraction index: 2.42

Particle form: non-spherical

Upper limit of measurement: 1,408 μm

Lower limit of measurement: 0.243 μm

Measurement environment: Normal temperature and normal humidity environment (23° C. 50% RH)

<Method for Measurement of Intensity of Magnetization of Magnetic Carrier and Porous Magnetic Core>

The intensity of magnetization of the magnetic carrier and the porous magnetic core can be determined with a vibrating magnetic field type magnetic characteristics measuring apparatus (Vibrating sample magnetometer) or a direct current magnetization characteristics recording apparatus (B-H tracer). In the working examples described later, measurement is performed with a vibrating magnetic field type magnetic characteristics measuring apparatus BHV-30 (manufactured by Riken Denshi Co., Ltd.).

A cylindrical plastics container sufficiently closely filled with a magnetic carrier or porous magnetic core is used as a sample. The actual mass of the sample filled into the container is measured. Then, the sample in the plastics container is adhered and fixed to each other with an instant adhesive.

The external magnetic field axis and the magnetization moment axis at 5,000/4π (kA/m) are calibrated using a standard sample.

The intensity of magnetization was measured from the loop of the magnetization moment when the sweep rate was set to 5 min/loop and an external magnetic field of 1,000/4π (kA/m) was applied. The results are divided by the sample weight to determine the intensity of magnetization ($Am^2/kg$) of the magnetic carrier and the porous magnetic core.

<Method for Measurement of True Density of Magnetic Carrier and Porous Magnetic Core>

The true specific gravity of the magnetic carrier and the porous magnetic core are measured with a dry process automatic densimeter Accupyc 1330 (manufactured by Shimadzu Corporation). At first, 5 g of the sample left standing under the environment of 23° C. 50% RH for 24 hours is accurately weighed and put into a cell (10 $cm^3$) for measurement and the cell is inserted into the sample chamber of the main body. The measurement can be automatically performed by inputting the sample weight to the main body and starting the measurement.

Referring to the measurement condition of the automatic measurement, the sample chamber is purged 10 times with helium gas adjusted to 20.000 psig ($2.392\times10^2$ kPa), and assuming that a state in which the change of the pressure in the sample chamber reaches 0.005 psig/min ($3.447\times10^{-2}$ kPa/min) is the equilibrium state, purge with helium gas is repeated till the equilibrium state is attained. The pressure of the sample chamber of the main body at the time of the equilibrium state is measured. The sample volume can be calculated from the change of pressure at the time of reaching the equilibrium. (Boyle's law)

Since the sample volume can be calculated, the true specific gravity of the sample can be calculated in the following expressions.

True specific gravity of the sample ($g/cm^3$)=sample weight (g)/sample volume ($cm^3$)

The average of the values when this measurement is repeated 5 times by the automatic measurement is defined as the true specific gravity ($g/cm^3$) of the magnetic carrier and the porous magnetic core.

<Method for Measurement of Weight Average Particle Size (D4) of Toner and Toner Particle>

The weight average particle size (D4) of toner and toner particles was measured with a precise particle size distribution analyzer, "COULTER COUNTER MULTISIZER 3" (registered trade mark, manufactured by Beckman Coulter, Inc.) provided with an aperture tube of 100 μm according to a pore electric resistance method and an attached software "BECKMAN COULTER MULTISIZER 3 Version 3.51" (manufactured by Beckman Coulter Inc.) exclusive to setting the measurement condition and analyzing the measured data with the number of effective measurement channels of 25,000, and the measurement data were analyzed to calculate the value of D4.

As an aqueous electrolyte solution for use in the measurement, a solution obtained by dissolving special grade sodium chloride in ion-exchange water so that the concentration may be about 1 mass %, for example, "ISOTON II" (manufactured by Beckman Coulter Inc.) can be used.

The exclusive software was set as follows before measurement and analysis.

The total number of counts of the control mode is set to 50,000 particles, and the number of measurement times is set to one and the Kd value is set to the value obtained by using "Standard Particle 10.0 μm" (manufactured by Beckman Coulter Inc.) on "the screen for changing standard measurement method (SOM)" of the exclusive software. The threshold and noise level are set automatically by pushing the measurement of threshold/noise level button. The current is set to 1600 μA, the gain is set to 2, the electrolyte is set to ISOTON II and flash of the aperture tube after the measurement is checked.

The bin interval is set to a logarithm particle size, the particle size bin is set to a 256 particle size bin, and the particle size range is set to the particle size range of 2 μm or more and 60 μm or less on "the screen of setting the conversion from pulse to particle size" of the exclusive software.

The specific measurement method is as follows.

(1) About 200 ml of the above aqueous electrolyte solution is put in a 250 ml round bottom beaker made of glass for exclusive use in Multisizer 3 and the beaker is set in the sample stand. Stirring with a stirrer rod is performed counterclockwise at a rate of 24 rounds per second. Dirt and air bubbles in the aperture tube are removed beforehand by function of "flashing of the aperture" of the analysis software.

(2) About 30 ml of the above aqueous electrolyte solution is put in a 100 ml flat bottom beaker made of glass. To this, about 0.3 ml of a diluted liquid obtained by diluting 3 times by mass "Contaminon N" (10 mass % aqueous solution of neutral detergent for cleaning precise measuring instruments, including a nonionic surfactant, an anionic surfactant and an organic builder, manufactured by Wako Pure Chemical Industries, Ltd., pH 7) with ion-exchange water is added as a dispersing agent.

(3) A predetermined amount of ion-exchange water is put in a water tank of a supersonic wave disperser "Ultrasonic Dispension System Tetora 150" (manufactured by Nikkaki Bios Co., Ltd.) having two built-in oscillators of an oscillation frequency of 50 kHz whose phase is shifted by 180 degrees and an electric output of 120 W. About 2 ml of the above Contaminon N is added to this water tank.

(4) The beaker in the above (2) is set into a hole for fixing a beaker of the above supersonic wave disperser and the supersonic wave disperser is operated. The height of beaker position is adjusted so that the resonance state of the liquid surface of the aqueous electrolyte solution in the beaker becomes maximum.

(5) About 10 mg of the toner is added little by little to the above aqueous electrolyte solution while a supersonic wave is applied to the aqueous electrolyte solution in the above beaker (4) to disperse the toner. The supersonic wave dispersion treatment is continued for further 60 seconds. In this case, the water temperature of the water tank is appropriately adjusted so as to fall within the range of 10° C. or more and 40° C. or less during the supersonic wave dispersion treatment.

(6) The above electrolyte aqueous solution (5) in which the toner is dispersed is dropwise added with a pipette to the above round bottom beaker (1) set in the sample stand so that the measured concentration may be about 5%. Then, measurement is performed till the number of measured particles amounts to 50,000.

(7) The measurement data are analyzed by the above exclusive software attached to the apparatus and the weight average particle size (D4) is calculated. The "average diameter" on the screen of the analysis/volume statistics (arithmetical average) when the setting to graph/volume % is performed in the exclusive software ("BECKMAN COULTER MULTISIZER 3 Version 3.51") is the weight average particle size (D4).

<Method for Measurement of Average Circularity of Toner and Toner Particle>

The average circularity of the toner and toner particles are measured with a flow-type particle image analyzer "FPIA-3000" (manufactured by Sysmex Corporation) under the condition for measurement and analysis at the time of calibration.

The measurement principle of the flow-type particle image analyzer "FPIA-3000" (manufactured by Sysmex Corporation) is to photograph still images of flowing particles, which is subjected to image analysis. The sample added to the sample chamber is sent into flat sheath flow cells by a sample suction syringe. The sample sent into the flat sheath flow cells forms a flat flow sandwiched between the sheath liquids. The sample passing through the flat sheath flow cell is irradiated with electronic flash light every 1/60 second, and flowing particles can be photographed as still images. In addition, pictures can be taken in focus since the flow is flat. The particle image is photographed with a CCD camera and subjected to image processing at 512×512 image processing resolution (0.37 μm×0.37 μm per pixel), where the outline of each particle image is extracted, and the projected area S and peripheral length L of the particle image are measured.

Then, the circle-equivalent diameter and the circularity are determined using the area S and peripheral length L mentioned above. The circle-equivalent diameter is the diameter of a circle having the same area as the projected area of the particle image, and the circularity is defined as the value obtained by dividing the peripheral length of the circle determined from the circle-equivalent diameter by the peripheral length of the projected particle image, and can be calculated by the following expression.

$$\text{Circularity}=2\times(\pi\times S)^{1/2}/L$$

When the particle image is circular, the circularity becomes 1, and as the degree of peripheral unevenness of the particle image increases, the circularity becomes small. After the circularity of each particle is calculated, the circularity range of 0.200 to 1.000 is divided into 800 regions, and the arithmetic average value of the obtained circularity is calculated, which is defined as the average circularity.

A specific method for measurement is as follows. At first, about 20 ml of ion-exchange water from which impure solids are removed beforehand is put in a glass vessel. To this, about 0.2 ml of a diluted liquid obtained by diluting 3 times by mass "Contaminon N" (10 mass % aqueous solution of neutral detergent for cleaning precise measuring instruments, including a nonionic surfactant, an anionic surfactant and an organic builder, manufactured by Wako Pure Chemical Industries, Ltd., pH 7) with ion-exchange water is added as a dispersing agent. About 0.02 g of the sample to be measured is further added and subjected to dispersing treatment with a supersonic wave disperser for 2 minutes to prepare a dispersion liquid for measurement. In this case, the temperature of the dispersion liquid is appropriately cooled so as to fall within the range of 10° C. or more and 40° C. or less during the above treatment. As a supersonic wave disperser, a desktop type supersonic cleaner distributor having an oscillation frequency of 50 kHz and an electric output of 150 W (for example, "VS-150" (manufactured by Velvo-clear Company)) is used. A predetermined amount of ion-exchange water is put in the water tank and about 2 ml of the above Contaminon N is added to this water tank.

The above flow-type particle image analyzer equipped with a standard objective lens (10 magnifications) was used for measurement, and the particle sheath "PSE-900A" (manufactured by Sysmex Corporation) was used for a sheath liquid. The dispersion liquid prepared according to the above procedure is introduced into the above flow type particle image analyzer and 3,000 toner particles are measured in an HPF measurement mode and in a total count mode. The binarized threshold at the time of particle analysis is set to 85% and the analyzed particles are limited to those having a circle-equivalent diameter of 1.985 μm or more and less than 39.69 μm, and the average circularity of the toner particles is determined.

Prior to the measurement, automatic focus adjustment is performed using standard latex particles (for example, "RESEARCH AND TEST PARTICLES Latex Microsphere Suspensions 5200A" manufactured by Duke Scientific company is diluted with ion-exchange water) for the measurement. Focus adjustment is preferably carried out every two hours from the beginning of measurement.

In the Examples, a flow type particle image analyzer provided with a calibration certificate issued by Sysmex Corporation for which calibration has been performed by Sysmex Corporation was used. Measurement was performed under the same measurement and analysis condition provided with a calibration certificate except that the analyzed particles were limited to those having a circle-equivalent diameter of 1.985 μm or more and less than 39.69 μm.

<Peak Temperature of Maximum Endothermic Peak of Wax, and Glass Transition Temperature Tg of Binder Resin>

The maximum endothermic peak temperature of wax is measured in compliance with ASTM D 3418-82 by using a differential scanning calorimetry analyzer "Q1000" (manufactured by TA Instruments, Japan).

The melting points of indium and zinc are used for the temperature correction of the apparatus detector and heat of fusion of indium is used for the correction of calorie.

Specifically, about 10 mg of wax is precisely weighed and placed in an aluminum pan, and measurement is performed in the measurement temperature range of 30° C. to 200° C. at a heating rate of 10° C./min; an empty aluminum pan is used as reference. In the measurement, the temperature is once elevated to 200° C. and then lowered to 30° C. and then elevated again. The largest endothermic peak of the DSC curve in the range of temperature of 30 to 200° C. in this second heating process is defined as the maximum endothermic peak of wax in the present invention.

The glass transition temperature (Tg) of the binder resin is measured after about 10 mg of the binder resin is precisely weighed as in the measurement for wax. Then, a specific heat change is obtained in the temperature range of 40° C. to 100° C. The intersection point of the middle line between the baselines before and after the specific heat change appears and the differential thermal curve is defined as the glass transition temperature Tg of the binder resin.

<Measurement of Particle Size in the Number-Based Distribution of Inorganic Particles>

The particle size in the number-based distribution of inorganic particles was measured in the following procedure.

The toner is subjected to the measurement using a scanning electron microscope S-4800 (manufactured by Hitachi, Ltd.) at an accelerating voltage of 2.0 kV in a non-vapor deposition condition. The reflection electron image is observed at 50,000 magnifications. Since the emission amount of reflected electrons depends on the atomic number of the material constituting the sample, contrast is caused between inorganic particles and an organic material such as the matrix substance of toner particles. Particles of more highlighted (whiter) ingredients as compared with the matrix substance of the toner particles can be acknowledged as inorganic particles. Then, 500 fine particles having a particle size of 5 nm or more are extracted at random. The major axis and the minor axis of each of the extracted particles are measured by digitizer and the average value of the major axis and the minor axis is defined as the particle size of the fine particles. A histogram is depicted for the particle size distribution of the extracted 500 particles using the central value of columns, where a histogram is used in which the column width is divided every 10 nm such as 5-15 nm, 15-25 nm, 25-35 nm, . . . . It is determined from the histogram whether the maximum value of the particle size exists in the range of 80 nm or more and 200 nm or less. In the histogram, the particle size which becomes maximum may be singular or plural, and the peak in the range of 80 nm or more and 200 nm or less may or may not be the largest value.

<Method for Measurement of Hydrophobicity of Inorganic Particles>

At first, 70 ml of a methanol-containing aqueous solution including 50 volume % of methanol and 50 volume % of water is put in a glass cylinder vessel having a diameter of 5 cm and a thickness of 1.75 mm, and a supersonic wave is applied with a supersonic wave disperser for 5 minutes to remove air bubbles.

Subsequently, 0.06 g of the sample is precisely weighed and added into the vessel which contains the above methanol-containing aqueous solution to prepare a sample liquid for measurement.

The sample liquid for measurement is set in a powder wettability testing machine "WET-100P" (manufactured by Rhesca Corporation). This sample liquid for measurement is stirred at a speed of 6.7 $s^{-1}$ (400 rpm) with a magnetic stirrer. Here, a spindle-shaped rotor coated with a fluorine resin having a length of 25 mm and a maximum trunk diameter of 8 mm is used as a rotor of the magnetic stirrer.

While methanol is continuously added to this sample liquid for measurement through the apparatus mentioned above at a dripping rate of 1.3 ml/min, the transmission of light having a wavelength of 780 nm is measured to prepare a methanol dripping transmission curve. The 50% transmission value of the obtained methanol dripping transmission curve is defined as the hydrophobicity.

<Measurement Method of Frictional Charge Amount of Toner by Two-Component Method>

The humidity of the magnetic carrier and the toner are conditioned in a normal temperature and normal humidity environment (temperature: 23° C., humidity: 50% RH) for 24 hours. 8 parts by mass (for example, 0.8 kg) of the toner is weighed with respect to 92 parts by mass (for example, 9.2 kg) of the magnetic carrier. They are shaken at 0.63 $S^{-1}$ (38 rpm) in a 10-liter V mixer for 10 minutes. The absolute value of the charge amount after mixed for 10 minutes is defined as the initial frictional charge amount. In the Examples, as for the developer subjected to a durability test with an image forming apparatus, image formation is repeated till the toner concentration reaches 8 mass % by using the image forming apparatus. In that case, when the toner concentration is to be increased, the toner amount to be supplied is made to be 1.01 times the consumed toner amount in a printing ratio of 1%. When the toner concentration is to be decreased, no toner is supplied in a printing ratio of 20%. The two-component developer is taken out from the developing container and is measured to determine the frictional charge amount after the durability test.

As an apparatus for measuring the frictional charge amount, a suction separation type charge amount measuring instrument Sepasoft STC-1-C1 model (manufactured by Sankyo Pio-Tech. Co., Ltd.) was used. A mesh (wire netting) having an opening size of 20 μm is placed on the bottom of a sample holder (Faraday gauge), 0.10 g of the developer is placed thereon, and the lid is closed. The total mass of the sample holder at this time is weighed and represented by W1 (kg). Then, the sample holder is installed in the main body of the apparatus and the suction pressure is set to 2 kPa by adjusting the air flow volume control valve. In this state, the toner is removed by 2-minute suction. The amount of electric charge at this time is represented by Q (mC). The total mass of the sample holder after the suction is weighed and represented by W2 (kg). Because Q determined at this time is measured as the electric charge of the carrier, the frictional charge amount of the toner is in reverse polarity. The absolute value of the frictional charge amount of this developer (mC/kg) is calculated according to the following expression. In addition, the measurement was carried out also in a normal temperature and normal humidity environment (23° C., 50% RH).

$$\text{Frictional charge amount (mC/kg)} = Q/(W1 - W2) \quad \text{(Expression)}$$

<Measurement Method of Laid-On Amount of Toner>

The laid-on toner amount can be calculated by suction collection of the toner on a transfer material by using a metal cylinder pipe and a cylinder filter.

Figure 11:
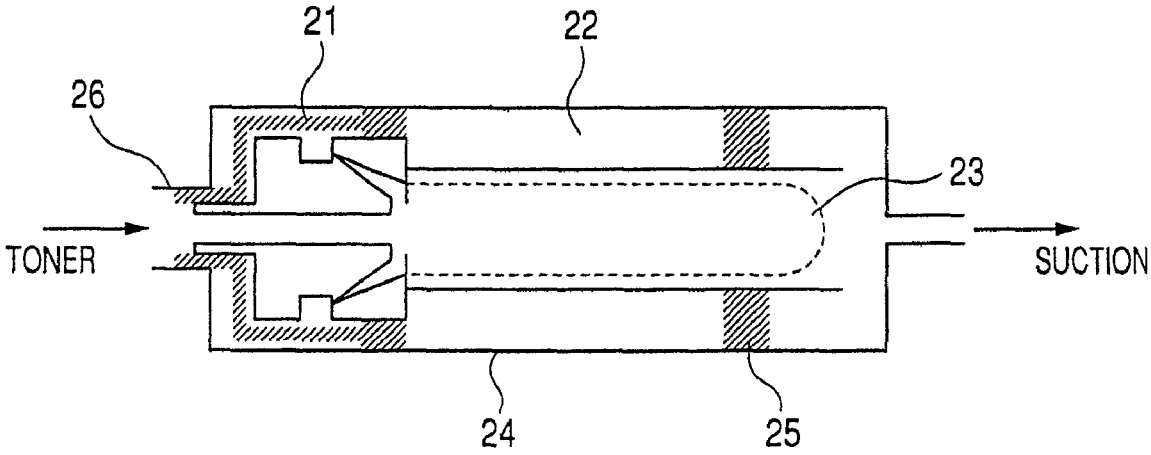
FIG. 11 is a schematic view illustrating an apparatus measuring the amount of laid-on toner on a transfer material.

Specifically, FIG. 11 illustrates an apparatus for measuring the laid-on toner amount and the toner charge amount on a transfer material. The laid-on toner amount and the frictional charge amount of the toner on a transfer material can be measured, for example, with a Faraday-Cage shown in FIG. 11. The Faraday-Cage refers to a coaxial double cylinder in which the inner cylinder 22 and the outer cylinder 24 are insulated with insulating members 21 and 25. When a charged body having an electric charge amount Q is placed in the inner cylinder 22, it becomes the same as the state in which there is a metal cylinder having an electric charge amount Q due to electrostatic induction. Actually, a suction opening 26 is placed on a transfer material and the toner on the transfer material is suctioned with a suction machine (not illustrated) and the suctioned toner is collected by a cylinder filter paper (cylinder filter) 23 placed in the inside of the inner cylinder 22. The amount of this induced electric charge is measured with an electrometer (Keithley 6517A manufactured by Keithley Instruments Inc.) (not illustrated) and the value (Q/M) obtained by dividing the electric charge amount Q (mC) by the mass of toner M (kg) in the inner cylinder 22 is defined as the charge amount. In addition, the suctioned area A is also measured, and the value obtained by dividing the mass of toner M by the suctioned area S ($cm^2$) is defined as the laid-on toner amount per unit area. After outputting an image with the toner, the toner is taken out from the machine in a state before passing through the fixing unit, and the toner is taken into a filter by air suction in a unfixed state directly from a transfer material.

$$\text{Laid-on toner amount (mg/cm}^2) = M/S$$

$$\text{Frictional charge amount of toner (mC/kg)} = Q/M$$

EXAMPLES

The present invention will be more specifically described with reference to Examples as follows.

Production Example 1 of Porous Magnetic Core

Step 1 (Weighing/Mixing Step)

| | |
|---|---|
| $Fe_2O_3$ | 68.3 mass % |
| $MnCO_3$ | 28.5 mass % |
| $Mg(OH)_2$ | 2.0 mass % |
| $SrCO_3$ | 1.2 mass % |

The above ferrite raw materials were weighed and 20 parts by mass of water was added to 80 parts by mass of the ferrite raw materials and then wet mixed in a ball mill with zirconia of diameter (ϕ) 10 mm for 3 hours to prepare a slurry. The concentration of the solid content of the slurry was 80 mass %.

Step 2 (Calcining Step)

After the mixed slurry was dried with a spray dryer (manufactured by Ohkawara Kakohki Co., Ltd.), the slurry was calcined at a temperature of 950° C. in the atmosphere for two hours to prepare a calcined ferrite.

Step 3 (Crushing Step)

After the calcined ferrite was pulverized in a crusher to around 0.5 mm, water was added thereto to prepare a slurry. The solid content of the slurry was 80 mass %. The resultant mixture was pulverized in a wet process beads mill with zirconia of ϕ1 mm for 3 hours to obtain a slurry which contained a first pulverized powder. As for the obtained first pulverized powder, D50 was 2.4 μm and D90 was 4.3 μm. Half of the amount of the slurry of the first pulverized powder was taken out and the slurry of the first pulverized powder was further crushed for 2 hours to prepare a slurry of a second pulverized powder. As for the obtained second pulverized powder, D50 was 0.9 μm and D90 was 1.9 μm. The slurry of the first pulverized powder and the slurry of the second pulverized powder were mixed together to obtain a ferrite slurry. As a result of measuring D50 and D90 of the calcined ferrite in the slurry, they were 1.3 μm and 4.0 μm, respectively.

Step 4 (Granulating Step)

Polyvinyl alcohol was added to the above ferrite slurry in a ratio of 2.0 parts by mass based on 100 parts by mass of the calcined ferrite and water was further added thereto to adjust the solid content of the slurry to 70 mass % and then granulated to spherical particles with a spray dryer (manufactured by Ohkawara Kakohki Co., Ltd.).

Step 5 (Burning Step)

The particles were burnt in an electric furnace from room temperature to the burning temperature for 5 hours and at a temperature of 1,050° C. for 4 hours in a nitrogen atmosphere (oxygen concentration: 0.01 volume % or less). Then the temperature was allowed to decrease to 80° C. over 8 hours and the atmosphere was changed back from the nitrogen atmosphere to the atmosphere and the product was taken out at a temperature of 40° C. or less.

Step 6 (Sorting Step)

Figure 16:
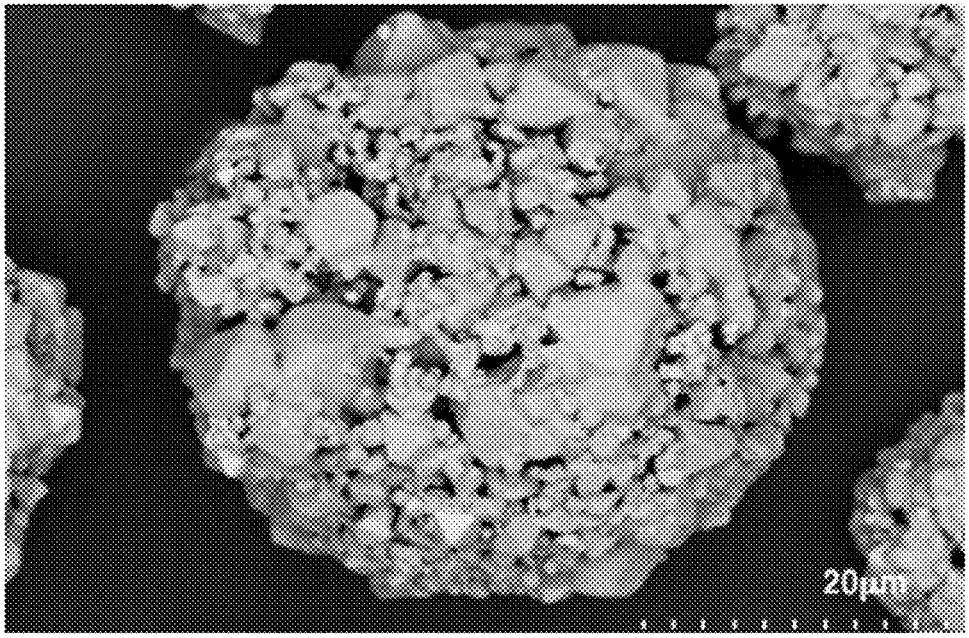
FIG. 16 shows an example of the scanning electron microscope photograph of the porous magnetic core 1 used in Example 1.

After the aggregated particles were disintegrated, they were sieved with a sieve having an opening size of 75 μm to remove coarse particles. Fine particles were removed by further performing air flow classification to obtain porous magnetic core 1. The porous magnetic core particles of the obtained porous magnetic core 1 were porous and had pores. The measurement results of the resistivity of the obtained porous magnetic core are shown in Table 2B. Other physical properties are also shown in Table 2B. In addition, the scanning electron microscope (SEM) photograph of this porous magnetic core is shown in FIG. 16.

Production Example 2 to Production Example 4 of Porous Magnetic Core

Porous magnetic cores 2 to 4 were prepared in the same way as in Production Example 1 of a porous magnetic core except that production conditions were changed as shown in Table 2A. The physical properties of the obtained porous magnetic cores 2 to 4 are shown in Table 2B.

Production Example 5 of Magnetic Core

Magnetic core 5 was prepared in the same way as in Production Example 1 of a porous magnetic core except that production conditions were changed as shown in Table 2A. The crush time in the wet process beads mill in Step 3 was changed to 5 hours and the slurry was not taken out on the way. The physical properties of the obtained magnetic core 5 are shown in Table 2B.

Production Example 6 of Porous Magnetic Core

Porous magnetic core 6 was prepared in the same way as in Production Example 1 of a porous magnetic core except that production conditions were changed as shown in Table 2A. The crush time in the wet process beads mill in Step 3 was changed to 4 hours and the slurry was not taken out on the way. The physical properties of the obtained porous magnetic core 6 are shown in Table 2B.

Production Example 7 of Magnetic Core

Magnetic core 7 was prepared in the same way as in Production Example 1 of a porous magnetic core except that production conditions were changed as shown in Table 2A. The crush time in the wet process beads mill in Step 3 was changed to 5 hours. Half of the amount of the slurry was not taken out on the way.

The obtained magnetic core particles were sintered body having a smooth surface. The physical properties of the obtained magnetic core 7 are shown in Table 2B.

Production Example 8 of Magnetic Core

| Magnetite fine particles (number average particle diameter: 0.3 μm) and 4.0 mass % of a silane coupling agent (3-(2-aminoethylaminopropyl)trimethoxysilane) were added to a vessel, and the mixture was stirred at high speed at 100° C. or more in the vessel to perform surface treatment of the fine particles. 4.0 mass % of a silane coupling agent (3-(2-aminoethylaminopropyl)trimethoxysilane) was added to hematite fine particles (number average particle diameter: 0.6 μm) and, and the mixture was stirred at high speed at 100° C. or more in the vessel to perform surface treatment of the fine particles. | |
|---|---|
| Phenol | 10 parts by mass |
| A formaldehyde solution (37 mass % aqueous formaldehyde) | 6 parts by mass |
| Magnetite fine particles treated as above | 59 parts by mass |
| Hematite fine particles treated as above | 25 parts by mass |

The above materials and 5 parts by mass of a 28 mass % ammonium aqueous solution, 10 parts by mass of water were placed into a flask, and the resultant mixture was heated to a temperature of 85° C. over 30 minutes while mixed and stirred, and the resultant mixture was kept at the temperature and polymerized for 3 hours to synthesize a phenolic resin and then prepare particles thereof. Then the polymerization liquid was cooled to a temperature of 30° C., and water was further added thereto. After that, the supernatant liquid was removed and the precipitate was washed with water and then air dried. Subsequently, the obtained particles were dried at a temperature of 60° C. under reduced pressure (in specific numerical values) to obtain magnetic core (magnetic fine particles dispersion type resin core) 8 in which magnetite fine particles and hematite fine particles which both had magnetism were dispersed.

As a result of measuring the resistivity of the obtained magnetic core 8, there was no electric field intensity just before break-down (the core caused no break-down). The resistivity at an electric field intensity of 300 V/cm was $2.6\times10^{12}$ (Ω·cm). In addition, the 50% particle size (D50) was 35.4 μm based on volume. The intensity of magnetization at 1,000/4π (kA/m) was 41 $Am^2/kg$. In addition, the true specific gravity was 3.50 $g/cm^3$.

The physical properties of the obtained magnetic core 8 are shown in Table 2B.

Production Example 9 of Porous Magnetic Core

Porous magnetic core 9 was prepared in the same way as in Production Example 1 of a porous magnetic core except that production conditions were changed as shown in Table 2A. Pulverization was performed for 1 hour in a wet process ball mill using ⅛-inch-diameter stainless beads instead of the beads mill of Step 3 and pulverization was further performed for 4 hours using 1/16-inch-diameter stainless beads. Half of the amount of the slurry was not taken out on the way. The physical properties of the obtained porous magnetic core 9 are shown in Table 2B.

TABLE 2A

| | Composition of raw materials (mass %) | | | | | | Calcination | | Pulverization | | | | | |
|---|---|---|---|---|---|---|---|---|---|---|---|---|---|---|
| | | | | | | | | | Ball mill | | Beads mill (1) | | | |
| | $Fe_2O_3$ | $MnCO_3$ | $Mg(OH)_2$ | $SrCO_3$ | CuO | ZnO | Temperature (° C.) | Time (h) | Media | Time (h) | Media | Time (h) | D50 (μm) | D90 (μm) |
| Porous magnetic core 1 | 68.3 | 28.5 | 2.0 | 1.2 | — | — | 950 | 2 | — | — | 1 mmφ Zirconia | 3 | 2.4 | 4.3 |
| Porous magnetic core 2 | 68.3 | 28.5 | 2.0 | 1.2 | — | — | 950 | 2 | — | — | 1 mmφ Zirconia | 4 | 2 | 3.8 |
| Porous magnetic core 3 | 68.3 | 28.5 | 2.0 | 1.2 | — | — | 950 | 2 | — | — | 1 mmφ Zirconia | 3 | 2.4 | 4.2 |
| Porous magnetic core 4 | 69.7 | 29.3 | 1.0 | — | — | — | 950 | 2 | — | — | 1 mmφ Zirconia | 4.5 | 1.8 | 3.3 |
| Magnetic core 5 | 68.3 | 28.5 | 2.0 | 1.2 | — | — | 950 | 2 | — | — | 1 mmφ Zirconia | 5 | 2.1 | 3.7 |
| Porous magnetic core 6 | 71.4 | 25.1 | 2.7 | 0.7 | — | — | 950 | 2 | — | — | 1 mmφ Zirconia | 4 | 2.3 | 3.9 |
| Magnetic core 7 | 70.8 | — | — | — | 12.8 | 16.4 | 950 | 2 | — | — | 1 mmφ Zirconia | 5 | 2.0 | 3.8 |
| Porous magnetic core 9 | 61.8 | 31.1 | 6.5 | 0.6 | — | — | 950 | 2 | ⅛ inchφ Stainless | 1 | 1/16 inchφ Stainless | 4 | 1.0 | 1.3 |

| | Pulverization | | | | | | Granulation | | | Calcination | | |
|---|---|---|---|---|---|---|---|---|---|---|---|---|
| | Beads mill (2) | | | | Particle size of calcined ferrite | | PVA Amount | $Na_2CO_3$ Amount | | | | |
| | Media | Time (h) | D50 (μm) | D90 (μm) | D50 (μm) | D90 (μm) | (mass part) | (mass part) | Solid content (mass %) | Oxygen concentration (volume %) | Calcination Temp. (° C.) | Time (h) |
| Porous magnetic core 1 | 1 mmφ Zirconia | 2 | 0.9 | 1.9 | 1.3 | 4.0 | 2.0 | — | 70 | 0.01 or less | 1050 | 4 |
| Porous magnetic core 2 | 1 mmφ Zirconia | 2 | 0.8 | 1.7 | 1.2 | 3.4 | 0.7 | — | 70 | 0.01 or less | 1150 | 4 |
| Porous magnetic core 3 | 1 mmφ Zirconia | 4 | 0.6 | 1.3 | 1.2 | 4.3 | 2.0 | 0.5 | 70 | 0.2 | 1100 | 4 |
| Porous magnetic core 4 | 1 mmφ Zirconia | 3 | 0.6 | 1.1 | 1.0 | 1.8 | 0.5 | — | 70 | 0.01 or less | 1200 | 4 |
| Magnetic core 5 | — | — | — | — | 2.1 | 3.7 | 0.5 | — | 75 | 0.01 or less | 1350 | 4 |
| Porous magnetic core 6 | — | — | — | — | 2.3 | 3.9 | 0.5 | — | 70 | 1.0 | 1100 | 4 |
| Magnetic core 7 | — | — | — | — | 2.0 | 3.8 | 0.5 | — | 75 | 21 | 1300 | 4 |
| Porous magnetic core 9 | — | — | — | — | 1.0 | 1.3 | 1.0 | — | 70 | 0 | 1100 | 4 |

TABLE 2B

| | Composition | Type of core | D50 (μm) | Electric field intensity just before break-down (V/cm) | Intensity of magnet-ization ($Am^2/kg$) | True specific gravity ($g/cm^3$) | Resis-tivity at 300 V/cm (Ω · cm) | Peak pore size from 0.1 to 3.0 μm (μm) | Total pore volume from 0.1 to 3.0 μm (ml/g) |
|---|---|---|---|---|---|---|---|---|---|
| Porous magnetic core 1 | $(MnO)_{0.345}(MgO)_{0.048}(SrO)_{0.011}(Fe_2O_3)_{0.596}$ | Porous | 34.8 | 576 | 59 | 4.84 | $7.1 \times 10^6$ | 1.1 | 0.104 |
| Porous magnetic core 2 | $(MnO)_{0.345}(MgO)_{0.048}(SrO)_{0.011}(Fe_2O_3)_{0.596}$ | Porous | 37.2 | 610 | 59 | 4.85 | $6.7 \times 10^6$ | 1.0 | 0.056 |
| Porous magnetic core 3 | $(MnO)_{0.345}(MgO)_{0.048}(SrO)_{0.011}(Fe_2O_3)_{0.596}$ | Porous | 34.9 | 1000 | 57 | 4.84 | $1.4 \times 10^7$ | 1.2 | 0.089 |
| Porous magnetic core 4 | $(MnO)_{0.360}(MgO)_{0.024}(Fe_2O_3)_{0.616}$ | Porous | 45.0 | 444 | 61 | 4.86 | $3.5 \times 10^6$ | 0.9 | 0.042 |
| Magnetic core particle 5 | $(MnO)_{0.345}(MgO)_{0.048}(SrO)_{0.011}(Fe_2O_3)_{0.596}$ | Aggregated | 33.9 | 563 | 59 | 4.85 | $4.3 \times 10^6$ | — | — |
| Porous magnetic core 6 | $(MnO)_{0.305}(MgO)_{0.064}(SrO)_{0.007}(Fe_2O_3)_{0.624}$ | Porous | 34.2 | 2770 | 55 | 4.85 | $7.0 \times 10^7$ | 0.7 | 0.040 |
| Magnetic core 7 | $(CuO)_{0.200}(ZnO)_{0.250}(Fe_2O_3)_{0.550}$ | Aggregated | 36.4 | Not break-down up to 10000 V/cm | 54 | 5.00 | $2.0 \times 10^8$ | — | — |
| Magnetic core 8 | Magnetite + hematite + resin | Magnetic material dispersed | 35.4 | Not break-down up to 10000 V/cm | 41 | 3.50 | $2.6 \times 10^{12}$ | — | — |
| Porous magnetic core 9 | $(MnO)_{0.350}(MgO)_{0.145}(SrO)_{0.005}(Fe_2O_3)_{0.500}$ | Porous | 34.2 | 5040 | 55 | 4.85 | $5.2 \times 10^7$ | 0.6 | 0.105 |

Production Example of Magnetic Carrier 1

| | |
|---|---|
| Silicone varnish (SR2410 manufactured by Dow Corning Toray Co., Ltd.) (Toluene solution having a solid content of 20 mass %) | 85.0 parts by mass |
| γ-aminopropyl triethoxysilane | 3.4 parts by mass |
| Toluene | 11.6 parts by mass |

The above materials were mixed together to obtain a resin solution 1.

100 parts by mass of porous magnetic core 1 was placed in a stirring vessel of a mixture stirrer (versatile stirrer NDMV type manufactured by Dalton Co., Ltd.) and nitrogen gas was introduced thereinto while decompressing the inside of the stirring vessel. Stirring was conducted by rotating the stirring blade at 100 rotations per minute while heating to a temperature of 50° C. Then, resin solution 1 was added to the stirring vessel, and porous magnetic core 1 and resin solution 1 were mixed together. The temperature was elevated to 70° C. and the mixture was continuously heated and stirred for 2 hours. The solvent was removed and a silicone resin composition having a silicone resin obtained from resin solution 1 was allowed to fill the core particles of porous magnetic core 1. After cooling, the obtained magnetic carrier particles were moved to a mixer (drum mixer type UD-AT manufactured by Sugiyama Heavy Industrial Co., Ltd.) having a spiral blade in a rotatable mixing vessel and heat-treated at a temperature of 160° C. in a nitrogen atmosphere for 2 hours while rotating the mixing vessel twice a minute to perform stirring. The obtained magnetic carrier particles were classified through a sieve having an opening size of 70 μm and a magnetic carrier with a resin filling ratio of 17.0 parts by mass based on 100 parts by mass of porous magnetic core 1.

Subsequently, 100 parts by mass of a magnetic carrier filled with a silicone resin composition was cast into a planetary mixer (NAUTA MIXER model VN manufactured by Hosokawa Micron Corporation). The screw-like stirring blade was revolved 3.5 times per minute and rotated 100 times per minute for stirring. A nitrogen flow was passed through at a flow rate of 0.1 $m^3$/min and the temperature was elevated to 70° C. to further remove toluene so that reduced pressure (about 0.01 MPa) could be attained. A resin solution (100 parts by mass of resin solution 1 +70 parts by mass of toluene) in which the solid content of resin solution 1 was diluted to 10 mass % with toluene was cast in ⅓ amount for the magnetic carrier and an operation for removing toluene and a coating operation were performed for 20 minutes. Subsequently, ⅓ amount of the resin solution was cast and an operation for removing toluene and a coating operation were further performed for 20 minutes and ⅓ amount of the resin solution was cast and an operation for removing toluene and a coating operation were further performed for 20 minutes. The coating amount was 1.5 parts by mass based on 100 parts by mass of the magnetic carrier. Then, the obtained magnetic carrier coated with a silicone resin was moved to a mixer (drum mixer type UD-AT manufactured by Sugiyama Heavy Industrial Co., Ltd.) having a spiral blade in a rotatable mixing vessel and heat-treated at a temperature of 160° C. in a nitrogen atmosphere for 2 hours while rotating the mixing vessel 10 times per minute to perform stirring. The partial exposure condition for the core particles on the surfaces of the magnetic carrier particles was controlled by stirring.

Almost no change in the resin coating amount occurred after this step.

The obtained magnetic carrier was classified with a sieve having an opening size of 70 μm to obtain a magnetic carrier 1.

The physical properties of the obtained magnetic carrier 1 are shown in Table 3.

Production Examples of Magnetic Carriers 2, 3 and 4

In the production example of magnetic carrier 1, resin solution 1 was added so that the resin ingredient filling 100 parts by mass each of porous magnetic core (for a magnetic carrier 2), porous magnetic core 3 (for a magnetic carrier 3), and porous magnetic core 4 (for a magnetic carrier 4) instead of porous magnetic core 1 was 8.0 parts by mass, 16.0 parts by mass, and 6.0 parts by mass, respectively, to obtain the magnetic carrier. Furthermore, 1.5 parts by mass, 2.0 parts by mass, and 1.0 part by mass of diluted resin solution 1 (100 parts by mass of resin solution 1+70 parts by mass of toluene) based on 100 parts by mass of the respective magnetic carriers were used to obtain magnetic carriers 2, 3 and 4 in the same way as in magnetic carrier 1.

The physical properties of the obtained magnetic carriers 2, 3 and 4 are shown in Table 3.

Production Example of Magnetic Carrier 5

100 parts by mass of porous magnetic core 1 is placed in an indirect heating type dryer (Solid Air SJ type manufactured by Hosokawa Micron Corporation), nitrogen gas is introduced at an air flow rate of 0.1 $m^3$/min and the paddle blade was rotated 100 times per minute to perform stirring while heating to a temperature of 70° C. Resin solution 1 was dropwise added until a resin filling amount of 18.0 parts by mass was attained. Heating and stirring were continued for 1 hour, and after toluene was removed, a silicone resin composition which had a silicone resin obtained from resin solution 1 was allowed to fill the core particles of porous magnetic core 1. After cooling, the obtained magnetic carrier particles were moved to a mixer (drum mixer type UD-AT manufactured by Sugiyama Heavy Industrial Co., Ltd.) having a spiral blade in a rotatable mixing vessel and heat-treated at a temperature of 160° C. in a nitrogen atmosphere for 2 hours while rotating the mixing vessel 10 times per minute to perform stirring. The partial exposure condition for the core particles on the surfaces of the magnetic carrier particles was controlled by stirring. The obtained magnetic carrier particles were classified with a sieve having an opening size of 70 μm to obtain magnetic carrier 5 having a resin filling amount of 18.0 parts by mass based on 100 parts by mass of porous magnetic core 1.

The physical properties of the obtained magnetic carrier 5 are shown in Table 3.

Production Example of Magnetic Carrier 6 (Comparative Example)

100 parts by mass of magnetic core 5 was cast into a planetary mixer (NAUTA MIXER model VN manufactured by Hosokawa Micron Corporation). The screw-like stirring blade was revolved 3.5 times per minute and rotated 100 times per minute for stirring. A nitrogen flow was passed through at a flow rate of 0.1 $m^3$/min and the temperature was elevated to 70° C. to further remove toluene so that reduced pressure (about 0.01 MPa) could be attained. Magnetic carrier 6 (Comparative Example) was obtained in the same way as in magnetic carrier 1 except that the coating amount was 1.0 part by mass and that the revolution number of the mixer having a spiral blade was 4 times per minute. The partial exposure condition for the core particles on the surfaces of the magnetic carrier particles was controlled by changing the stirring number of revolutions of the mixer having a spiral blade.

The physical properties of the obtained magnetic carrier 6 are shown in Table 3.

Production Example of Magnetic Carrier 7

| | |
|---|---|
| Polymethyl methacrylate polymer (Mw = 66,000) | 15.0 parts by mass |
| Toluene | 85.0 parts by mass |

The above materials were dissolved with a beads mill to obtain a resin solution 2.

A magnetic carrier filled with a polymethyl methacrylate resin was obtained in the same way as in the magnetic carrier 1 except that the filling amount of the resin composition of resin solution 2 was 15.0 parts by mass based on 100 parts by mass of porous magnetic core 1.

Silicone varnish (SR2410 manufactured by Dow Corning Toray Co., Ltd.) 85.0 parts by mass (Toluene Solution Having a Solid Content of 20 mass %)

| | |
|---|---|
| γ-aminopropyl triethoxysilane | 1.5 part by mass |
| Toluene | 13.5 parts by mass |

The above materials were mixed together to obtain resin solution 3.

Magnetic carrier 7 was obtained by coating in the same way as in magnetic carrier 1 except that the amount of the resin composition of resin solution 3 as a coating resin component was 1.5 parts by mass based on 100 parts by mass of the magnetic carrier filled with the polymethyl methacrylate resin.

The physical properties of the obtained magnetic carrier 7 are shown in Table 3.

Production Example of Magnetic Carrier 8

100 parts by mass of porous magnetic core 4 was cast into a planetary mixer (NAUTA MIXER model VN manufactured by Hosokawa Micron Corporation). The screw-like stirring blade was revolved 3.5 times per minute and rotated 100 times per minute for stirring. A nitrogen flow was passed through at a flow rate of 0.1 $m^3$/min and the temperature was elevated to 70° C. to further remove toluene so that reduced pressure (about 0.01 MPa) could be attained. A resin solution (100 parts by mass of resin solution 1 +70 parts by mass of toluene) in which the solid content of resin solution 1 was diluted to 10 mass % with toluene was cast in 5 parts by mass based on 100 parts by mass of the porous magnetic core and an operation for removing toluene and a filling operation were performed for 1 hour. The filling amount of the obtained magnetic carrier was 0.5 part by mass.

Subsequently, a resin solution (100 parts by mass of resin solution 1+70 parts by mass of toluene) in which the solid content of resin solution 1 was diluted to 10 mass % with toluene was cast in ⅓ amount for the magnetic carrier and an operation for removing toluene and a coating operation were performed for 20 minutes. Subsequently, ⅓ amount of the resin solution was cast and an operation for removing toluene and a coating operation were further performed for 20 minutes and ⅓ amount of the resin solution was cast and an operation for removing toluene and a coating operation were further performed for 20 minutes. The coating amount was 2.0 parts by mass based on 100 parts by mass of the magnetic carrier.

Furthermore, magnetic carrier 8 was obtained in the same way as in magnetic carrier 1 except that the revolution number of the mixer having a spiral blade was 4 times per minute. The partial exposure condition for the core particles on the surfaces of the magnetic carrier particles was controlled by changing the stirring number of revolutions of the mixer having a spiral blade.

The physical properties of the obtained magnetic carrier 8 are shown in Table 3.

Production Example of Magnetic Carrier 9
(Comparative Example)

Magnetic carrier 9 (Comparative Example) was obtained in the same way as in magnetic carrier 1 except that the filling amount of the resin solution 1 was 8.0 parts by mass based on 100 parts by mass of porous magnetic core 2 and that the coating step was not performed.

The physical properties of the obtained magnetic carrier 9 are shown in Table 3.

Production Example of Magnetic Carrier 10
(Comparative Example)

A magnetic carrier was obtained in the same way as in magnetic carrier 1 except that the filling amount of the resin solution 1 was 8.0 parts by mass based on 100 parts by mass of porous magnetic core 6.

Then, 100 parts by mass of the magnetic carrier filled with a silicone resin composition was placed in a fluid bed coating apparatus (SPIR-A-FLOW SFC type manufactured by Freund Corporation), and nitrogen at an aeration rate of 0.8 $m^3$/min was introduced and the aeration temperature was a temperature of 75° C. The number of rotation of the rotary rotor was 1000 times per minute, and when the product temperature reached a temperature of 50° C., spraying was started using a resin solution (100 parts by mass of resin solution 1+70 parts by mass of toluene) in which the solid content of resin solution 1 was diluted to 10 mass % with toluene. The spraying rate was set to 3.5 g/min. Coating was performed until the amount of the coating resin became 1.0 part by mass.

Furthermore, magnetic carrier 10 (Comparative Example) was obtained in the same way as in magnetic carrier 1 except that the revolution number of the mixer having a spiral blade was 1.5 time per minute. The surfaces of the core particles were not allowed to be exposed to the surfaces of the magnetic carrier particles by changing the stirring number of revolutions of the mixer having a spiral blade.

The physical properties of the obtained magnetic carrier 10 are shown in Table 3.

Production Example of Magnetic Carrier 11
(Comparative Example) and Magnetic Carrier 12
(Comparative Example)

Magnetic carrier 11 (Comparative Example) and magnetic carrier 12 (Comparative Example) were obtained in the same way as in magnetic carrier 1 except that 100 parts by mass each of magnetic cores 7 (for the magnetic carrier 11) and 8 (for the magnetic carrier 12) were used.

The physical properties of the obtained magnetic carriers 11 and 12 are shown in Table 3.

Production Example of Magnetic Carrier 13
(Comparative Example)

A magnetic carrier filled with a silicone resin composition was obtained in the same way as in magnetic carrier 10 except that 100 parts by mass of magnetic core 6 was used.

Then, magnetic carrier 13 (Comparative Example) was obtained in the same way as in magnetic carrier 10 except that resin solution 1 was changed to resin solution 3.

The physical properties of the obtained magnetic carrier 13 are shown in Table 3.

Production Example of Magnetic Carrier 14
(Comparative Example)

| | |
|---|---|
| For resin solution 4, Silicone varnish (SR2411 manufactured by Dow Corning Toray Co., Ltd.) (A toluene solution having a solid content of 20 mass %) | 100.0 parts by mass |
| γ-aminopropyl triethoxysilane | 2.0 parts by mass |
| Toluene | 1000.0 parts by mass |

The above materials were mixed together to obtain resin solution 4.

Magnetic carrier 14 (Comparative Example) was obtained in the same way as in magnetic carrier 5 except that porous magnetic core 1 was replaced with porous magnetic core 9, that the temperature of the indirect heating type dryer was changed from 70° C. to 75° C., that the resin solution to fill the insides of the porous magnetic core particles was changed from resin solution 1 to resin solution 4, that the resin filling amount was changed from 18.0 parts by mass to 20.0 parts by mass, and that heat-treatment temperature after the removal of toluene and the filling with a resin was changed to 200° C.

The physical properties of the obtained magnetic carrier 14 are shown in Table 3.

Production Example of Magnetic Carrier 15
(Comparative Example)

| | |
|---|---|
| Silicone varnish (SR2411 manufactured by Dow Corning Toray Co., Ltd.) | 100.0 parts by mass |
| γ-aminopropyl triethoxysilane | 2.0 parts by mass |
| Conductive carbon | |
| Toluene | 1000.0 parts by mass |

The above materials were mixed together to obtain resin solution 5.

A magnetic carrier filled with a silicone resin composition was obtained in the same way as in magnetic carrier 5 except that porous magnetic core 1 was replaced with porous magnetic core 9, that the temperature of the indirect heating type dryer was changed from 70° C. to 75° C., that the resin solution to fill the insides of the porous magnetic core particles was changed from resin solution 1 to resin solution 4, that the resin filling amount was changed from 18.0 parts by mass to 13.0 parts by mass, and that heat-treatment temperature after the removal of toluene and the filling with a resin was changed to 200° C.

Subsequently, magnetic carrier 15 (Comparative Example) was obtained in the same way as in magnetic carrier 10 except that resin solution 1 was replaced with resin solution 5 for 100 parts by mass of the magnetic carrier filled with a silicone resin composition, that the coating resin amount was changed from 1.0 part by mass to 2.0 parts by mass, and that the heat-treatment after the coating was performed with a vacuum dryer instead at a temperature 220° C. under reduced pressure (about 0.01 MPa) for 2 hours while a nitrogen flow was passed through at a flow rate of 0.01 $m^3$/min.

The physical properties of the obtained magnetic carrier 15 are shown in Table 3.

TABLE 3

| | Magnetic core | Resin solution | Filling amount (mass part) | Resin solution | Coating amount (mass part) | D50 (μm) | Electric field intensity just before break-down (V/cm) | Resistivity at 1000 V/cm (Ω · cm) | Intensity of magnetization ($Am^2$/kg) | True specific gravity (g/$cm^3$) | Resistivity at 2000 V/cm (Ω · cm) |
|---|---|---|---|---|---|---|---|---|---|---|---|
| Magnetic carrier 1 | Porous magnetic core 1 | 1 | 17.0 | 1 | 1.5 | 36.2 | 3130 | $4.0 \times 10^7$ | 50 | 3.51 | $1.8 \times 10^7$ |
| Magnetic carrier 2 | Porous magnetic core 2 | 1 | 8.0 | 1 | 1.5 | 37.9 | 2720 | $6.0 \times 10^7$ | 54 | 3.99 | $1.2 \times 10^7$ |
| Magnetic carrier 3 | Porous magnetic core 3 | 1 | 16.0 | 1 | 2.0 | 37.5 | 3130 | $7.2 \times 10^7$ | 48 | 3.53 | $3.2 \times 10^7$ |
| Magnetic carrier 4 | Porous magnetic core 4 | 1 | 6.0 | 1 | 1.0 | 46.0 | 1850 | $1.9 \times 10^7$ | 57 | 4.18 | Break-down |
| Magnetic carrier 5 | Porous magnetic core 1 | 1 | 18.0 | — | — | 35.5 | 4960 | $1.2 \times 10^8$ | 50 | 3.63 | $7.5 \times 10^7$ |
| Magnetic carrier 6 | Magnetic core 5 | — | — | 1 | 1.0 | 34.0 | 1580 | $1.2 \times 10^7$ | 58 | 4.79 | Break-down |
| Magnetic carrier 7 | Porous magnetic core 1 | 2 | 15.0 | 3 | 1.5 | 35.7 | 4160 | $7.2 \times 10^7$ | 51 | 3.49 | $4.0 \times 10^7$ |
| Magnetic carrier 8 | Porous magnetic core 4 | 1 | 0.5 | 1 | 2.0 | 45.2 | 1350 | $4.5 \times 10^6$ | 60 | 4.69 | Break-down |
| Magnetic carrier 9 | Porous magnesic core 2 | 1 | 8.0 | — | — | 38.0 | 1230 | $9.2 \times 10^5$ | 55 | 3.96 | Break-down |
| Magnetic carrier 10 | Porous magnetic core 6 | 1 | 8.0 | 1 | 1.0 | 35.6 | 6000 | $1.5 \times 10^8$ | 50 | 4.06 | $5.1 \times 10^7$ |
| Magnetic carrier 11 | Magnetic core 7 | — | — | 1 | 0.5 | 36.5 | Not break-down up to 10000 V/cm | $4.5 \times 10^8$ | 54 | 4.98 | $3.5 \times 10^8$ |
| Magnetic carrier 12 | Magnetic core 8 | — | — | 1 | 0.5 | 35.5 | Not break-down up to 10000 V/cm | $1.8 \times 10^{12}$ | 41 | 3.49 | $1.0 \times 10^{12}$ |
| Magnetic carrier 13 | Porous magnetic core 6 | 1 | 8.0 | 3 | 1.0 | 35.3 | 5940 | $4.6 \times 10^7$ | 50 | 3.97 | $2.9 \times 10^6$ |
| Magnetic carrier 14 | Porous magnetic core 9 | 4 | 20.0 | — | — | 36.0 | Not break-down up to 10000 V/cm | $1.4 \times 10^{11}$ | 44 | 3.37 | $5.7 \times 10^{10}$ |
| Magnetic carrier 15 | Porous magnetic core 9 | 4 | 13.0 | 5 | 2.0 | 35.4 | Not break-down up to 10000 V/cm | $1.8 \times 10^8$ | 47 | 3.55 | $1.1 \times 10^8$ |

Production Example 1 of Cyan Toner

As materials to obtain a vinyl copolymer unit, 10 parts by mass of styrene, 5 parts by mass of 2-ethylhexyl acrylate, 2 parts by mass of fumaric acid, 5 parts by mass of α-methyl styrene dimer and 5 parts by mass of dicumyl peroxide were placed in a dripping funnel. As materials to obtain a polyester polymer unit, 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 9 parts by mass of terephthalic acid, 5 parts by mass of trimellitic anhydride, 24 parts by mass of fumaric acid and 0.2 part by mass of tin 2-ethyl hexanoate were placed in a 4-liter four-necked glass flask. This four-necked flask was equipped with a thermometer, a stirrer, a condenser and a nitrogen introduction pipe and placed in a mantle heater. Then, the air inside the four-necked flask was replaced with nitrogen gas and the temperature was gradually elevated while stirring the mixture therein. The vinyl monomer and a polymerization initiator were added dropwise thereto from the dripping funnel for about 4 hours at a temperature of 130° C. under stirring. Then the temperature was elevated to 200° C. and the mixture was reacted for 4 hours to obtain a hybrid resin A having a weight average molecular weight of 78,000, a number average molecular weight of 3800 and a Tg of 62° C.

<Production of Cyan Masterbatch>

| | |
|---|---|
| Hybrid resin A | 60.0 parts by mass |
| Cyan pigment (PigmentBlue 15: 3) | 40.0 parts by mass |

The above raw materials were placed in a kneader type mixer and heated under non-pressurization and under mixing. After the resultant mixture was melt kneaded at a temperature of 90 to 110° C. for 30 minutes, the mixture was cooled and crushed in a pin mill to about 1 mm to prepare a cyan masterbatch.

<Production of Cyan Toner>

| | |
|---|---|
| Hybrid resin A | 92.6 parts by mass |
| Refinement paraffin wax (the largest endothermic peak: 70° C.) | 5.3 parts by mass |
| Cyan masterbatch (coloring agent: 40 mass %) | 24.1 parts by mass |
| Aluminum compound of di-tert-butylsalicylic acid | 1.1 parts by mass |

The above materials were mixed together in a HENSCHEL MIXER preliminarily, and melt kneaded with a twin-screw extruder so that the temperature of the kneaded product was 150° C. (temperature at the outlet of the apparatus set at 120° C.) and, after cooling, the extruded product was roughly crushed with a hammer mill to about 1 to 2 mm Then the hammer shape was changed and a roughly pulverized product of about 0.3 mm was prepared with the hammer mill having a smaller mesh. Then, a moderately pulverized product of around 11 μm was made with a turbo mill (RS rotor/SNB liner) manufactured by Turbo Kogyo Co., Ltd. Furthermore, the moderately pulverized product was pulverized to around 6 μm using a turbo mill (RSS rotor/SNNB liner) manufactured by Turbo Kogyo Co., Ltd. and a finely pulverized product of around 5 μm was prepared using a turbo mill (RSS rotor/SNNB liner) again. Then, classification and conglobation were performed using a particle design apparatus (product name: FACULTY) manufactured by Hosokawa Micron Corporation having an improved shape and number of hammers to obtain cyan toner particles having a weight average particle size (D4) of 5.8 μm, and an average circularity of 0.964.

To 100 parts by mass of the obtained cyan toner particles were added 1.0 part by mass of silica particles treated with hexamethyldisilazane and having an average particle size in the number-based distribution of 110 nm and hydrophobicity of 85%, 0.9 part by mass of titanium oxide particles having an average particle size in the number-based distribution of 50 nm and a hydrophobicity of 68% and 0.5 part by mass of dimethyl silicone oil treated silica particles having an average particle size in the number-based distribution of 20 nm and a hydrophobicity of 90%. Then, these were mixed together in a HENSCHEL MIXER (manufactured by Mitsui Miike Kako Co., Ltd.) to obtain cyan toner 1 having a weight average particle size of 5.8 μm and an average circularity of 0.963.

The physical properties of the obtained cyan toner 1 are shown in Table 4B.

Production Example 1 of Magenta Toner

<Production of Magenta Masterbatch>

| | |
|---|---|
| Hybrid resin A | 60 parts by mass |
| Magenta pigment (PigmentRed-57) | 20 parts by mass |
| Magenta pigment (PigmentRed-122) | 20 parts by mass |

The above materials were melt kneaded in a kneader mixer to prepare a magenta masterbatch in the same way as in the cyan masterbatch.

<Production of Magenta Toner>

A magenta toner 1 was prepared in the same way as in the production example of cyan toner 1 except that the formulation was changed to that of magenta toner 1 as shown in Table 4A.

The physical properties of the obtained magenta toner 1 are shown in Table 4B.

Production Example 1 of Yellow Toner

<Production of Yellow Masterbatch>

| | |
|---|---|
| Hybrid resin A | 60 parts by mass |
| Yellow pigment (PigmentYellow-74) | 40 parts by mass |

The above materials were melt kneaded in a kneader mixer to prepare a yellow masterbatch in the same way as in the cyan masterbatch.

<Production of Yellow Toner>

A yellow toner 1 was prepared in the same way as in the production example of cyan toner 1 except that the formulation was changed to that of yellow toner 1 as shown in Table 4A.

The physical properties of the obtained yellow toner 1 are shown in Table 4B.

Production Example 1 of Black Toner

<Production of Black Masterbatch>

| | |
|---|---|
| Hybrid resin A | 60 parts by mass |
| Carbon black pigment (Printex35 manufactured by Degussa AG) | 40 parts by mass |

The above materials were melt kneaded in a kneader mixer to prepare a black masterbatch in the same way as in the cyan masterbatch.

<Production of Black Toner>

A black toner 1 was prepared in the same way as in the production example of cyan toner 1 except that the formulation was changed to that of black toner 1 as shown in Table 4A.

The physical properties of the obtained black toner 1 are shown in Table 4B.

Production Example 2 of Cyan Toner

<Production of Cyan Toner>

A cyan toner 2 was prepared in the same way as in the production example of cyan toner 1 except that the formulation was changed to that of cyan toner 2 as shown in Table 4A.

The physical properties of the obtained cyan toner 2 are shown in Table 4B.

Production Example 3 of Cyan Toner

| | |
|---|---|
| 600 parts by mass of a 0.12 mol/liter $Na_3PO_4$ aqueous solution was cast into 500 parts by mass of ion-exchange water and after warmed to a temperature of 60° C., the resultant mixture was stirred with a TK-type homomixer (manufactured by Tokushu Kika Kogyo Co., Ltd.) at 11,000 rpm. 93 parts by mass of a 1.2 mol/liter $CaCl_2$ aqueous solution was added slowly thereto to obtain an aqueous medium containing $Ca_3(PO_4)_2$. | |
| Styrene | 162.0 parts by mass |
| N-butyl acrylate | 38.0 parts by mass |
| Ester wax (behenyl behenate: maximum endothermic peak temperature, 78° C.) | 20.0 parts by mass |
| Aluminum compound of di-tert-butylsalicylic acid | 1.0 part by mass |
| Saturated polyester (terephthalic acid-propylene oxide modified bisphenol A; acid value, 15 mgKOH/g; peak molecular weight, 6000) | 10.0 parts by mass |
| Cyan pigment (PigmentBlue 15: 3) | 13.0 parts by mass |

The above materials were warmed to a temperature of 60° C. and uniformly dissolved and dispersed with a TK-type homomixer (manufactured by Tokushu Kika Kogyo Co., Ltd.) at 10,000 rpm. 8 parts by mass of 2,2'-azobis(2,4-dimethylvaleronitrile), a polymerization initiator, was dissolved therein to prepare a monomer composition.

The above monomer composition was cast in the above aqueous medium and the resultant mixture was stirred with a TK-type homomixer at 15,000 rpm in a nitrogen atmosphere at a temperature of 60° C. for 10 minutes and the monomer composition was granulated. Then the temperature was elevated to 80° C. and the mixture was allowed to react for 10 hours under stirring with a paddle stirring blade. After the polymerization reaction ended, the remaining monomer was evaporated under reduced pressure. After cooling, hydrochloric acid was added to the reaction product to dissolve $Ca_3(PO_4)_2$. Filtration, washing with water and drying were then performed to obtain cyan toner particles having a weight average particle size (D4) of 3.2 μm and an average circularity of 0.982. These particles had a weight average molecular weight of 65,000, a number average molecular weight of 23,000 and a Tg of 58° C.

To 100 parts by mass of the obtained cyan toner particles were added 1.5 parts by mass of silica particles treated with hexamethyldisilazane and having an average particle size in the number-based distribution of 90 nm and a hydrophobicity of 80, 0.8 part by mass of titanium oxide particles having an average particle size in the number-based distribution of 40 nm and a hydrophobicity of 60% and 1.3 parts by mass of dimethyl silicone oil treated silica particles having a maximum peak particle size in the number-based distribution of 30 nm and a hydrophobicity of 85%. Then, these were mixed together in a HENSCHEL MIXER (manufactured by Mitsui Miike Kako Co., Ltd.) to obtain cyan toner 3 having a weight average particle size (D4) of 3.2 μm and an average circularity of 0.981. The particles had one local maximum at 90 nm in the particle size distribution in the number-based distribution.

Production Example 4 of Cyan Toner

<Production of Cyan Masterbatch>

| | |
|---|---|
| Hybrid resin A | 60.0 parts by mass |
| A cyan pigment (PigmentBlue 15: 3) | 40.0 parts by mass |

The above formulation was melt kneaded in a kneader mixer to prepare a cyan masterbatch likewise.

<Production of Cyan Toner>

A cyan toner 4 was prepared in the same way as in the production example of cyan toner 1 except that the formulation was changed to that of cyan toner 4 as shown in Table 4A.

The physical properties of the obtained cyan toner 4 are shown in Table 4B.

TABLE 4A

| | Binder resin | | Coloring agent Masterbatch | | Coloring agent | | Purified Paraffin wax | Aluminum compound of di-tert-butylsalicylic acid | Silica particle | Titaium oxide particle | Dimethyl silicone oil treated silica particle |
|---|---|---|---|---|---|---|---|---|---|---|---|
| Cyan toner 1 | Hybrid resin A | 92.6 mass parts | Cyan masterbatch | 24.1 mass parts | — | — | 5.3 mass parts | 1.1 mass parts | 110 nm 1.0 mass parts | 50 nm 0.9 mass parts | 20 nm 0.5 mass parts |
| Magenta toner 1 | Hybrid resin A | 88.3 mass parts | Magenta masterbatch | 45.0 mass parts | — | — | 5.7 mass parts | 1.1 mass parts | 110 nm 1.0 mass parts | 50 nm 0.9 mass parts | 20 nm 0.5 mass parts |
| Yellow toner 1 | Hybrid resin A | 89.5 mass parts | Yellow masterbatch | 39.7 mass parts | — | — | 5.7 mass parts | 1.1 mass parts | 110 nm 1.0 mass parts | 50 nm 0.9 mass parts | 20 nm 0.3 mass parts |
| Black toner 1 | Hybrid resin A | 92.6 mass parts | Black masterbatch | 24.1 mass parts | P.B15:3 | 2.0 mass parts | 5.3 mass parts | 1.1 mass parts | 110 nm 1.0 mass parts | 50 nm 0.8 mass parts | 20 nm 0.6 mass parts |
| Cyan toner 2 | Hybrid resin A | 100.0 mass parts | — | — | P.B15:3 | 5.5 mass parts | 5.0 mass parts | 1.0 mass parts | 110 nm 1.0 mass parts | 50 nm 0.9 mass parts | 20 nm 0.5 mass parts |
| Cyan toner 4 | Hybrid resin A | 92.6 mass parts | Cyan masterbatch | 24.1 mass parts | — | — | 5.3 mass parts | 1.1 mass parts | — | 170 nm 1.0 mass parts | 20 nm 0.5 mass parts |

TABLE 4B

| | Toner particle | | Toner | | |
|---|---|---|---|---|---|
| | Weight average particle size D4 (μm) | Average circularity | Weight average particle size D4 (μm) | Average circularity | Particle size (nm) of externally added inorganic particle at the local maximum in range of 80 to 200 nm |
| Cyan toner 1 | 5.8 | 0.964 | 5.8 | 0.963 | 110 |
| Cyan toner 2 | 5.8 | 0.964 | 5.8 | 0.963 | 110 |
| Cyan toner 3 | 3.2 | 0.982 | 3.2 | 0.981 | 90 |
| Cyan toner 4 | 8.3 | 0.944 | 8.4 | 0.943 | 170 |
| Magenta toner 1 | 5.9 | 0.963 | 5.8 | 0.963 | 110 |
| Yellow toner 1 | 5.7 | 0.962 | 5.8 | 0.962 | 110 |
| Black toner 1 | 5.9 | 0.960 | 5.9 | 0.961 | 110 |

Example 1

Magnetic carrier 1 and cyan toner 1 are each air conditioned in a normal temperature and normal humidity environment (temperature, 23° C.; humidity, 50% RH) for 24 hours. 8 parts by mass of cyan toner 1 is weighed for 92 parts by mass of magnetic carrier 1. The resultant mixture was shaken at 0.63 $S^{-1}$ in a 10-liter V-type mixer for 10 minutes to prepare a two-component developer. The absolute value of the frictional charge amount when mixed for 10 minutes is defined as the initial frictional charge amount. The results of performing the following evaluation using this two-component developer are shown in Table 5.

As an image forming apparatus, a digital full color printer (a remodeled version of commercial digital printing printer image PRESSC7000 VP manufactured by Canon Inc.) (remodeling points are described later) was used. The above developer was placed at the cyan position in the developing apparatus and image formation was performed in a normal temperature and normal humidity environment (temperature, 23° C.; humidity, 50% RH). Remodeling was performed by rearranging the position of the developing container as shown in FIG. 10, setting the gap (S-D gap) between the developing sleeve and the developing electrode of the photosensitive member to 300 μm; rotating the developing sleeve and the photoconductor drum in the forward direction in the developing area; and setting the circumferential speed of the developing sleeve relative to the photoconductor drum to 1.5 times. In addition, the printer was remodeled so that only toner can be supplied to a hopper as replenishing toner and that the developer outlet of the developing container was tightly closed. Then, alternating voltage having a frequency of 2.0 kHz and a Vpp from 0.7 kV to 1.8 kV changeable in increments/decrements of 0.1 kV and a direct current voltage $V_{DC}$ were applied to the developing sleeve to form an electric field in the developing area. The Vpp at which the laid-on toner amount was 0.3 mg/cm$^2$ was determined, and under these conditions, initial evaluation and a 50,000 sheet image output test were conducted using an image of an image ratio of 5%, and the following evaluation was performed.

A monochromic solid image was formed on a transfer material (paper: CS-814 (A4, 81.4 g/m$^2$) laser beam printer paper available from Canon Marketing Japan Inc.), and image density (reflection density) when the laid-on toner amount was 0.3 mg/cm$^2$ was determined. The reflection density was measured with a 500 Series Spectrodensitometer (manufactured by X-Rite Corporation). A contrast electric potential of 300 V was used as reference.

(1) Developing Characteristics

Under the above conditions, evaluation is made with regard to Vpp, laid-on toner amount and image density.

(Criteria for Evaluating Developing Characteristics)

(A) when Vpp is 1.3 kV or less, the laid-on toner amount is 0.3 mg/cm$^2$ and the image density is 1.30 or more and 1.60 or less (very good)

(B) when Vpp is 1.5 kV or less, the laid-on toner amount is 0.3 mg/cm$^2$ and the image density is 1.30 or more and 1.60 or less (good)

(C) when Vpp is 1.8 kV or less, the laid-on toner amount is 0.3 mg/cm$^2$ and the image density is 1.30 or more and 1.60 or less (acceptable level in the present invention)

(D) 0.3 mg/cm$^2$ fails to be attained even when the Vpp exceeds 1.8 kV (unacceptable level in the present invention)

(2) Image Defect (Blank Areas) Evaluation

A chart which contains halftone zones (30H 10 mm in width) and solid black zones (FFH 10 mm in width) alternately along the transportation direction of transfer paper is output (that is, an image obtained by repeating a half tone image of 10 mm in width across the longitudinal direction of the photosensitive member, and then, a solid image of 10 mm in width across the longitudinal direction of the photosensitive member). The image is read with a scanner (600 dpi) and luminance distribution (256 gradation) in the transportation direction is measured. In the obtained luminance distribution, the total of the brightness in the half tone (30H) image area which was higher than the brightness in the half tone (30H) was defined as "blank areas" which was evaluated as follows.

(Criteria for Evaluating Blank Areas)

A: 50 or less (very good)

B: 51 or more and 150 or less (good)

C: 151 or more and 300 or less (acceptable level in the present invention)

D: 301 or more (unacceptable level in the present invention)

(3) Image Quality (Roughening)

A half tone image (30H) was printed on one A4 sheet and, the area of 1,000 dots was measured with a digital microscope VHX-500 (lens wide range zoom lens VH-Z100 manufactured by Keyence Corporation). The number average (S) of the dot area and the standard deviation (σ) of the dot area were calculated and the dot reproducibility index was calculated by the following expression.

(Criteria for Evaluation of Roughening)

The roughening of the half tone image was evaluated by a dot reproducibility index.

A dot reproducibility index (I)=σ/S×100

A: I is less than 4.0 (very good)

B: I is 4.0 or more and less than 6.0 (good)

C: I is 6.0 or more and less than 8.0 (acceptable level in the present invention)

D: I is 8.0 or more (unacceptable level in the present invention)

(4) Fogging

A solid white image was printed on one A4 sheet (Vback was set to 150 V).

The average reflectance Dr (%) of the paper was measured with a reflectometer ("REFLECTOMETER MODEL TC-6DS" manufactured by Tokyo Denshoku Co., Ltd.).

The reflectance Ds (%) of the solid white image was measured.

The fogging ratio (%) was calculated by the following equation. The resultant fogging was evaluated according to the following evaluation criteria.

(Criteria for Evaluating Fogging)

$$\text{Fogging ratio (\%)} = Dr\ (\%) - Ds\ (\%)$$

A: less than 0.5% (very good)

B: 0.5% or more and less than 1.0% (good)

C: 1.0% or more and less than 2.0% (acceptable level in the present invention)

D: 2.0% or more (unacceptable level in the present invention)

(5) Carrier Adhesion

A 00H image was printed and then sampling was conducted by adhering a transparent adhesive tape closely to a part on the photoconductor drum and the number of magnetic carrier particles which deposited on the photoconductor drum per 1 cm×1 cm was counted. The number of adhesion carrier particles per 1 cm$^2$ was counted with an optical microscope.

(Criteria for Evaluating Carrier Adhesion)

A: 3 or less (very good)

B: 4 or more and 10 or less (good)

C: 11 or more and 20 or less (acceptable level in the present invention)

D: 21 or more (unacceptable level in the present invention)

(6) Leak Test (White Spots)

A developer separate from that for a durability test is prepared for an initial leak test. Toner replenishing is stopped and a solid image (laid-on toner amount, 0.30 mg/cm$^2$) is output at the contrast electric potential Vpp initially determined until the toner concentration decreases to half of the initial value and the test is performed by the following method. As for "after duration," the developer having been subjected to the durability test is used and the test is performed by the following method while the toner replenishing is stopped so that the toner concentration decreases to half of the initial value.

Solid (FFH) images are successively output on 5 sheets of A4 normal paper, and spots whose area in a diameter of 1 mm or more is white are counted and the total number of the spots on the 5 sheets is evaluated.

(Criteria for Evaluating a Leak)

A: 0 (very good)

B: 1 or more and less than 10 (good)

C: 10 or more and less than 20 (acceptable level in the present invention)

D: 20 or more (unacceptable level in the present invention)

(7) Evaluation of Color Change Before and After Durability Test

Before a durability test, the contrast electric potential was adjusted so that the toner amount which attained 1.5 in the reflection density of the solid fixed image on the paper was on the paper. The solid image (3 cm×3 cm) was output in 400 lines to obtain a fixed image. Then, after 50,000 sheets were output for the durability image test, a fixed solid image was output at the same developing voltage as that before the durability test.

The chromaticity measurement was performed before and after the durability test. In the chromaticity measurement, a chromoscope (Spectrolino, manufactured by GRETAG-MACBETH Corporation) was used with D50 as the observation light source and with the visual field of observation set to 2 degrees. ΔE was calculated and evaluated.

The color change was evaluated based on the definition of the color coordinate system standardized in the Commission Internationale de l'Eclairage (CIE) (the International Commission on Illumination) in 1976 and color difference (ΔE) of the solid image before and after the durability test was quantitatively evaluated as follows based on the following criteria. Here, in this measurement, black toner cannot be evaluated.

$$\Delta E=\{(L1^*-L2^*)^2+(a1^*-a2^*)^2+(b1^*-b2^*)^{1/2}\}^{1/2}$$

wherein L1*: Lightness of the image before the durability test a1*, b1*: Chromaticity which shows a hue and a saturation of the image before the durability test L2*: Lightness of the image after the durability test, and a2*, b2*: Chromaticity which shows a hue and a saturation of the image after the durability test (Criteria for Evaluating ΔE)

A: Color difference is subtly felt. 0.0 or more and less than 1.5 (very good)

B: Color difference is slightly felt. 1.5 or more and less than 3.0 (good)

C: Color difference is considerably felt. 3.0 or more and less than 6.0 (acceptable level in the present invention)

D: Color difference is remarkably felt. 6.0 or more (unacceptable level in the present invention)

(8) Evaluation of Gradation Characteristics 17 gradation images (00H, 10H, 20H, 30H, 40H, 50H, 60H, 70H, 80H, 90H, A0H, B0H, C0H, D0H, E0H, F0H, and FFH) were formed on a transfer material (paper: Image Coat Gloss 128 (A4, 128 g/m$^2$) available from Canon Marketing Japan Inc.), and the developing voltage (contrast electric potential) was adjusted so that the laid-on toner amount was a level in which the reflection density of the single color solid image was 1.60. Thereby a graphic image in which the images were combined in a good balance in the low to high image density regions was output and the gradation characteristics in the low to high image density regions were evaluated.

A: very good gradation characteristics (very good)

B: good gradation characteristics (good)

C: reproducibility in the low image density region but poor gradation characteristics in the high image density region (slightly good)

D: slightly poor gradation characteristics in both the low and high image density regions (acceptable level in the present invention)

E: the gradation is not smooth in the low image density region and fails in the high image density region (unacceptable level in the present invention)

(9) Evaluation of Consumption

A single color solid image was formed on a transfer material (paper: CS-814 (A4, 81.4 g/m$^2$), laser beam printer paper available from Canon Marketing Japan Inc.). Vpp was controlled so that the image density was 1.50, and an image having an image printing ratio (duty) of 10% was output on 50,000 sheets while keeping the image density constant. The consumption was determined and evaluated from the change in the toner amount in the container for supplying.

A: 850 g or more and less than 1050 g (very good)

B: 1050 g or more and less than 1350 g (good)

C: 1350 g or more and less than 1650 g (slightly good)

D: 1650 g or more and less than 1950 g (acceptable level in the present invention)

E: 1950 g or more (unacceptable level in the present invention)

Comparative Examples 1 to 6

8 parts by mass of cyan toner 1 was added to 92 parts by mass of magnetic carriers 9 to 15 to prepare a two-component developer. Evaluation was performed using this two-component developer in the same way as in Example 1. The results are shown in Table 5.

Examples 2 to 4

8 parts by mass of cyan toner 1 was added to 92 parts by mass of magnetic carriers 2 to 4 to prepare a two-component developer. Evaluation was performed using this two-component developer in the same way as in Example 1. The results are shown in Table 5.

Examples 5, 6

8 parts by mass of cyan toners 3, 4 were added to 92 parts by mass of magnetic carrier 1 to prepare a two-component developer. Evaluation was performed using this two-component developer in the same way as in Example 1. The results are shown in Table 5.

Example 7

8 parts by mass of cyan toner 1 was added to 92 parts by mass of magnetic carrier 5 to prepare a two-component developer. Evaluation was performed using this two-component developer in the same way as in Example 1. The results are shown in Table 5.

Comparative Example 7

8 parts by mass of cyan toner 1 was added to 92 parts by mass of magnetic carrier 6 to prepare a two-component developer. Evaluation was performed using this two-component developer in the same way as in Example 1. The results are shown in Table 5.

TABLE 5

| Example | Magnetic carrier | Toner | Toner density (%) | Normal temperature and normal humidity (initial) | | | | | | | |
|---|---|---|---|---|---|---|---|---|---|---|---|
| | | | | Charge amount when toner density is 8% (mC/kg) | Developing properties (Vpp) Image density | Whited-out | Roughening | Fogging | Carrier adhesion | Leak | Gradation characteristics |
| Example 1 | 1 | Cyan 1 | 8 | −60.1 | A (1.2 kV) 1.54 | A 20 | A 0.8 | A 0.2 | B 4 | A 0 | A |
| Comparative Example 1 | 9 | Cyan 1 | 8 | −51.9 | A (1.2 kV) 1.53 | A 20 | C 6.3 | D 3.6 | B 7 | D 25 | C |
| Comparative Example 2 | 10 | Cyan 1 | 8 | −62.5 | C (1.7 kV) 1.52 | D 350 | A 1.0 | A 0.2 | A 2 | A 0 | C |
| Comparative Example 3 | 11 | Cyan 1 | 8 | −57.5 | C (1.8 kV) 1.50 | D 390 | C 7.2 | C 1.2 | A 0 | A 0 | D |
| Comparative Example 4 | 12 | Cyan 1 | 8 | −60.5 | D (>1.8 kV) 3.0 mg/cm$^2$ not attained | D 1200 | A 0.7 | A 0.2 | B 4 | A 0 | D |
| Comparative Example 5 | 14 | Cyan 1 | 8 | −62.3 | D (>1.8 kV) 3.0 mg/cm$^2$ not attained | D 1400 | A 1.0 | B 0.5 | B 6 | A 0 | D |
| Comparative Example 6 | 15 | Cyan 1 | 8 | −51.2 | C (1.8 kV) 1.50 | D 370 | C 7.0 | C 1.8 | D 21 | B 1 | C |
| Example 2 | 2 | Cyan 1 | 8 | −59.5 | A (1.2 kV) 1.55 | A 20 | A 3.5 | B 0.5 | A 1 | A 0 | A |
| Example 3 | 3 | Cyan 1 | 8 | −61.7 | A (1.3 kV) 1.53 | B 60 | A 0.8 | A 0.2 | B 4 | B 1 | A |
| Example 4 | 4 | Cyan 1 | 8 | −58.8 | A (1.1 kV) 1.54 | A 20 | A 3.7 | B 0.8 | B 8 | B 3 | A |
| Example 5 | 1 | Cyan 3 | 8 | −62.0 | B (1.5 kV) 1.51 | C 170 | A 0.6 | A 0.4 | B 5 | A 0 | B |
| Example 6 | 1 | Cyan 4 | 8 | −56.0 | A (1.2 kV) 1.53 | A 40 | C 6.0 | C 1.0 | B 5 | A 0 | A |
| Example 7 | 5 | Cyan 1 | 8 | −61.0 | B (1.5 kV) 1.54 | C 220 | B 4.0 | A 0.2 | A 3 | B 1 | A |
| Comparative Example 7 | 6 | Cyan 1 | 8 | −62.5 | A (1.1 kV) 1.54 | A 10 | C 6.1 | C 1.1 | B 4 | C 11 | C |
| Example 10 | 8 | Cyan 1 | 8 | −41.3 | A (0.9 kV) 1.53 | A 20 | C 7.5 | C 1.5 | B 4 | C 10 | A |

| Example | Normal temperature and normal humidity (after 50000 sheets printing) | | | | | | | | | |
|---|---|---|---|---|---|---|---|---|---|---|
| | Charge amount when toner density is 8% (mC/kg) | Developing properties (Vpp) Image density | Blank areas | Roughening | Fogging | Carrier adhesion | Leak | Change in color ΔE | Gradation characteristics | Consumption (g) |
| Example 1 | −59.6 | A (1.2 kV) 1.53 | A 20 | A 1.1 | A 0.3 | B 4 | A 0 | A 0.6 | A | A 903 |

TABLE 5-continued

| | | | | | | | | | | |
|---|---|---|---|---|---|---|---|---|---|---|
| Comparative Example 1 | −48.9 | A (1.3 kV) 1.53 | A 30 | C 7.0 | D 5.9 | D 25 | D 49 | A 0.9 | C | A 967 |
| Comparative Example 2 | −60.3 | C (1.8 kV) 1.53 | D 400 | A 2.0 | B 0.7 | A 3 | B 5 | B 1.9 | D | A 928 |
| Comparative Example 3 | −50.1 | C (1.8 kV) 1.53 | D 580 | D 10.5 | D 4.0 | A 2 | A 0 | D 6.2 | E | A 945 |
| Comparative Example 4 | −58.8 | D (>1.8 kV) 0.30 mg/cm$^2$ not attained | D 1230 | A 1.1 | A 0.4 | B 5 | A 0 | A 1.2 | D | Predetermined image density was not attained and evaluation not performed |
| Comparative Example 5 | −65.0 | D (>1.8 kV) 0.30 mg/cm$^2$ not attained | D 1650 | B 4.0 | B 0.7 | B 5 | A 0 | D 6.5 | E | Predetermined image density was not attained and evaluation not performed |
| Comparative Example 6 | −46.2 | C (1.7 kV) 1.50 | D 350 | C 7.7 | D 3.5 | C 15 | B 1 | B 2.5 | D | A 936 |
| Example 2 | −58.5 | A (1.3 kV) 1.55 | A 40 | B 4.1 | B 0.8 | A 3 | A 0 | A 0.7 | A | A 906 |
| Example 3 | −60.0 | B (1.4 kV) 1.53 | B 70 | A 1.2 | A 0.4 | B 4 | B 3 | B 1.5 | A | A 909 |
| Example 4 | −56.1 | A (1.2 kV) 1.53 | A 40 | B 4.5 | B 0.9 | B 10 | C 11 | A 1.4 | A | A 910 |
| Example 5 | −67.0 | B (1.5 kV) 1.52 | C 170 | A 1.0 | B 0.6 | B 4 | A 0 | B 2.5 | B | A 922 |
| Example 6 | −53.6 | A (1.3 kV) 1.51 | A 50 | C 6.2 | C 1.2 | B 5 | A 0 | B 2.0 | B | A 973 |
| Example 7 | −59.5 | C (1.6 kV) 1.52 | C 240 | B 4.4 | A 0.4 | A 3 | B 2 | B 2.2 | B | A 910 |
| Comparative Example 7 | −59.4 | A (1.3 kV) 1.51 | A 50 | C 6.8 | C 1.9 | C 11 | C 14 | C 3.1 | D | A 923 |
| Example 10 | −39.5 | A (1.1 kV) 1.52 | A 20 | C 7.9 | C 1.6 | B 5 | C 10 | C 3.3 | B | A 920 |

Example 9

8 parts by mass of cyan toner 2 was added to 92 parts by mass of magnetic carrier 7 to prepare a two-component developer. This two-component developer was used and as an image forming apparatus, a remodeled version of commercial digital printing printer image PRESSC7000 VP manufactured by Canon Inc. (remodeling points are the same as in Example 1) was used. Alternating voltage having a frequency of 2.0 kHz and Vpp from 0.7 kV to 1.8 kV changeable in increments/decrements of 0.1 kV and a direct current voltage $V_{DC}$ were applied to the developing sleeve to form an electric field in the developing area. The Vpp at which the laid-on toner amount was 0.6 mg/cm$^2$ was determined, and under these conditions, initial evaluation and a durability test were performed. The contrast electric potential is fixed to 300 V. The other evaluation was performed in the same way as in Example 1.

(8) Developing Characteristics

Under the above conditions, developing characteristics are determined from Vpp, laid-on toner amount and image density.

(A) when Vpp is 1.3 kV or less, the laid-on toner amount is 0.60 mg/cm$^2$ and the image density is 1.30 or more and 1.60 or less (very good)

(B) when Vpp is 1.5 kV or less, the laid-on toner amount is 0.60 mg/cm$^2$ and the image density is 1.30 or more and 1.60 or less (good)

(C) when Vpp is 1.8 kV or less, the laid-on toner amount is 0.60 mg/cm$^2$ and the image density is 1.30 or more and 1.60 or less (acceptable level in the present invention)

(D) when 0.60 mg/cm$^2$ fails to be attained even when the Vpp exceeds 1.8 kV (unacceptable level in the present invention)

The results are shown in Table 6.

Comparative Example 5

8 parts by mass of cyan toner 2 was added to 92 parts by mass of magnetic carrier 13 to prepare a two-component developer. Evaluation was performed using this two-component developer in the same way as in Example 9. The results are shown in Table 6.

TABLE 6

| Example | Magnetic carrier | Toner | Toner density (%) | Normal temperature and normal humidity (initial): Charge amount when toner density is 8% (mC/kg) | Developing properties (Vpp) Image density | Blank areas | Roughening | Fogging | Carrier adhesion | Leak | Gradation characteristics |
|---|---|---|---|---|---|---|---|---|---|---|---|
| Example 9 | 7 | Cyan 2 | 8 | −29.3 | A (1.2 kV) 1.48 | B 60 | B 4.0 | B 0.5 | B 4 | A 0 | A |
| Comparative Example 8 | 13 | Cyan 2 | 8 | −28.8 | C (1.8 kV) 1.47 | D 310 | B 4.0 | B 0.6 | B 5 | A 0 | C |

| Example | Normal temperature and normal humidity (after 50000 sheets printing): Charge amount when toner density is 8% (mC/kg) | Developing properties (Vpp) Image density | Blank areas | Roughening | Fogging | Carrier adhesion | Leak | Change in color | Gradation characteristics | Consumption (g) |
|---|---|---|---|---|---|---|---|---|---|---|
| Example 9 | −28.4 | A (1.2 kV) 1.47 | B 60 | B 4.2 | B 0.6 | B 5 | A 0 | C 3.5 | A | D 1832 |
| Comparative Example 8 | −27.4 | C (1.8 kV) 1.47 | D 330 | B 5.2 | C 1.1 | B 5 | A 0 | D 6.1 | C | D 1859 |

Example 10

8 parts by mass of cyan toner 1 was added to 92 parts by mass of magnetic carrier 8 to prepare a two-component developer. Evaluation was performed using this two-component developer in the same way as in Example 1. The results are shown in Table 5.

Example 11

8 parts by mass each of cyan toner 1, magenta toner 1, yellow toner 1 and black toner 1 were added to 92 parts by mass of magnetic carrier 1 to prepare 4 color two-component developers. Furthermore, 5 parts by mass of a magnetic carrier was mixed with 95 parts by mass each of the respective color toners, to prepare replenishing developers.

These two-component developers were used and as an image forming apparatus, a digital full color printer (a remodeled version of commercial digital printing printer image PRESSC7000 VP manufactured by Canon Inc.) was used. Image formation was performed in each of normal temperature and normal humidity (23° C., 50% RH), normal temperature and low humidity (23° C., 5% RH), and high temperature and high humidity (30° C., 80% RH) environments. Remodeling was performed by rotating the developing sleeve and the photosensitive member in the forward direction in the developing area; and setting the circumferential speed of developing sleeve relative to the photosensitive member to 1.5 times as in Example 1. Then, alternating voltage having a frequency of 2.0 kHz and Vpp from 0.7 kV to 1.8 kV changeable in increments/decrements of 0.1 kV and a direct current voltage $V_{DC}$ were applied to the developing sleeve. The Vpp at which the laid-on toner amount was 0.3 mg/cm was determined, and under these conditions, initial evaluation and a durability test were performed. The electric contrast potential is fixed to 300 V. A 50,000 sheet image output test was conducted using a full color image for an image ratio and as a result, as shown in Table 7, sufficient image density was obtained without defects such as blank areas and fogging and good results were obtained in each environment. The change in color after the durability test was scarcely observed and the results were good in this point.

TABLE 7

| Example | Magnetic carrier | Toner | Toner density (%) | Initial: Charge amount when toner density is 8% (mC/kg) | Developing properties (Vpp) Image density | Blank areas | Roughening | Fogging | Carrier adhesion | Leak | Gradation characteristics |
|---|---|---|---|---|---|---|---|---|---|---|---|
| Example 11 (23° C. 50% RH) | 1 | Cyan 1 | 8 | −60.1 | A (1.2 kV) 1.53 | A 20 | A 0.8 | A 0.2 | B 4 | A 0 | A |
| | 1 | Magenta 1 | 8 | −58.8 | A (1.2 kV) 1.53 | A 10 | A 0.9 | A 0.2 | A 3 | A 0 | A |

TABLE 7-continued

| | | | | | | | | | | | |
|---|---|---|---|---|---|---|---|---|---|---|---|
| | 1 | Yellow 1 | 8 | −62.0 | A (1.3 kV) 1.54 | A 20 | A 0.7 | A 0.2 | B 4 | A 0 | A |
| | 1 | Black 1 | 8 | −57.5 | A (1.2 kV) 1.50 | A 20 | A 3.5 | A 0.4 | A 3 | A 0 | A |
| Example 11 (23° C. 5% RH) | 1 | Cyan 1 | 8 | −65.7 | A (1.3 kV) 1.53 | A 20 | A 0.8 | A 0.2 | B 6 | A 0 | A |
| | 1 | Magenta 1 | 8 | −64.5 | A (1.3 kV) 1.51 | A 20 | A 0.8 | A 0.2 | B 4 | A 0 | A |
| | 1 | Yellow 1 | 8 | −68.2 | A (1.3 kV) 1.52 | A 20 | A 0.7 | A 0.2 | B 5 | A 0 | A |
| | 1 | Black 1 | 8 | −62.3 | A (1.3 kV) 1.51 | A 20 | A 3.5 | A 0.3 | A 3 | A 0 | A |
| Example 11 (30° C. 80% RH) | 1 | Cyan 1 | 8 | −56.9 | A (1.2 kV) 1.55 | A 10 | A 1.9 | A 0.3 | A 0 | A 0 | A |
| | 1 | Magenta 1 | 8 | −55.8 | A (1.1 kV) 1.53 | A 10 | A 2.0 | A 0.3 | A 0 | A 0 | A |
| | 1 | Yellow 1 | 8 | −58.6 | A (1.2 kV) 1.52 | A 10 | A 1.8 | A 0.3 | A 0 | A 0 | A |
| | 1 | Black 1 | 8 | −53.1 | A (1.0 kV) 1.53 | A 10 | B 4.5 | B 0.5 | A 1 | A 0 | A |

| | After 50000 sheets printing | | | | | | | | | |
|---|---|---|---|---|---|---|---|---|---|---|
| Example | Charge amount when toner density is 8% (mC/kg) | Developing properties (Vpp) Image density | Blank areas | Roughening | Fogging | Carrier adhesion | Leak | Change in color | Gradation characteristics | Consumption (g) |
| Example 11 (23° C. 50% RH) | −59.7 | A (1.2 kV) 1.53 | A 20 | A 1.2 | A 0.3 | B 4 | A 0 | A 0.6 | A | A 903 |
| | −58.2 | A (1.2 kV) 1.54 | A 10 | A 1.4 | A 0.3 | B 4 | A 0 | A 0.7 | A | A 898 |
| | −61.7 | A (1.3 kV) 1.52 | A 20 | A 0.9 | A 0.3 | B 5 | A 0 | A 0.4 | A | A 896 |
| | −57.0 | A (1.2 kV) 1.51 | A 20 | B 4.0 | B 0.5 | A 2 | A 0 | — | A | A 912 |
| Example 11 (23° C. 5% RH) | −65.3 | A (1.3 kV) 1.53 | A 20 | A 1.1 | A 0.3 | B 5 | A 0 | A 0.5 | A | A 899 |
| | −64.0 | A (1.3 kV) 1.52 | A 10 | A 1.3 | A 0.3 | B 4 | A 0 | A 0.6 | A | A 895 |
| | −67.9 | A (1.3 kV) 1.52 | A 20 | A 1.0 | A 0.3 | B 4 | A 0 | A 0.4 | A | A 889 |
| | −61.7 | A (1.3 kV) 1.52 | A 10 | A 3.9 | B 0.6 | A 3 | A 0 | — | A | A 903 |
| Example 11 (30° C. 80% RH) | −56.1 | A (1.2 kV) 1.55 | A 20 | A 2.3 | A 0.4 | A 2 | A 0 | A 0.8 | A | A 910 |
| | −54.9 | A (1.1 kV) 1.55 | A 10 | A 2.6 | A 0.4 | A 2 | A 0 | A 1.0 | A | A 909 |
| | −57.5 | A (1.2 kV) 1.53 | A 20 | A 2.0 | A 0.3 | A 2 | A 0 | A 0.7 | A | A 901 |
| | −52.5 | A (1.0 kV) 1.52 | A 10 | B 5.4 | B 0.7 | A 0 | A 0 | — | B | A 916 |

Production Example 10 of the Porous Magnetic Core

Step 1 (Weighing/Mixing Step)

| | |
|---|---|
| $Fe_2O_3$ | 59.5 mass % |
| $MnCO_3$ | 35.0 mass % |
| $Mg(OH)_2$ | 4.4 mass % |
| $SrCO_3$ | 1.1 mass % |

The ferrite raw materials were weighed as above. Then the materials were wet mixed with water in a ball mill using zirconia having a diameter (ϕ) of 10 mm for 3 hours. The solid content of the slurry was 80 mass %.

Step 2 (Calcining Step)

After the mixed slurry was dried with a spray dryer (manufactured by Ohkawara Kakohki Co., Ltd.), the mixture was calcined at 950° C. in the atmosphere for 2 hours to prepare a calcined ferrite.

Step 3 (Crushing Step)

After crushing to around 0.5 mm with a crusher, water was added thereto so that the solid content of the slurry was 80 mass %. In order to control the pore size, the size of the balls and beads and the crushing time therewith were controlled. The mixture was pulverized in a wet process ball mill using zirconia of ϕ10 mm for 2 hours. The slurry was further pulverized in a wet process beads mill using zirconia of ϕ1 mm instead of the above zirconia for 2 hours to obtain a slurry of a first pulverized powder. As for the obtained first pulverized powder, D50 was 2.5 μm and D90 was 3.4 μm. Half of the amount of the slurry of the first pulverized powder was taken out and the slurry of the first pulverized powder was further crushed for 2 hours to prepare a slurry of a second pulverized powder. As for the obtained second pulverized powder, D50 was 0.9 μm and D90 was 1.8 μm. The slurry of the first pulverized powder removed on the way and the slurry of the second pulverized powder were mixed together to obtain a ferrite slurry. As a result of measuring D50 and D90 of the calcined ferrite in the slurry, they were 1.3 μm and 2.3 μm, respectively.

Step 4 (Granulation Step)

In order to control the porous structure of the porous magnetic core particles, polyvinyl alcohol was added as a binder to the above ferrite slurry in a ratio of 0.7 part by mass based on 100 parts by mass of the calcined ferrite. Water was further added thereto to adjust the solid content of the slurry to 70 mass % and then granulated to spherical particles with a spray dryer (manufactured by Ohkawara Kakohki Co., Ltd.).

Step 5 (Burning Step)

In order to attain a desired resistivity of the porous magnetic core, the burning environment was controlled. In addition, the burning temperature was controlled to control the porous structure. The particles were burnt in an electric furnace from room temperature to the burning temperature for 5 hours and at a temperature of 1,150° C. for 4 hours in a nitrogen atmosphere (oxygen concentration: 0.01 volume % or less). Then the temperature was allowed to decrease to 80° C. for 8 hours and the atmosphere was changed back from the nitrogen atmosphere to the atmosphere and the product was taken out at a temperature of 40° C. or less.

Step 6 (Sorting Process)

After the aggregated particles were disintegrated, they were sieved with a sieve having an opening size of 75 μm to remove coarse particles. Fine particles were removed by further performing air flow classification to obtain porous magnetic core 10. The obtained porous magnetic core particles were porous. The results of the measurement of the resistivity of the obtained porous magnetic core are shown in Table 9B. The other physical properties are also shown in Table 9B.

Production Examples 11 to 17 of Porous Magnetic Core

Porous magnetic cores 11 to 17 were prepared in the same way as in Production Example 10 of a porous magnetic core except that production conditions were changed as shown in Table 9A. The physical properties of the obtained porous magnetic core 11 are shown in Table 9B.

The obtained magnetic core was a sintered body having a smooth surface. No pores were able to be detected.

Production Example 18 of Magnetic Core

Respectively 4.0 mass % of a silane coupling agent (3-(2-aminoethylaminopropyl)trimethoxysilane) were added to magnetite fine particles (number average particle diameter, 0.3 μm) and hematite fine particles (number average particle diameter, 0.6 μm), and the mixture was subjected to high speed mixing and stirring at a temperature of 100° C. or more in a container, and the respective fine particles were surface treated.

| | |
|---|---|
| Phenol | 10 parts by mass |
| A formaldehyde solution (37 mass % formaldehyde aqueous solution) | 6 parts by mass |
| Magnetite fine particles treated as above | 59 parts by mass |
| Hematite fine particles treated as above | 25 parts by mass |

The above materials, and 5 parts by mass of a 28 mass % ammonium solution, 10 parts by mass of water were placed in a flask, the temperature was elevated to 85° C. for 30 minutes and kept at the temperature while the resultant mixture was stirred and mixed and polymerized for 3 hours to cure. Then, mixture was cooled to 30° C. and water was further added thereto. The supernatant liquid was removed and the precipitate was washed with water and then air dried. Subsequently, the powder was dried at a temperature of 60° C. under reduced pressure (5 hPa or less), and magnetic core 18 in which magnetic fine particles were dispersed (magnetic fine particle dispersed resin core) was obtained.

No pores were able to be detected. The physical properties of the obtained magnetic core 18 are shown in Table 9B.

Production Example 19 of Porous Magnetic Core

Porous magnetic core 19 was prepared in the same way as in Production Example 10 of a porous magnetic core except that production conditions were changed as shown in Table 9A. As a post-treatment, after the burning, the core was further burnt at a temperature of 400° C. for 0.5 hour in a hydrogen flow in an electric furnace to reduce the surface for resistance adjustment. The physical properties of the obtained porous magnetic core 19 are shown in Table 9B.

TABLE 9A

| | Composition of raw materials (mass %) | | | | | | | | Calcination | |
|---|---|---|---|---|---|---|---|---|---|---|
| | $Fe_2O_3$ | $MnCO_3$ | $Mg(OH)_2$ | $SrCO_3$ | CuO | ZnO | $Li_2O$ | $CaCO_3$ | Temperature (° C.) | Time (h) |
| Porous magnetic core 10 | 59.5 | 35.0 | 4.4 | 1.1 | — | — | — | — | 950 | 2 |
| Porous magnetic core 11 | 62.3 | 30.8 | 5.8 | 1.1 | — | — | — | — | 950 | 2 |
| Porous magnetic core 12 | 62.3 | 30.8 | 5.8 | 1.1 | — | — | — | — | 950 | 2 |
| Porous magnetic core 13 | 69.0 | 29.0 | 2.0 | — | — | — | — | — | 950 | 2 |
| Porous magnetic core 14 | 69.0 | 29.0 | 2.0 | — | — | — | — | — | 950 | 2 |
| Porous magnetic core 15 | 87.4 | — | 2.9 | — | — | — | 7.5 | 2.2 | 950 | 2 |
| Porous magnetic core 16 | 59.5 | 35.0 | 4.4 | 1.1 | — | — | — | — | 950 | 2 |
| Magnetic core 17 | 70.8 | — | — | — | 12.8 | 16.4 | — | — | 950 | 2 |
| Porous magnetic core 19 | 69.0 | 29.0 | 2.0 | — | — | — | — | — | 950 | 2 |

| | Pulverization | | | | | | | | | |
|---|---|---|---|---|---|---|---|---|---|---|
| | Ball mill | | | | Beads mill | | | | Particle size of calcined ferrite | |
| | Media | Time (h) | D50 (μm) | D90 (μm) | Media | Time (h) | D50 (μm) | D90 (μm) | D50 (μm) | D90 (μm) |
| Porous magnetic core 10 | 10 mmφ Zirconia | 2 | 2.5 | 3.4 | 1 mmφ Zirconia | 2 | 0.9 | 1.8 | 1.3 | 2.3 |
| Porous magnetic core 11 | 10 mmφ Zirconia | 2 | 2.5 | 3.6 | 1 mmφ Zirconia | 3 | 0.8 | 1.6 | 1.5 | 2.9 |
| Porous magnetic core 12 | 10 mmφ Stainless | 1 | 4.3 | 6.6 | 1 mmφ Zirconia | 1 | 1.4 | 2.4 | 1.7 | 3.6 |
| Porous magnetic core 13 | 10 mmφ Zirconia | 1 | 4.2 | 6.6 | 1 mmφ Zirconia | 1 | 1.5 | 2.4 | 1.9 | 3.5 |
| Porous magnetic core 14 | 10 mmφ Zirconia | 2 | 2.4 | 3.3 | 1 mmφ Zirconia | 3 | 0.8 | 1.5 | 1.3 | 2.0 |
| Porous magnetic core 15 | 10 mmφ Zirconia | 2 | 2.2 | 3.3 | 1 mmφ Zirconia | 4 | 0.7 | 1.2 | 1.0 | 1.7 |
| Porous magnetic core 16 | 10 mmφ Stainless | 1 | 4.4 | 6.6 | 1.2 mmφ Stainless | 4 | 0.9 | 1.4 | 1.3 | 2.4 |
| Magnetic core 17 | 10 mmφ Stainless | 6 | — | — | — | — | — | — | 2.6 | 4.3 |
| Porous magnetic core 19 | 10 mmφ Zirconia | 2 | 2.4 | 3.3 | 1 mmφ Zirconia | 2 | 1 | 1.8 | 1.5 | 2.3 |

| | Granulation | | | Calcination | | | |
|---|---|---|---|---|---|---|---|
| | PVA amount (mass part) | $Na_2CO_3$ amount (mass part) | Solid content (mass %) | Oxygen concentration (volume %) | Calcination temperature (° C.) | Time (h) | Post-treatment |
| Porous magnetic core 10 | 0.7 | — | 70 | 0.01 or less | 1150 | 4 | None |
| Porous magnetic core 11 | 2.0 | — | 75 | 0.02 | 1050 | 4 | None |
| Porous magnetic core 12 | 2.0 | 0.5 | 70 | 0.2 | 1100 | 4 | None |
| Porous magnetic core 13 | 0.7 | — | 70 | 0.01 or less | 1050 | 4 | None |
| Porous magnetic core 14 | 0.7 | — | 80 | 0.01 or less | 1150 | 4 | None |
| Porous magnetic core 15 | 0.7 | 0.5 | 80 | 0.3 | 1000 | 4 | None |
| Porous magnetic core 16 | 0.7 | — | 75 | 1.0 | 1100 | 4 | None |
| Magnetic core 17 | 0.5 | — | 80 | 21 | 1300 | 4 | None |
| Porous magnetic core 19 | 0.7 | — | 70 | 0.01 or less | 1150 | 4 | Done |

TABLE 9B

| | Composition | D50 (μm) | Resistivity at 300 V/cm (Ω · cm) | Intensity of magnetization ($Am^2/kg$) | True specific gravity ($g/cm^3$) | Type of core | Peak pore size from 0.1 to 3.0 μm (μm) | Total pore volume from 0.1 to 3.0 μm (ml/kg) | Electric field intensity just before breakdown (V/cm) |
|---|---|---|---|---|---|---|---|---|---|
| Porous magnetic core 10 | $(MnO)_{0.400}(MgO)_{0.100}(SrO)_{0.010}(Fe_2O_3)_{0.490}$ | 36.0 | $6.6 \times 10^6$ | 57 | 4.83 | Porous | 1.0 | 0.058 | 570 |
| Porous magnetic core 11 | $(MnO)_{0.350}(MgO)_{0.130}(SrO)_{0.010}(Fe_2O_3)_{0.510}$ | 34.8 | $8.5 \times 10^6$ | 56 | 4.85 | Porous | 1.1 | 0.105 | 635 |
| Porous magnetic core 12 | $(MnO)_{0.350}(MgO)_{0.130}(SrO)_{0.010}(Fe_2O_3)_{0.510}$ | 34.9 | $1.5 \times 10^7$ | 55 | 4.84 | Porous | 1.2 | 0.090 | 1040 |

TABLE 9B-continued

| | Composition | D50 (μm) | Resistivity at 300 V/cm (Ω · cm) | Intensity of magnet-ization ($Am^2/kg$) | True specific gravity ($g/cm^3$) | Type of core | Peak pore size from 0.1 to 3.0 μm (μm) | Total pore volume from 0.1 to 3.0 μm (ml/kg) | Electric field intensity just before break-down (V/cm) |
|---|---|---|---|---|---|---|---|---|---|
| Porous magnetic core 13 | $(MnO)_{0.350}(MgO)_{0.050}(Fe_2O_3)_{0.600}$ | 39.9 | $3.5 \times 10^6$ | 58 | 4.87 | Porous | 1.4 | 0.100 | 432 |
| Porous magnetic core 14 | $(MnO)_{0.350}(MgO)_{0.050}(Fe_2O_3)_{0.600}$ | 38.5 | $2.0 \times 10^6$ | 59 | 4.87 | Porous | 0.8 | 0.043 | 404 |
| Porous magnetic core 15 | $(Li_2O)_{0.140}(MgO)_{0.070}(CaO)_{0.030}(Fe_2O_3)_{0.760}$ | 40.6 | $2.4 \times 10^7$ | 51 | 4.69 | Porous | 0.4 | 0.040 | 582 |
| Porous magnetic core 16 | $(MnO)_{0.350}(MgO)_{0.130}(SrO)_{0.010}(Fe_2O_3)_{0.510}$ | 36.3 | $7.1 \times 10^7$ | 55 | 4.85 | Porous | 0.8 | 0.060 | 5770 |
| Magnetic core 17 | $(CuO)_{0.250}(ZnO)_{0.200}(Fe_2O_3)_{0.550}$ | 36.5 | $1.8 \times 10^8$ | 54 | 5.01 | Aggregated | — | — | Not break-down up to 10000 V/cm |
| Magnetic core 18 | Magnetite + hematite + resin | 35.2 | $2.7 \times 10^{12}$ | 41 | 3.52 | Magnetic material dispersed | — | — | Not break-down up to 10000 V/cm |
| Porous magnetic core 19 | $(MnO)_{0.350}(MgO)_{0.050}(Fe_2O_3)_{0.600}$ | 37.1 | $8.5 \times 10^5$ | 60 | 4.87 | Porous | 1.0 | 0.059 | 340 |

Production Example of Magnetic Carrier 16

| | |
|---|---|
| Silicone varnish (KR255 manufactured by Shin-Etsu Chemical Co., Ltd.) (Solid content: 20 mass %) | 40.0 parts by mass |
| N-β(aminoethyl) γ-aminopropyltrimethoxysilane | 0.8 part by mass |
| Toluene | 59.2 parts by mass |

The above materials were mixed together to obtain resin solution 6.

100 parts by mass of porous magnetic core 10 was placed in a stirring vessel of a mixture stirrer (versatile stirrer NDMV type manufactured by Dalton Co., Ltd.) and nitrogen gas was introduced thereinto while decompressing the inside of the stirring vessel. Stirring was conducted by rotating the stirring blade at 100 rotations per minute while heating to a temperature of 50° C. Then, the resin solution 6 was added to the stirring vessel, and porous magnetic core and resin solution 6 were mixed together. The temperature was elevated to 70° C. and the mixture was continuously heated and stirred for two hours. The solvent was removed, and the core particles of porous magnetic core 10 were filled with a silicone resin composition having a silicone resin obtained from resin solution 6. After cooling, the obtained magnetic carrier particles were moved to a mixer (drum mixer type UD-AT manufactured by Sugiyama Heavy Industrial Co., Ltd.) having a spiral blade in a rotatable mixing vessel and heat-treated at a temperature of 200° C. in a nitrogen atmosphere for 2 hours while rotating the mixing vessel twice a minute to perform stirring. The obtained magnetic carrier particles were classified through a sieve having an opening size of 70 μm and a magnetic carrier with a resin filling amount of 8.0 parts by mass based on 100 parts by mass of porous magnetic core 10 was obtained.

| | |
|---|---|
| Silicone varnish (KR255 manufactured by Shin-Etsu Chemical Co., Ltd.) (Solid content: 20 mass %) | 5.0 parts by mass |
| N-β (aminoethyl)γ-aminopropyltrimethoxysilane | 0.2 part by mass |
| Toluene | 10.0 parts by mass |

The above materials were mixed together to obtain a resin solution 7.

Subsequently, 100 parts by mass of a magnetic carrier filled with a silicone resin composition were cast into a planetary mixer (NAUTA MIXER model VN manufactured by Hosokawa Micron Corporation). The screw-like stirring blade was revolved 3.5 times per minute and rotated 100 times per minute for stirring. A nitrogen flow was passed through at a flow rate of 0.1 $m^3$/min and the temperature was elevated to 70° C. to further remove toluene so that reduced pressure (about 0.01 MPa) could be attained. ⅓ mass of resin solution 7 relative to the magnetic carrier was cast and an operation for removing toluene and a coating operation were performed for 20 minutes. Subsequently, ⅓ mass of the resin solution was cast and an operation for removing toluene and a coating operation were further performed for 20 minutes and ⅓ mass of the resin solution was cast and an operation for removing toluene and a coating operation were further performed for 20 minutes. The coating amount was 1.0 part by mass based on 100 parts by mass of the magnetic carrier. Then, the obtained magnetic carrier was moved to a mixer (drum mixer type UD-AT manufactured by Sugiyama Heavy Industrial Co., Ltd.) having a spiral blade in a rotatable mixing vessel and heat-treated at a temperature of 200° C. in a nitrogen atmosphere for 2 hours while rotating the mixing vessel 10 times per minute to perform stirring. The partial exposure condition of the core particles on the surfaces of the magnetic carrier particles was controlled by stirring. After this step, there was no substantial change in the amount of the coating resin.

The obtained magnetic carrier was classified with a sieve having an opening size of 70 μm to obtain magnetic carrier 16.

The physical properties of the obtained magnetic carrier 16 are shown in Table 10.

Production Examples of Magnetic Carrier 17, Magnetic Carrier 18, Magnetic Carrier 22 and Magnetic Carrier 28 (Comparative Example)

In the production example of magnetic carrier 16, resin solution 6 was added so that the filling resin ingredient based on 100 parts by mass porous each of magnetic core 11 (for magnetic carrier 17), porous magnetic core 12 (for magnetic carrier 18), porous magnetic core 14 (for magnetic carrier 22) and porous magnetic core 19 (for magnetic carrier 28) instead of porous magnetic core 10 were 16.0 parts by mass, 17.0 parts by mass, 5.0 parts by mass and 8.0 parts by mass, respectively, to obtain magnetic carriers filled with a resin. Furthermore, 1.0 part by mass, 1.0 part by mass, 0.5 part by mass and 1.0 part by mass of resin solution based on 100 parts by mass of a magnetic carrier filled with a resin, as a coating resin ingredient were used for coating to obtain magnetic carrier 17, magnetic carrier 18, magnetic carrier 22 and magnetic carrier 28 (Comparative Example), respectively, in the same way as in magnetic carrier 16.

The physical properties of the obtained magnetic carriers 17, 18, 22 and 28 are shown in Table 10.

Production Example of Magnetic Carrier 19

100 parts by mass of the magnetic carrier filled with a silicone resin composition prepared in the section of magnetic carrier 16 were placed in a fluid bed coating apparatus (Spiralflow SFC type manufactured by Freund Corporation) and nitrogen gas in an aeration rate of 0.8 $m^3$/min was introduced and the aeration temperature was a temperature of 75° C. The number of rotation of the rotary rotor was 1000 times per minute, and when the magnetic carrier temperature reached a temperature of 50° C., spraying was started using resin solution 7. The spraying rate was 3.5 g/min. Coating was performed until the amount of coating resin became 0.5 part by mass.

Furthermore, a magnetic carrier 19 was obtained in the same way as in magnetic carrier 16 except that the revolution number of the mixer having a spiral blade was 10 times per minute. The partial exposed condition of the core particles on the surface of the magnetic carrier particles was controlled by changing the stirring number of revolutions of the mixer having a spiral blade.

The physical properties of the obtained magnetic carrier 19 are shown in Table 10.

Production Example of Magnetic Carrier 20

| | |
|---|---|
| Silicone varnish (KR255 manufactured by Shin-Etsu Chemical Co., Ltd.) (Solid content: 20 mass %) | 40.0 parts by mass |
| N-β(aminoethyl) γ-aminopropyltrimethoxysilane | 1.6 parts by mass |
| Toluene | 58.4 parts by mass |

The above materials were mixed together to obtain resin solution 8.

100 parts by mass of porous magnetic core 10 were placed in an indirect heating type dryer (SOLID AIR SJ type manufactured by Hosokawa Micron Corporation), nitrogen gas was introduced in an air flow rate of 0.1 $m^3$/min and the paddle blade was rotated 100 times per minute for stirring while heating to a temperature of 70° C. Resin solution 8 was dropwise added until 7.0 parts by mass of resin filling amount was attained. Heating and stirring were continued for 1 hour, and after toluene was removed, a silicone resin composition which had silicone resin obtained from resin solution 8 was filled in the core particles of porous magnetic core 10. After cooling, the obtained magnetic carrier was moved to a mixer (drum mixer type UD-AT manufactured by Sugiyama Heavy Industrial Co., Ltd.) having a spiral blade in a rotatable mixing vessel and heat-treated at a temperature of 200° C. in a nitrogen atmosphere for 2 hours while rotating the mixing vessel 10 times per minute to perform stirring. The partial exposure condition of the core particles on the surface of the magnetic carrier particles was controlled by stirring. The obtained magnetic carrier particle was classified with a sieve having an opening size of 70 μm to obtain magnetic carrier 20 having a resin filling amount of 7.0 parts by mass based on 100 parts by mass of porous magnetic core 10.

The physical properties of the obtained magnetic carrier 20 are shown in Table 10.

Production Example of Magnetic Carrier 21

| | |
|---|---|
| Silicone varnish (KR5208 manufactured by Shin-Etsu Chemical Co., Ltd.) (Solid content: 20 mass %) | 90.0 parts by mass |
| Toluene | 180.0 parts by mass |

The above materials were mixed together to obtain resin solution 9.

In the production example of magnetic carrier 16, filling was performed in the same way as in the production example of magnetic carrier 16 using porous magnetic core 13 instead of porous magnetic core 10 and using resin solution 9 instead of resin solution 6 so that the resin filling amount was 18.0 parts by mass.

| | |
|---|---|
| Silicone varnish (KR5208 manufactured by Shin-Etsu Chemical Co., Ltd.) (Solid content: 20 mass %) | 5.0 parts by mass |
| N-β (aminoethyl)γ-aminopropyltrimethoxysilane | 0.2 part by mass |
| Toluene | 10.0 parts by mass |

The above materials were mixed together to obtain resin solution 10. The obtained filled particles were coated in a coating amount of 1.0 part by mass in the same way as in the production example of magnetic carrier 16 to obtain magnetic carrier 21.

The physical properties of the obtained magnetic carrier 21 are shown in Table 10.

Production Example of Magnetic Carrier 23

| | |
|---|---|
| Polymethyl methacrylate copolymer (Mw = 68,000) | 7.0 parts by mass |
| Toluene | 140.0 parts by mass |

The above materials were mixed together to obtain resin solution 11.

In the production example of magnetic carrier 16, filling was performed in the same way as in the production example of magnetic carrier 16 using porous magnetic core 15 instead of porous magnetic core 10 with and using resin solution 11 instead of resin solution 6 so that the resin filling amount was 7.0 parts by mass.

| | |
|---|---|
| Polymethyl methacrylate copolymer (Mw = 68,000) | 1.0 part by mass |
| Bontron P-51 (manufactured by Orient Chemical Industries Co., Ltd.) | 0.1 part by mass |
| Toluene | 10.0 parts by mass |

The above materials were mixed together and dissolved to obtain resin solution 12. The obtained filled particles were coated in a coating amount of 1.0 part by mass in the same way as in the production example of magnetic carrier 16 to obtain magnetic carrier 23.

The physical properties of the obtained magnetic carrier 23 are shown in Table 10.

Production Example of Magnetic Carrier 24

In the production example of magnetic carrier 16, filling was performed in the same way as in the production example of magnetic carrier 16.

| | |
|---|---|
| Silicone varnish (KR255 manufactured by Shin-Etsu Chemical Co., Ltd.) (Solid content: 20 mass %) | 5.0 part by mass |
| γ-aminopropyltrimethoxysilane | 0.2 part by mass |
| Toluene | 10.0 parts by mass |

The above materials were mixed together to obtain resin solution 13.

100 parts by mass of the magnetic carrier filled with a silicone resin composition were coated in a coating amount of 1.0 part by mass of resin solution in the same way as in the production example of magnetic carrier 16 to obtain magnetic carrier 24.

The physical properties of the obtained magnetic carrier 24 are shown in Table 10.

Production Example of Magnetic Carrier 25 (Comparative Example)

In the production example of magnetic carrier 16, porous magnetic core 10 was replaced with porous magnetic core 16 and resin solution 6 was added so that the resin ingredient was 8.0 parts by mass based on 100 parts by mass of porous magnetic core 16 to obtain a magnetic carrier filled with a silicone resin composition. 100 parts by mass of the magnetic carrier filled with a silicone resin composition were placed in a fluid bed coating apparatus (Spiralflow SFC type manufactured by Freund Corporation) and nitrogen in an aeration rate of 0.8 $m^3$/min was introduced and the aeration temperature was a temperature of 75° C. The number of rotation of the rotary rotor was 1000 times per minute, and when the product temperature reached a temperature of 50° C., spraying was started using resin solution 7. The spraying rate was 3.5 g/min. Coating was performed until the amount of coating resin became 1.0 part by mass.

Furthermore, magnetic carrier 25 (Comparative Example) was obtained in the same way as in magnetic carrier 10 except that the revolution number of the mixer having a spiral blade was 1.5 times per minute. The surfaces of the core particles were not allowed to be exposed to the surfaces of the magnetic carrier particles by changing the stirring number of revolutions of the mixer having a spiral blade. The physical properties of the obtained magnetic carrier 25 are shown in Table 10.

Production Examples of Magnetic Carrier 26 (Comparative Example) and Magnetic Carrier 27 (Comparative Example)

Porous magnetic core 10 was replaced with magnetic core 17 (for magnetic carrier 26) and 17 (for magnetic carrier 27), and without the filling step, using resin solution 7, coating in coating amounts of 0.5 part by mass and 0.5 part by mass, respectively, was performed in the same way as in the production example of magnetic carrier 16 to obtain magnetic carriers 26 and 27.

The physical properties of the obtained magnetic carriers 26 (Comparative Example) and 27 (Comparative Example) are shown in Table 10.

Production Example of Magnetic Carrier 29 (Comparative Example)

In the production example of magnetic carrier 25, filling was performed in the same way as in the production example of magnetic carrier 25 (filling amount of 8.0 parts by mass).

Subsequently, 100 parts by mass of the magnetic carrier filled with a silicone resin composition were coated in a coating amount of 1.0 part by mass of resin solution 13 instead of resin solution 7 in the same way as in the production example of magnetic carrier 25.

Furthermore, magnetic carrier 29 (Comparative Example) was obtained in the same way as in magnetic carrier 16 except that the revolution number of the mixer having a spiral blade was 1.5 times per minute. The surfaces of the core particles were not allowed to be exposed to the surfaces of the magnetic carrier particles by changing the stirring number of revolutions of the mixer having a spiral blade.

The physical properties of the obtained magnetic carrier 29 are shown in Table 10.

TABLE 10

| | Magnetic core | Resin solution | Filling amount (mass part) | Resin solution | Coating amount (mass part) | D50 (μm) | Resistivity at 1000 V/cm (Ω · cm) | Resistivity at 2000 V/cm (Ω · cm) | Intensity of magnetization ($Am^2$/kg) | True specific gravity ($g/cm^3$) | Electric field intensity just before break-down (V/cm) |
|---|---|---|---|---|---|---|---|---|---|---|---|
| Magnetic carrier 16 | Porous magnetic core 10 | 6 | 8.0 | 7 | 1.0 | 36.9 | $1.9 \times 10^7$ | $6.6 \times 10^6$ | 52 | 3.98 | 2060 |
| Magnetic carrier 17 | Porous magnetic core 11 | 6 | 16.0 | 7 | 1.0 | 36.0 | $4.0 \times 10^7$ | $1.8 \times 10^7$ | 48 | 3.52 | 3130 |
| Magnetic carrier 18 | Porous magnetic core 12 | 6 | 17.0 | 7 | 1.0 | 36.3 | $7.2 \times 10^7$ | $3.4 \times 10^7$ | 47 | 3.5 | 3160 |
| Magnetic carrier 19 | Porous magnetic core 10 | 6 | 8.0 | 7 | 0.5 | 37.6 | $1.5 \times 10^9$ | $2.6 \times 10^7$ | 53 | 3.99 | 2650 |

TABLE 10-continued

| | Magnetic core | Resin solution | Filling amount (mass part) | Resin solution | Coating amount (mass part) | D50 (μm) | Resistivity at 1000 V/cm (Ω · cm) | Resistivity at 2000 V/cm (Ω · cm) | Intensity of magnet-ization ($Am^2/kg$) | True specific gravity ($g/cm^3$) | Electric field intensity just before break-down (V/cm) |
|---|---|---|---|---|---|---|---|---|---|---|---|
| Magnetic carrier 20 | Porous magnetic core 10 | 8 | 7.0 | — | — | 38.2 | $1.9 \times 10^7$ | Break-down | 53 | 4.03 | 1850 |
| Magnetic carrier 21 | Porous magnetic core 13 | 9 | 18.0 | 10 | 1.0 | 41.3 | $7.3 \times 10^8$ | $3.8 \times 10^8$ | 49 | 3.48 | 4970 |
| Magnetic carrier 22 | Porous magnetic core 14 | 6 | 5.0 | 7 | 0.5 | 39.8 | $6.2 \times 10^6$ | Break-down | 56 | 4.19 | 1310 |
| Magnetic carrier 23 | Porous magnetic core 15 | 11 | 7.0 | 12 | 1.0 | 42.5 | $1.2 \times 10^9$ | $8.9 \times 10^7$ | 47 | 4.01 | 3980 |
| Magnetic carrier 24 | Porous magnetic core 10 | 6 | 8.0 | 13 | 1.0 | 37.1 | $1.2 \times 10^7$ | $4.5 \times 10^6$ | 51 | 3.97 | 2080 |
| Magnetic carrier 25 | Porous magnetic core 16 | 6 | 8.0 | 7 | 1.0 | 37.0 | $6.0 \times 10^{11}$ | $2.5 \times 10^{11}$ | 50 | 3.99 | 8520 |
| Magnetic carrier 26 | Magnetic core 17 | — | — | 7 | 0.5 | 36.5 | $4.5 \times 10^8$ | $2.0 \times 10^8$ | 54 | 4.98 | Not break-down up to 10000 V/cm |
| Magnetic carrier 27 | Magnetic core 18 | — | — | 7 | 0.5 | 35.5 | $2.5 \times 10^{12}$ | $1.7 \times 10^{12}$ | 41 | 3.5 | Not break-down up to 10000 V/cm |
| Magnetic carrier 28 | Porous magnetic core 19 | 6 | 8.0 | 7 | 1.0 | 39.0 | Break-down | Break-down | 55 | 3.95 | 940 |
| Magnetic carrier 29 | Porous magnetic core 16 | 6 | 8.0 | 13 | 1.0 | 37.1 | $3.3 \times 10^{11}$ | $6.0 \times 10^{10}$ | 50 | 3.98 | 7920 |

Production Example of Cyan Toner 5

As materials to obtain a vinyl copolymer unit, 10 parts by mass of styrene, 5 parts by mass of 2-ethylhexyl acrylate, 2 parts by mass of fumaric acid, 5 parts by mass of α-methylstyrene dimer and 5 parts by mass of dicumyl peroxide were placed in a dripping funnel. As materials to obtain a polyester polymer unit, 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 9 parts by mass of terephthalic acid, 5 parts by mass of trimellitic anhydride, 24 parts by mass of fumaric acid and 0.2 parts by mass of tin 2-ethyl hexanoate were placed in a 4-liter four-necked glass flask. This four-necked flask is equipped with a thermometer, a stirrer, a condenser and a nitrogen introduction pipe and placed in a mantle heater. Then, the air inside the four-necked flask was replaced with nitrogen gas and the temperature was gradually elevated while stirring the mixture therein. The vinyl monomer and a polymerization initiator were added dropwise thereto from the dripping funnel for about 4 hours at a temperature of 130° C. under stirring. Then the temperature was elevated to 200° C. and the mixture was allowed to react for 4 hours to obtain a hybrid resin B having a weight average molecular weight of 76,000, a number average molecular weight of 3900 and a Tg of 61° C.

<Production of Cyan Masterbatch>

Hybrid resin B 60.0 parts by mass

Cyan pigment (PigmentBlue 15: 3) 40.0 parts by mass

At first, the above raw materials were placed in a kneader type mixer and heated under non-pressurization and under mixing. After the resultant mixture was melt kneaded at a temperature of 90 to 110° C. for 30 minutes, the mixture was cooled and crushed in a pin mill to about 1 mm to prepare a cyan masterbatch.

<Production of Cyan Toner>

| | |
|---|---|
| Hybrid resin B | 92.6 parts by mass |
| Refined paraffin wax (largest endotherm peak: 70° C.) | 5.3 parts by mass |
| Cyan masterbatch (coloring agent: 40 mass %) | 24.1 parts by mass |
| Aluminum compound of di-tert-butylsalicylic acid | 1.1 parts by mass |

The above materials were mixed together in a HENSCHEL MIXER preliminarily, and melt kneaded with a twin-screw extruder so that the temperature of the kneaded product was 150° C. (temperature at the outlet of the apparatus set at 120° C.) and, after cooling, the extruded product was crushed with a hammer mill to about 1 to 2 mm Then the hammer shape was changed and a roughly pulverized product of about 0.3 mm was prepared with the hammer mill having a smaller mesh. Then, a moderately pulverized product of around 11 um was made with a turbo mill (RS rotor/SNB liner) manufactured by Turbo Kogyo Co., Ltd. Furthermore, the moderately pulverized product was pulverized to around 7 μm using a turbo mill (RSS rotor/SNNB liner) manufactured by Turbo Kogyo Co., Ltd. and a finely pulverized product of around 5 μm was prepared using a turbo mill (RSS rotor/SNNB liner) again. Then, classification and conglobation were performed using a particle design apparatus (product name: FACULTY) manufactured by Hosokawa Micron Corporation having an improved shape and number of hammers to obtain cyan toner particles having a weight average particle size (D4) of 5.9 μm and an average circularity of 0.961.

To 100 parts by mass of the obtained cyan toner particles were added 1.0 part by mass of silica particles treated with hexamethyldisilazane and having an average particle size in the number-based distribution of 110 nm and a hydrophobicity of 85%, 0.9 part by mass of titanium oxide particles having an average particle size in the number-based distribution of 50 nm and a hydrophobicity of 68% and 0.5 part by mass of dimethyl silicone oil treated silica particles having an average particle size in the number-based distribution of 20 nm and a hydrophobicity of 90%. Then, these are mixed together in a HENSCHEL MIXER (manufactured by Mitsui Miike Kakoki Co., Ltd.) to obtain cyan toner 5 having a weight average particle size of 6.0 μm and an average circularity of 0.960. The particles have one local maximum at 110 nm in the particle size distribution in the number-based distribution. The physical properties of the obtained cyan toner 5 are shown in Table 11B.

Production Example of Magenta Toner 2

<Production of Magenta Masterbatch>

| | |
|---|---|
| Hybrid resin B | 60.0 parts by mass |
| Magenta color pigment (PigmentRed-57) | 20.0 parts by mass |
| Magenta color pigment (PigmentRed-122) | 20.0 parts by mass |

The above materials were melt kneaded in a kneader mixer in the same way as in the cyan masterbatch to prepare a magenta masterbatch.

<Production of Magenta Toner>

Magenta toner 2 was prepared in the same way as in production example of cyan toner 5 except that the formulation was changed to that of magenta toner 2 as shown in Table 11A.

The physical properties of the obtained magenta toner 2 are shown in Table 11B.

Production Example of Yellow Toner 2

<Production of Yellow Masterbatch>

| | |
|---|---|
| Hybrid resin B | 60.0 parts by mass |
| Yellow color pigment (PigmentYellow-155) | 40.0 parts by mass |

The above materials were melt kneaded in a kneader mixer in the same way as the cyan masterbatch to prepare a yellow masterbatch.

<Production of Yellow Toner>

Yellow toner 2 was prepared in the same way as in production example of cyan toner 5 except that the formulation was changed to that of yellow toner 2 as shown in Table 11A.

The physical properties of the obtained yellow toner 2 are shown in Table 11B.

Production Example of Black Toner 2

<Production of Black Masterbatch>

| | |
|---|---|
| Hybrid resin B | 60.0 parts by mass |
| Carbon black pigment (Printex35 manufactured by Degussa AG) | 40.0 parts by mass |

The above materials were melt kneaded in a kneader mixer in the same way as the cyan masterbatch to prepare a black masterbatch.

<Production of Black Toner>

Black toner 2 was prepared in the same way as in production example of cyan toner 5 except that the formulation was changed to that of black toner 2 as shown in Table 11A.

The physical properties of the obtained black toner 2 are shown in Table 11B.

Production Example of Cyan Toner 6

<Production of Cyan Toner>

Cyan toner 6 was prepared in the same way as in production example of cyan toner 5 except that the formulation was changed to that of cyan toner 6 as shown in Table 11A.

The physical properties of the obtained cyan toner 6 are shown in Table 11B.

Production Example of Cyan Toner 7

| | |
|---|---|
| 600 parts by mass of a 0.10 mol/liter $Na_3PO_4$ aqueous solution were cast into 500 parts by mass of ion-exchange water and after warmed to a temperature of 60° C., the resultant mixture was stirred with a TK type homomixer (manufactured by Tokushu Kika Kogyo Co., Ltd.) at 10,000 $m^{-1}$. 93 parts by mass of a 1.0 mol/liter $CaCl_2$ aqueous solution were added slowly thereto to obtain an aqueous medium containing $Ca_3(PO_4)_2$. | |
| Styrene | 162.0 parts by mass |
| N-butyl acrylate | 38.0 parts by mass |
| Ester wax (behenyl behenate: maximum endothermic peak temperature 78° C.) | 20.0 parts by mass |
| Aluminum compound of di-tert-butylsalicylic acid | 1.0 part by mass |
| Saturated polyester (terephthalic acid-propylene oxide modified bisphenol A; acid value, 15 mgKOH/g; peak molecular weight, 6000) | 10.0 parts by mass |
| Cyan pigment (PigmentBlue 15: 3) | 13.0 parts by mass |

The above materials were warmed to a temperature of 60° C. and uniformly dissolved or dispersed with a TK-type homomixer (manufactured by Tokushu Kika Kogyo Co., Ltd.) at 10,000 rpm. 8 parts by mass of 2,2'-azobis(2,4-dimethylvaleronitrile), a polymerization initiator, were dissolved therein to prepare a monomer composition.

The above monomer composition was cast in the above aqueous medium, and the resultant mixture was stirred with a TK type homomixer at 12,000 rpm in a nitrogen atmosphere at a temperature of 60° C. for 10 minutes and the monomer composition was granulated. Then the temperature was elevated to 80° C. and the mixture was allowed to react for 10 hours under stirring with a paddle mixing impeller. After the polymerization reaction ended, the remaining monomer was evaporated under reduced pressure. After cooling, hydrochloric acid was added to the reaction product to dissolve $Ca_3(PO_4)_2$. Filtration, washing with water and drying were performed to obtain cyan toner particles having a weight average particle size (D4) of 5.7 μm and an average circularity of 0.982. These particles had a weight average molecular weight of 62,000, a number average molecular weight of 20,000 and a Tg of 58° C.

To 100 parts by mass of the obtained cyan toner particles were added 1.5 parts by mass of silica particles treated with hexamethyldisilazane and having an average particle size in the number-based distribution of 90 nm and a hydrophobicity of 80%, 0.8 part by mass of titanium oxide particles having an average particle size in the number-based distribution of 40 nm and a hydrophobicity of 60% and 1.3 parts by mass of dimethyl silicone oil treated silica particles having a maximum peak particle size in the number-based distribution of 30 nm and a hydrophobicity of 85%. Then, these are mixed together in a HENSCHEL MIXER (manufactured by Mitsui Miike Kakoki Co., Ltd.) to obtain cyan toner 7 having a weight average particle size (D4) of 5.8 μm and an average circularity of 0.980. The particles had one local maximum at 90 nm in the particle size distribution in the number-based distribution. The physical properties of the obtained cyan toner 7 are shown in Table 11B.

TABLE 11A

| | Binder resin | | Coloring agent Masterbatch | | Coloring agent | | Purified Paraffin wax | Aluminum compound of di-tert-butylsalicylic acid | Silica particle | Titanium oxide particle | Dimethyl silicone oil treated silica particle |
|---|---|---|---|---|---|---|---|---|---|---|---|
| Cyan toner 5 | Hybrid resin B | 92.6 mass parts | Cyan masterbatch | 24.1 mass parts | — | — | 5.3 mass parts | 1.1 mass parts | 110 nm 1.0 mass parts | 50 nm 0.9 mass parts | 20 nm 0.5 mass parts |
| Magenta toner 2 | Hybrid resin B | 88.3 mass parts | Magenta masterbatch | 45.0 mass parts | — | — | 5.7 mass parts | 1.1 mass parts | 110 nm 1.0 mass parts | 50 nm 0.9 mass parts | 20 nm 0.5 mass parts |
| Yellow toner 2 | Hybrid resin B | 89.5 mass parts | Yellow masterbatch | 39.7 mass parts | — | — | 5.7 mass parts | 1.1 mass parts | 110 nm 1.0 mass parts | 50 nm 0.9 mass parts | 20 nm 0.3 mass parts |
| Black toner 2 | Hybrid resin B | 92.6 mass parts | Black masterbatch | 24.1 mass parts | P.B15:3 | 2.0 mass parts | 5.3 mass parts | 1.1 mass parts | 110 nm 1.0 mass parts | 50 nm 0.8 mass parts | 20 nm 0.6 mass parts |
| Cyan toner 6 | Hybrid resin B | 100.0 mass parts | — | — | P.B15:3 | 5.5 mass parts | 5.0 mass parts | 1.0 mass parts | 110 nm 1.0 mass parts | 50 nm 0.9 mass parts | 20 nm 0.5 mass parts |

TABLE 11B

| | Toner particle | | Toner | | |
|---|---|---|---|---|---|
| | Weight average particle size D4 (μm) | Average circularity | Weight average particle size D4 (μm) | Particle size (nm) of externally added inorganic particles at the local maximum in range of 80 to 200 nm | Average circularity |
| Cyan toner 5 | 5.9 | 0.961 | 6.0 | 110 | 0.960 |
| Cyan toner 6 | 5.9 | 0.962 | 5.9 | 110 | 0.961 |
| Cyan toner 7 | 5.7 | 0.982 | 5.8 | 90 | 0.980 |
| Magenta toner 2 | 5.9 | 0.961 | 5.9 | 110 | 0.960 |
| Yellow toner 2 | 5.8 | 0.964 | 5.9 | 110 | 0.964 |
| Black toner 2 | 6.1 | 0.960 | 6.2 | 110 | 0.959 |

Example 12

8 parts by mass of cyan toner 5 were added to 92 parts by mass of magnetic carrier 16 and shaken in a V-type mixer for 10 minutes to prepare a two-component developer. The results of performing the following evaluation using this two-component developer are shown in Table 12.

As an image forming apparatus, a digital full color printer (a remodeled version of commercial digital printing printer image PRESS C7000 VP manufactured by Canon Inc.) was used. The above developer was placed at the cyan position in the developing apparatus and image formation was performed in a normal temperature and normal humidity environment (temperature, 23° C.; humidity, 50% RH). Remodeling was performed so that the circumferential speed of developing sleeve relative to the photoconductor drum was 1.5 times; the outlet of the replenishing developer was tightly closed; and only toner was replenished. And alternating voltage having a frequency of 2.0 kHz and Vpp from 0.7 kV to 1.8 kV changeable in increments/decrements of 0.1 kV and a direct current voltage $V_{DC}$ were applied to the developing sleeve to form an electric field in the developing area. The Vpp at which the laid-on toner amount was 0.3 mg/cm$^2$ was determined, and under these conditions, initial evaluation and a 50,000 sheet image output test were conducted using an image of an image ratio of 5%, and evaluation was performed in the same way.

Comparative Examples 9 to 14

A two-component developer was prepared in the same way as in Example 12 except that magnetic carrier 16 was replaced as shown in Table 12. Evaluation was performed using this two-component developer in the same way as in Example 12. The results are shown in Table 12.

Examples 13 to 19

A two-component developer was prepared in the same way as in Example 12 except that magnetic carrier 16 was replaced as shown in Table 12. Evaluation was performed using this two-component developer in the same way as in Example 12. The results are shown in Table 12.

A two-component developer was prepared in the same way as in Example 12 except that magnetic carrier 16 was replaced as shown in Table 2. Evaluation was performed using this two-component developer in the same way as in Example 12. The results are shown in Table 12.

TABLE 12

| | | | | Normal temperature and normal humidity (23° C. 50% RH) initial | | | | | | | | | |
|---|---|---|---|---|---|---|---|---|---|---|---|---|---|
| Example | Magnetic carrier | Toner | Toner density (%) | Charge amount when toner is 8% (mC/kg) | Developing density properties (Vpp) Image density | Blank areas | Roughen-ing | Fine line reproducibility | Fogging | Carrier adhesion | Leak | Gradation characteristics |
| Example 12 | 16 | Cyan 5 | 8 | −60.5 | A (1.2 kV) 1.52 | A 10 | A 2.2 | A 3 μm | A 0.2 | A 0 | A 0 | A |
| Comparative Example 9 | 25 | Cyan 5 | 8 | −63.3 | C (1.8 kV) 1.51 | D 370 | A 2.6 | A 6 μm | A 0.2 | A 2 | A 0 | B |
| Comparative Example 10 | 26 | Cyan 5 | 8 | −55.2 | C (1.8 kV) 1.53 | C 280 | D 8.0 | B 11 μm | C 1.2 | A 0 | A 0 | C |
| Comparative Example 11 | 27 | Cyan 5 | 8 | −55.9 | D (>1.8 kV) 0.30 mg/cm$^2$ not attained | D 1250 | A 1.2 | A 3 μm | A 0.2 | B 4 | A 0 | B |
| Comparative Example 12 | 28 | Cyan 5 | 8 | −51.1 | A (1.2 kV) 1.52 | A 10 | D 8.1 | A 6 μm | C 1.8 | D 23 | D 32 | D |
| Comparative Example 13 | 14 | Cyan 5 | 8 | −62.5 | D (>1.8 kV) 0.30 mg/cm$^2$ not attained | D 1400 | A 2.2 | A 6 μm | B 0.6 | B 7 | A 0 | D |
| Comparative Example 14 | 15 | Cyan 5 | 8 | −53.7 | C (1.8 kV) 1.50 | D 340 | C 6.3 | C 16 μm | C 1.7 | D 22 | B 1 | C |
| Example 13 | 17 | Cyan 5 | 8 | −62.7 | A (1.3 kV) 1.51 | B 60 | A 0.9 | A 3 μm | A 0.2 | B 4 | A 0 | A |
| Example 14 | 18 | Cyan 5 | 8 | −58.8 | A (1.3 kV) 1.52 | B 80 | A 0.8 | A 3 μm | A 0.2 | B 5 | A 0 | A |
| Example 15 | 19 | Cyan 7 | 8 | −58.5 | A (1.3 kV) 1.51 | A 20 | A 2.2 | B 7 μm | B 0.5 | A 2 | A 0 | A |
| Example 16 | 20 | Cyan 5 | 8 | −56.6 | A (1.3 kV) 1.51 | A 10 | A 3.0 | A 5 μm | A 0.4 | B 5 | A 0 | B |
| Example 17 | 21 | Cyan 5 | 8 | −61.9 | B (1.4 kV) 1.52 | B 90 | A 1.5 | A 5 μm | B 0.7 | C 11 | A 0 | A |
| Example 18 | 22 | Cyan 5 | 8 | −47.0 | A (1.2 kV) 1.53 | A 10 | B 4.5 | B 7 μm | C 1.0 | A 3 | C 17 | B |
| Example 19 | 23 | Cyan 5 | 8 | −41.5 | A (1.1 kV) 1.53 | A 30 | B 4.0 | B 7 μm | C 1.0 | A 3 | B 1 | A |

| | Normal temperature and normal humidity (23° C. 50% RH) after 50000 sheets printing | | | | | | | | | | |
|---|---|---|---|---|---|---|---|---|---|---|---|
| Example | Charge amount when toner density is 8% (mC/kg) | Developing properties (Vpp) Image density | Blank areas | Roughen-ing | Fine line reproducibility | Fogging | Carrier adhesion | Leak | Change in color ΔE | Gradation characteristics | Consumption (g) |
| Example 12 | −59.4 | A (1.2 kV) 1.53 | A 20 | A 3.0 | A 4 μm | A 0.3 | A 1 | A 0 | A 0.7 | A | A 896 |
| Comparative Example 9 | −62.2 | C (1.8 kV) 1.52 | D 430 | A 3.3 | B 9 μm | B 0.7 | A 3 | B 1 | B 1.9 | C | A 930 |
| Comparative Example 10 | −49.8 | C (1.8 kV) 1.51 | D 450 | D 11.3 | B 11 μm | D 3.9 | A 1 | A 0 | D 6.0 | C | A 941 |

TABLE 12-continued

| | | | | | | | | | | | |
|---|---|---|---|---|---|---|---|---|---|---|---|
| Comparative Example 11 | −55.2 | D (>1.8 kV) 0.30 mg/cm$^2$ not attained | D 1230 | A 1.8 | A 3 μm | A 0.3 | B 4 | A 0 | B 1.5 | B | Predetermined image density was not attained and evaluation not performed |
| Comparative Example 12 | −50.9 | A (1.2 kV) 1.51 | A 10 | D 8.9 | B 7 μm | D 2.3 | C 17 | D 53 | A 1.1 | E | A 952 |
| Comparative Example 13 | −63.0 | D (>1.8 kV) 0.30 mg/cm$^2$ not attained | D 1300 | A 3.4 | B 11 μm | B 0.8 | B 5 | A 0 | D 6.1 | D | Predetermined image density was not attained and evaluation not performed |
| Comparative Example 14 | −50.4 | C (1.6 kV) 1.50 | D 310 | C 7.4 | C 19 μm | D 3.3 | C 16 | B 2 | B 2.6 | C | A 966 |
| Example 13 | −6.19 | A (1.3 kV) 1.50 | B 60 | A 1.3 | A 4 μm | A 0.2 | B 4 | A 0 | A 0.8 | A | A 908 |
| Example 14 | −58.0 | B (1.4 kV) 1.53 | B 0 | A 1.2 | A 5 μm | A 0.4 | B 4 | A 0 | A 0.8 | A | A913 |
| Example 15 | −56.5 | A (1.3 kV) 1.53 | A 20 | A 2.8 | B 8 μm | B 0.6 | A 2 | A 0 | A 1.4 | A | A 920 |
| Example 16 | −56.0 | B (1.3 kV) 1.53 | A 10 | B 4.1 | B 7 μm | B 0.6 | B 4 | A 0 | B 2.4 | B | A 915 |
| Example 17 | −59.8 | B (1.5 kV) 1.53 | B 120 | A 3.5 | A 6 μm | B 0.9 | C 15 | A 0 | B 2.0 | A | A 910 |
| Example 18 | −46.3 | A (1.2 kV) 1.52 | A 20 | C 6.0 | B 8 μm | C 1.0 | A 3 | C 19 | C 3.0 | C | A 932 |
| Example 19 | −40.7 | A (1.2 kV) 1.53 | A 50 | B 5.1 | B 7 μm | C 1.2 | A 3 | B 3 | C 4.7 | A | A 940 |

Example 20

In Example 12, magnetic carrier 16 was replaced with magnetic carrier 24 and cyan toner 5 was replaced with cyan toner 6, and 8 parts by mass of the latter were added to 92 parts by mass of the former to prepare a two-component developer. This two-component developer was used and as an image forming apparatus, a digital full color printer (a remodeled version of commercial digital printing printer image PRESS C7000 VP manufactured by Canon Inc.) was used. The remodeling points were the same as in Example 12. Alternating voltage having a frequency of 2.0 kHz and Vpp from 0.7 kV to 1.8 kV changeable in increments/decrements of 0.1 kV and a direct current voltage $V_{DC}$ were applied to the developing sleeve to form an electric field in the developing area. The Vpp at which the laid-on toner amount was 0.6 mg/cm$^2$ was determined, and under these conditions, initial evaluation and a durability test were performed. The contrast electric potential was fixed to 300 V, and the other evaluation was performed in the same way as in Example 12.

The results are shown in Table 13.

Comparative Example 15

In Example 12, magnetic carrier 16 was replaced with magnetic carrier 29 and cyan toner 5 was replaced with cyan toner 6, and 8 parts by mass of the latter were added to 92 parts by mass of the former to prepare a two-component developer. This two-component developer was subjected to the same evaluation as in the Example 20. The developing characteristics were in a satisfactory level but produced blank areas. The results are shown in Table 13.

TABLE 13

| | | | | Normal temperature and normal humidity (23° C. 50% RH) initial | | | | | | | | |
|---|---|---|---|---|---|---|---|---|---|---|---|---|
| Example | Magnetic carrier | Toner | Toner density (%) | Charge amount when toner is 8% (mC/kg) | Developing density properties (Vpp) Image density | Blank areas | Roughening | Fine line reproducibility | Fogging | Carrier adhesion | Leak | Gradation characteristics |
| Example 20 | 24 | Cyan 6 | 8 | −32.3 | B (1.4 kV) 1.50 | B 60 | A 3.6 | B 7 μm | B 0.6 | B 4 | A 0 | A |

TABLE 13-continued

| | | | | | | | | | | | | |
|---|---|---|---|---|---|---|---|---|---|---|---|---|
| Comparative Example 15 | 29 | Cyan 6 | 8 | −34.1 | C (1.8 kV) 1.52 | D 360 | A 2.9 | B 7 μm | B 0.6 | A 3 | A 0 | C |

| | Normal temperature and normal humidity (23° C. 50% RH) after 50000 sheets printing | | | | | | | | | | |
|---|---|---|---|---|---|---|---|---|---|---|---|
| Example | Charge amount when toner density is 8% (mC/kg) | Developing properties (Vpp) Image density | Blank areas | Roughening | Fine line reproducibility | Fogging | Carrier adhesion | Leak | Change in color | Gradation characteristics | Consumption (g) |
| Example 20 | −32 | B (1.4 kV) 1.52 | B 60 | B 4.5 | B 7 μm | B 0.6 | B 5 | A 0 | C 3.2 | A | D 1830 |
| Comparative Example 15 | −33.3 | D (>1.8 kV) 0.60 mg/cm$^2$ not attained | D 420 | B 4.1 | B 9 μm | C 1.1 | B 5 | A 0 | C 3.2 | D | Predetermined image density was not attained and evaluation not performed |

Example 21

8 parts by mass each of cyan toner 5, magenta toner 2, yellow toner 2 and black toner 2 were added to 92 parts by mass of magnetic carrier 16 to prepare 4 color two-component developers. Furthermore, 5 parts by mass of a magnetic carrier were mixed with 95 parts by mass of the respective color toners to prepare replenishing developers. These two-component developers were used and as an image forming apparatus, a digital full color printer (a remodeled version of commercial digital printing printer image PRESS C7000 VP manufactured by Canon Inc.) was used. Image formation was performed in a normal temperature normal humidity (23° C., 50% RH) environment. Remodeling was performed so that the circumferential speed of developing sleeve relative to the photoconductor drum was 1.5 times. And alternating voltage having a frequency of 2.0 kHz and Vpp from 0.7 kV to 1.8 kV changeable in increments/decrements of 0.1 kV and a direct current voltage $V_{DC}$ are applied to the developing sleeve. The Vpp at which the laid-on toner amount was 0.3 mg/cm$^2$ was determined, and under these conditions, initial evaluation and a durability test were conducted. The contrast electric potential was fixed to 300 V. A 50,000 sheet image output test was conducted using a full color image of an image ratio of 30% (duty) and as a result, sufficient image density was obtained, image quality and scattering were satisfactory, there were not defects such as blank areas, fogging and carrier adhesion, and good results were obtained. The change in color after the durability test was scarcely observed and the results were good in this point. The results are shown in Table 14.

TABLE 14

| | | | | Normal temperature and normal humidity (23° C. 50% RH) initial | | | | | | | | |
|---|---|---|---|---|---|---|---|---|---|---|---|---|
| Example | Magnetic carrier | Toner | Toner density (%) | Charge amount when toner is 8% (mC/kg) | Developing density properties (Vpp) Image density | Blank areas | Roughening | Fine line reproducibility | Fogging | Carrier adhesion | Leak | Gradation characteristics |
| Example 21 | 16 | Cyan 5 | 8 | −60.4 | A (1.2 kV) 1.53 | A 20 | A 2.2 | A 3 μm | A 0.2 | A 0 | A 0 | A |
| | 16 | Magenta 2 | 8 | −59.2 | A (1.2 kV) 1.53 | A 10 | A 2.5 | A 3 μm | A 0.2 | A 0 | A 0 | A |
| | 16 | Yellow 2 | 8 | −61.7 | A (1.3 kV) 1.54 | A 20 | A 2.2 | A 3 μm | A 0.2 | A 1 | A 0 | A |
| | 16 | Black 2 | 8 | −57.6 | A (1.2 kV) 1.54 | A 10 | B 4.2 | A 4 μm | A 0.4 | A 0 | A 0 | A |

TABLE 14-continued

| Example | Charge amount when toner density is 8% (mC/kg) | Developing properties (Vpp) Image density | Blank areas | Roughening | Fine line reproducibility | Fogging | Carrier adhesion | Leak | Change in color | Gradation characteristics | Consumption (g) |
|---|---|---|---|---|---|---|---|---|---|---|---|
| | Normal temperature and normal humidity (23° C. 50% RH) after 50000 sheets printing | | | | | | | | | | |
| Example 21 | −59.8 | A (1.2 kV) 1.53 | A 20 | A 3.6 | A 3 μm | A 0.3 | A 0 | A 0 | A 0.7 | A | A 906 |
| | −58.9 | A (1.2 kV) 1.54 | A 10 | B 4.0 | A 3 μm | A 0.3 | A 0 | A 0 | A 0.8 | A | A 901 |
| | −61.7 | A (1.3 kV) 1.52 | A 20 | A 3.2 | A 3 μm | A 0.3 | A 0 | A 0 | A 0.8 | A | A 892 |
| | −57.1 | A (1.2 kV) 1.51 | A 20 | B 5.9 | A 3 μm | B 0.5 | A 0 | A 0 | — | A | A 924 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present application claims priority from Japanese Patent Application No. 2008-201075 filed Aug. 4, 2008, No. 2008-201076 filed on Aug. 4, 2008, which are herein incorporated by reference in their entirety.

What is claimed is:

1. A magnetic carrier comprising resin-coated magnetic carrier particles, each of which comprises a porous magnetic core particle made from magnetic ferrite, wherein the surface of the porous magnetic core particle is partially exposed, and wherein the magnetic carrier has an electric field intensity just before break-down of 1,300 V/cm or more and 5,000 V/cm or less.

2. The magnetic carrier according to claim 1, wherein the magnetic carrier does not cause break-down at electric field intensity less than 1,300 V/cm and causes break-down at electric field intensity more than 5,000 V/cm.

3. The magnetic carrier according to claim 1, wherein the porous core particle has a resistivity of $1.0\times10^{6}$ Ω·cm or more and $5.0\times10^{7}$ Ω·cm or less at an electric field intensity of 300 V/cm.

4. The magnetic carrier according to claim 1, wherein the porous core particle has a pore size of 0.8 μm or more and 1.5 μm or less corresponding to a maximum differential pore volume in a pore size range of 0.1 μm or more and 3.0 μm or less as measured by a mercury intrusion method.

5. The magnetic carrier according to claim 1, wherein the pores of the porous magnetic core particle are filled with a silicone resin.

6. The magnetic carrier according to claim 1, wherein the porous core particle has an electric field intensity just before break-down of 400 V/cm or more and 1,000 V/cm or less.

7. The magnetic carrier according to claim 1, wherein the magnetic carrier has a resistivity of $1.0\times10^{6}$ Ω·cm or more and $5.0\times10^{10}$ Ω·cm or less at an electric field intensity of 2,000 V/cm.

8. A two-component developer comprising at least a magnetic carrier and a toner, wherein the magnetic carrier is a magnetic carrier according to claim 1.

9. The two-component developer according to claim 8, wherein an average circularity of the toner having a circle-equivalent diameter of 1.985 μm or more and less than 39.69 μm is 0.940 or more and 1.000 or less.

10. The two-component developer according to claim 8, wherein the toner comprises toner particles and inorganic particles having at least one local maximum in the range of 80 nm or more to 200 nm or less in number-based particle size distribution.

11. The two-component developer according to claim 8, wherein an absolute value of a frictional charge amount measured by applying a two-component method to a two-component developer comprising at least the toner and the magnetic carrier in which a toner concentration is set to be 8 mass % is 40.0 mC/kg or more and 80.0 mC/kg or less.

* * * * *